US011131176B1

(12) United States Patent
Haustveit et al.

(10) Patent No.: US 11,131,176 B1
(45) **Date of Patent: *Sep. 28, 2021**

(54) SYSTEMS AND METHODS FOR CONTROLLING FRACTURING OPERATIONS USING MONITOR WELL PRESSURE

(71) Applicant: Devon Energy Corporation, Oklahoma City, OK (US)

(72) Inventors: Kyle L. Haustveit, Edmond, OK (US); Wolfgang Deeg, Duncan, OK (US)

(73) Assignee: Devon Energy Corporation, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/714,488

(22) Filed: Dec. 13, 2019

Related U.S. Application Data

(63) Continuation of application No. 16/362,214, filed on Mar. 22, 2019, which is a continuation-in-part of application No. 15/879,187, filed on Jan. 24, 2018.
(Continued)

(51) Int. Cl.
*E21B 43/26* (2006.01)
*E21B 43/267* (2006.01)
(Continued)

(52) U.S. Cl.
CPC ..... *E21B 43/267* (2013.01); *E21B 21/08* (2013.01); *E21B 44/005* (2013.01); *E21B 47/06* (2013.01)

(58) Field of Classification Search
CPC ..... E21B 21/08; E21B 43/17; E21B 43/26; E21B 43/267; E21B 44/005; E21B 47/06
See application file for complete search history.

(56) References Cited

U.S. PATENT DOCUMENTS 3,586,105 A * 6/1971 Johnson ..... E21B 43/17 166/250.1
3,933,205 A 1/1976 Kiel
(Continued)

FOREIGN PATENT DOCUMENTS

WO WO 2013-008195 1/2013

OTHER PUBLICATIONS

Dawson et al., Breakthrough in Hydraulic Fracture & Proppant Mapping: Achieving Increased Precision with Lower Cost, Unconventional Resources Technology Conference, San Antonio, Texas, Aug. 1-3, 2016 (21 pages).
(Continued)

*Primary Examiner* — Christopher J Sebesta
(74) *Attorney, Agent, or Firm* — Polsinelli PC; Gregory P. Durbin

(57) ABSTRACT

Systems and methods of hydraulically fracturing subterranean formations include modifying a completion operation parameter for hydraulic fracturing a target well, the target well extending through a subterranean formation and a fracture extending from the target well as a result of the hydraulic fracturing. The modification to the completion operation is responsive to detection of a response of a monitor well extending through the subterranean formation, where the response of the monitor well resulting from interactions between the monitor well and the fracture extending from the target well.

29 Claims, 21 Drawing Sheets

Related U.S. Application Data

(60) Provisional application No. 62/449,905, filed on Jan. 24, 2017.

(51) Int. Cl.
*E21B 21/08* (2006.01)
*E21B 44/00* (2006.01)
*E21B 47/06* (2012.01)

(56) References Cited

U.S. PATENT DOCUMENTS 4,718,490 A 1/1988 Uhri
6,439,310 B1 8/2002 Scott, III et al.
6,886,632 B2 5/2005 Raghuraman et al.
7,066,266 B2 6/2006 Wilkinson
8,204,727 B2 6/2012 Dean et al.
9,103,200 B2 8/2015 Baihly et al.
9,187,984 B2 11/2015 Usadi et al.
2005/0125209 A1* 6/2005 Soliman ..... E21B 43/26 703/10
2005/0189108 A1 9/2005 Davidson
2006/0027280 A1 12/2006 Tubel et al.
2007/0193737 A1 8/2007 Miller et al.
2010/0039893 A1 2/2010 Segal et al.
2011/0048719 A1 3/2011 Baihly et al.
2012/0126992 A1* 5/2012 Rodney ..... E21B 33/0355 340/850
2012/0318500 A1* 12/2012 Urbancic ..... E21B 43/26 166/250.1
2012/0325462 A1 12/2012 Roussel et al.
2013/0029866 A1 1/2013 Sun et al.
2013/0277050 A1* 10/2013 Cherian ..... E21B 43/17 166/271
2013/0298665 A1* 11/2013 Minchau ..... E21B 47/107 73/152.51
2014/0018284 A1 1/2014 Coget et al.
2014/0251626 A1* 9/2014 Gomaa ..... E21B 43/26 166/308.5
2014/0334260 A1 11/2014 Chang et al.
2015/0016743 A1 1/2015 Knee
2015/0047832 A1* 2/2015 Yuan ..... E21B 43/26 166/245
2015/0083398 A1 3/2015 Dawson
2015/0083405 A1* 3/2015 Dobroskok ..... E21B 47/0002 166/250.1
2015/0176394 A1 6/2015 Roussel et al.
2015/0356403 A1 12/2015 Storm, Jr.
2016/0003020 A1 1/2016 Sharma
2016/0018654 A1 1/2016 Haddick et al.
2016/0061016 A1 3/2016 Ciezobka et al.
2016/0061026 A1 3/2016 Cherian et al.
2016/0177708 A1* 6/2016 Stokely ..... E21B 47/135 73/152.32
2016/0237799 A1* 8/2016 Dawson ..... E21B 43/30
2017/0002652 A1* 1/2017 Kampfer ..... E21B 49/008
2017/0342823 A1* 11/2017 Shah ..... E21B 47/091
2019/0346579 A1 11/2019 Roussel et al.

OTHER PUBLICATIONS

Kampfer et al., A Novel Approach to Mapping Hydraulic Fractures Using Poromechanic Principles, American Rock Mechanics Association, Prepared for the 50th US Rock Mechanics/Geomechanics Symposium held in Houston, Texas, Jun. 26-29, 2016 (15 pages).
NSI Technologies, Frac Tips: Can Rate Reductions Near the End of a Frac Treatment Induce Tip Screenout?, NSI Technologies Inc., Tulsa/Houston, vol. 2, No. 1, 2011 (2 pages).

* cited by examiner

1000

| Stage (1002) | Trigger (1004) | Action (1006) | Test (1008) | If Successful (1010) | If Not Successful |
|---|---|---|---|---|---|
| … | … | … | … | … | … |
| 47 | +5 psi on first ramp | Rate cycle to 0 bpm for 3 minutes | Rate of pressure change decrease by >20% | Continue base schedule | After 5 min., repeat rate cycle and start linear gel |
| 48 | +20 psi on first ramp | Rate cycle to 0 bpm for 3 minutes | Rate of pressure change decrease by >20% | Continue base schedule | After 5 min., repeat rate cycle and start linear gel |
| … | … | … | … | … | … |

FIG. 10

SYSTEMS AND METHODS FOR CONTROLLING FRACTURING OPERATIONS USING MONITOR WELL PRESSURE

CROSS-REFERENCE TO RELATED APPLICATION

The present non-provisional utility application is a continuation of U.S. patent application Ser. No. 16/362,214, titled "SYSTEMS AND METHODS FOR CONTROLLING FRACTURING OPERATIONS USING MONITOR WELL PRESSURE," filed Mar. 22, 2019, which is a continuation-in-part of U.S. patent application Ser. No. 15/879,187, titled "SYSTEMS AND METHODS FOR CONTROLLING FRACTURING OPERATIONS USING MONITOR WELL PRESSURE," filed on Jan. 24, 2018, which claims priority under 35 U.S.C. § 119(e) from U.S. Patent Application No. 62/449,905, filed Jan. 24, 2017, entitled "SYSTEMS AND METHODS FOR CONTROLLING FRACTURING OPERATIONS USING MONITOR WELL PRESSURE." The entire contents of each of the foregoing applications and/or patents are incorporated herein by reference for all purposes.

TECHNICAL FIELD

Aspects of the present disclosure involve completion of wellbores for production of hydrocarbons from subterranean formations and, more particularly, fracturing of subterranean formations through which such wellbores extend.

BACKGROUND

Hydraulic fracturing is a technique for improving yields (greater volume over a longer period of time) of oil and/or gas production from unconventional reservoirs, including shales, typically characterized by tight or ultra-tight subterranean formations where the oil or gas in the formation does not flow in commercially viable volumes through conventionally drilled wellbores. In many cases, fracturing is performed in a horizontal section of a wellbore where a vertical section extends from the surface to a target area (pay zone) of the formation, such as shale strata some distance from the surface, and the horizontal section of the wellbore extends from the vertical section and is drilled through the target area. For example, it may be known that shale may be found between 6000 and 7000 feet below the surface of an area, and in some specific formation. In such cases, a vertical section of a well may be drilled to 6500 feet below the surface and the horizontal section of the well may then be drilled outward for several thousand feet from the vertical section within the strata at approximately 6500 feet depth.

Once drilled, a well is generally completed by running and fixing casing within the wellbore (e.g., by cementing), perforating the casing where fracturing is targeted, and applying a well stimulation technique, such as hydraulic fracturing, to the surrounding formation. In open hole wells, the step of running and fixing casing within the well is omitted. Fracturing, generally speaking, involves pumping of fluid from the surface at high rate and pressure into the wellbore and into the formation surrounding the wellbore. The resource bearing formation surrounding the wellbore fractures under the pressure and volume of the injected fluid, increasing the size and quantity of pathways for hydrocarbons trapped within the formation to flow from the formation into the wellbore. The hydrocarbons may then be recovered at the surface of the well.

It is with these observations in mind, among others, that aspects of the present disclosure were conceived.

SUMMARY

In one aspect of the present disclosure, a method of fracturing a subterranean formation is provided. The method includes initiating pumping of a fracturing fluid into a target well according to one or more fracturing operation parameters, the target well extending through a subterranean formation. Subsequent to initiating pumping of the fracturing fluid into the target well, a response of a monitor well extending through the subterranean formation is detected, the monitor well including a sealed monitoring portion. The sealed monitoring portion is substantially filled with a liquid such that the response results from interactions between the sealed monitoring portion and a fracture extending from the target well. The method further includes modifying at least one of the one or more fracturing operation parameters in response to detecting the response of the monitor well.

In another aspect of the present disclosure, a method of fracturing subterranean formations includes initiating pumping of fracturing fluid into a first target well extending through a subterranean formation. Subsequent to initiating pumping of the fracturing fluid into the first target well, a response of a monitor well extending through the subterranean formation is detected, the monitor well including a sealed monitoring portion. The sealed monitoring portion is filled with a liquid such that the response results from interactions between the sealed monitoring portion and a fracture extending from the target well. The method further includes, in response to detecting the response of the monitor well, each of stopping pumping of fracturing fluid into the first target well and initiating pumping of fracturing fluid into a second target well extending through the subterranean formation, the second target well being different than the first target well.

In yet another aspect of the present disclosure, a system for providing a fracturing fluid to a subterranean formation is described. The system includes a pump coupleable to a wellhead of a target well extending through a subterranean formation, the pump configured to provide fracturing fluid to the target well according to one or more fracturing operation parameters. The system further includes a pressure transducer adapted to measure pressure within a monitoring portion of a monitor well, the monitoring portion being sealed and substantially filled with a liquid and a computing device. The computing device is adapted to receive pressure measurements from the pressure transducer, to identify a change in the pressure measurements received from the pressure transducer indicating interaction between a fracture extending from the target well and the monitoring portion, and to generate an alert in response to detecting the change in the pressure measurements.

BRIEF DESCRIPTION OF THE DRAWINGS

The foregoing and other objects, features, and advantages of the present disclosure set forth herein will be apparent from the following description of particular embodiments of those inventive concepts, as illustrated in the accompanying drawings. It should be noted that the drawings are not necessarily to scale; however the emphasis instead is being placed on illustrating the principles of the inventive concepts. Also, in the drawings the like reference characters may refer to the same parts or similar throughout the different views. It is intended that the embodiments and figures disclosed herein are to be considered illustrative rather than limiting.

FIG. 10 is a table illustrating example stages of a well completion.

DETAILED DESCRIPTION

Figure 1:
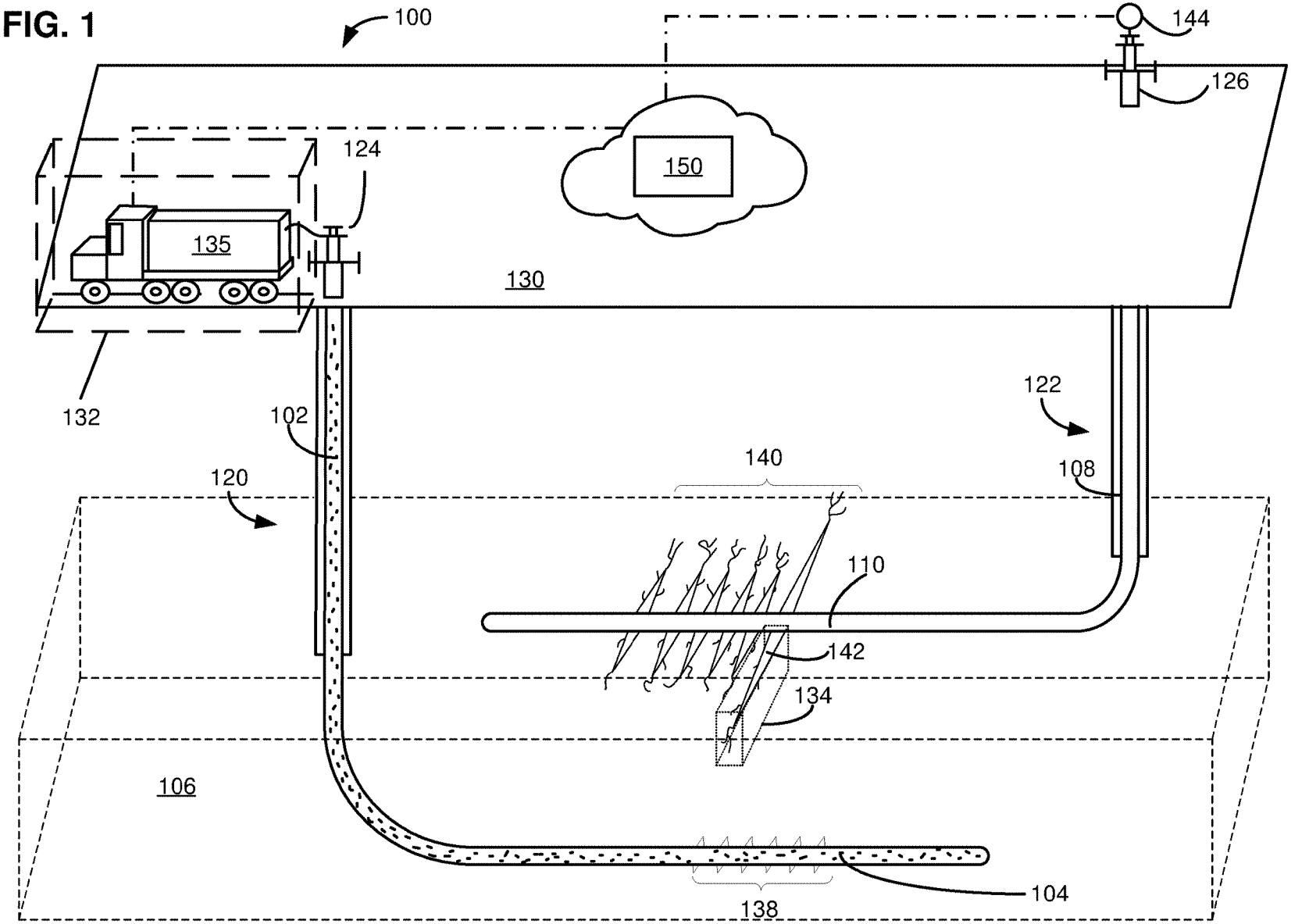
FIG. 1 is a schematic diagram of an example well completion environment for completing a fracturing operation in accordance with the present disclosure.

Aspects of the presently disclosed technology involve controlling one or more aspects of a fracturing operation, alone or in combination. In certain implementations, the presently disclosed technology involves rate cycling of fracturing fluid injected into a wellbore during the fracturing operation based on measurements made at a monitor well. Rate cycling is a technique in which the rate at which fracturing fluid is pumped into a well is varied throughout the fracturing operation. The cycles are controlled based on feedback from the monitor well. Generally, the flow rate may be cycled between a relatively higher flow rate to promote development and propagation of fractures within the formation and a relatively lower flow rate to release stresses induced in the formation during the high flow rate period, although many other cycles and bases for such cycles are possible.

It is understood that rate cycling of fracturing fluid during a fracturing operation may provide several benefits, alone or in combination. First, rate cycling may inhibit focused growth of only a limited number of dominant fractures in an area of the wellbore being completed. Stated differently, controlled rate cycling may distribute the fracturing fluid across many fractures and grow such fractures rather than focusing the fluid to relatively fewer numbers of dominant fractures in any given stage being fractured. Second, rate cycling may initiate new fractures within the stage being completed. Thus, in a simplified example, rather than growing the dominant fracture group, several new fractures may be successively initiated and grown after a rate cycle or rate cycles. Third, rate cycling may be controlled and used to arrest breakthrough of fractures from a wellbore being completed into an adjacent wellbore. Fourth, rate cycling may facilitate fracturing operations without the need for diverters in the fracturing fluid. In effect, it is believed that rate cycling has the effect of diverting an increased proportion of fracturing fluid from dominant fractures undergoing significant propagation prior to the rate cycle into new, or smaller fractures, after the rate cycle. Fifth, rate cycling may facilitate greater production volume and greater production longevity of a fractured wellbore and possibly reduce initial completion costs. For example, it is believed that a greater number of fractures may be initiated resulting in greater production from the wellbore at less relative cost than the same wellbore fractured without the controlled rate cycling techniques described herein. Moreover, the same wellbore may be completed without particulate diverters thus providing additional cost advantages and/or production advantages relative to conventional techniques using particulate diverters.

Propagation and distribution of fractures may also be controlled by varying other parameters of a fracturing operation. Such parameters may include, without limitation, fracturing fluid viscosity, proppant size, proppant concentration, fracturing fluid additive ratios, and fracturing fluid injection rate. To further promote or inhibit fracture growth and distribution, one or more of such parameters may be modified during the course of a fracturing operation in response to measurements obtained from a monitor well and. For example, if increased fracture height is desired, fracturing fluid viscosity may be increased. Conversely, if further fracture height is to be inhibited, viscosity may be reduced. As another example, if increased lateral propagation of fractures is desired, viscosity may be decreased. Conversely, if lateral propagation is to be inhibited, viscosity may be increased.

The success of a fracturing operation generally depends on adequate distribution and propagation of fractures within the area of the formation around a wellbore being fractured. However, due to the remoteness of the fractures being formed it is often difficult or cost-prohibitive to accurately determine how a given fracturing operation is progressing.

To control fracturing operations (e.g., by modifying fracturing operation parameters such as injection rate, viscosity, proppant size, proppant concentration, etc.) during fracturing of a wellbore being completed (referred to herein as an active well), systems and methods according to certain implementations of the present disclosure monitor pressure in an adjacent well, referred to herein as a monitor well. A portion of the monitor well is poroelastically coupleable to the active well such that a pressure response is produced in the monitor well during fracturing of the active well. For example, the monitor well may include a section spaced within 1000 to 2000 feet from the stage of the active well being completed and include at least one fracture, referred to herein as a monitor or transducer fracture, that extends from the monitor well toward the stage of the active well undergoing completion. Stated simply, as fluid is pumped into the active well and fractures are formed and/or propagate through the formation, the transducer fracture is compressed, thereby increasing pressure within the monitor well. More specifically, according to the principles of poroelasticity, fractures propagating from the active wellbore during fracturing induce pressure changes in the monitor well when the fractures from the active well overlap the transducer fracture of the monitor well. When this occurs, pressure in the monitor well increases relative to some baseline pressure or rate of pressure change, such as a leak off rate. Such pressure changes may be observed, for example, as an increase in pressure relative to a baseline pressure of the monitor well or a decrease in the leak off rate of the monitor well as compared to a baseline leak off rate of the monitor well obtained prior to initiating the fracturing operation in the active well.

In certain implementations, characteristics of one or more of the monitor well, the active well, and the transducer fracture are used, at least in part, to characterize the pressure response of the monitor well as well as use the information to further define completion operations. For example, the geometry of the monitor well and/or the transducer fracture may be used in analyzing the pressure response caused by injecting fracturing fluid into the active well. A calibration operation may also be performed to determine characteristics of one or more of the active well, the monitor well, and the subterranean formation between the active well and the monitor well. For example, in one embodiment, a fracture formation rate of the subterranean formation may be determined. To do so, a single entry point may be made in the active well and fracturing fluid may be pumped into the active well at a known rate. When a corresponding pressure response in the monitor well is observed, the single fracture has extended from the active well to overlap the monitor well and/or a fracture of the monitor well. Accordingly, by knowing the distance between the active well and the monitor well/monitor well fracture and the rate at which fracturing fluid was provided to the active well, an approximate relationship between flow rate of fracturing fluid and fracture growth can be determined. For example, if 100 barrels of fracturing fluid cause a pressure response in a monitor well 1000 feet away from the active well, every barrel of fracturing fluid creates approximately 10 feet of fracture half-length.

Changes in the pressure within the monitor well can then be used to approximate, without limitation, the location, size, direction, and similar characteristics of fractures associated with the active well and to dynamically control or inform the fracturing operation. For example, the fracturing operation may be controlled in response to changes in pressure observed within the monitor well by, without limitation, one or more of changing the flow rate of fracturing fluid provided to the active well, changing the duration for which a particular flow rate is maintained, changing the pressure of fracturing fluid provided to the active well, changing the concentration of proppants and/or density of the fracturing fluid, and controlling whether to continue or cease fracturing operations in whole or in part. Such controls may be done alone or in various possible combinations. Accordingly, pressure within the monitor well may be used to dynamically adjust parameters of the fracturing operation in response to characteristics of the subterranean formation through which the fractures extend, characteristics of the fractures, characteristics of initial perforations in the wellbore, and other sources of variability in the fracturing operation.

In certain implementations, control of fracturing operations may be achieved, at least in part, by a computing system adapted to receive and process data collected from the monitor well. The computing system may be communicatively coupled to equipment for performing a fracturing operation such that the computing system may modify one or more operational parameters of the equipment in response to the received data. The logic and outputs governing control by the computing system may be maintained in a fracturing operation plan executable by the computing system. Control of the equipment may also be accomplished, in whole or in part, through manual intervention by an operator. For example, the computing system may receive data and generate an updated fracturing operation plan that may then be manually executed by an operator who activates, deactivates, or otherwise modifies operational parameters of equipment for performing the fracturing operation.

The monitor well is generally capped under pressure and pressure within the monitor well is measured using, for example, gauges, or transducers located at the well head. Alternatively, downhole transducers may be installed within the monitor well and communicatively coupled to communication devices disposed at the well head. In certain implementations in which there is at least some leakage from the monitor well, a baseline leak off rate of the monitor well is obtained prior to fracturing of the active well. The gradual decrease in pressure within the monitor well over time is known as the leak off rate. The leak off rate results from a loss of fluid and pressure into the surrounding formation and surface environment and may be caused by a variety of factors including, but not limited to, small leaks within the monitor well (e.g., through leaks in the casing of the monitor well) or at the surface of the monitor well (e.g., through valves or other surface equipment). The leak off rate is generally a function of the porosity, permeability, and pore pressure of the formation surrounding the monitor well and the baseline leak off rate corresponds to the leak off rate of the monitor well when the active well is not being fractured and often will be done prior to initiation of fracturing of the active well. During completion of the active well, the leak off rate in the monitor well is compared to the baseline leak off rate and/or one or more other observed leak off rates, with the differences being the leak off rates being used to determine when and to what extent to control the fracturing operation. While much of the discussion herein references a comparison to a leak off rate, it is also possible to compare pressure in the monitor well to a discrete pressure value, a discrete flow value or some other discrete attribute of the monitor well indicative of an induced poroelastic effect between fractures forming from the active well and the monitor well.

Initial pressurization of the monitor well can be achieved in various ways. For example, the monitor well may be maintained under pressure following completion/fracturing of the monitor well. Alternatively, the monitor well may be pressurized by injecting fluid, such as water, into the monitor well. Notably, this latter approach facilitates the repurposing of dead or otherwise unused wells as monitor wells. In still other implementations, the monitor well may be a producing well. In implementations in which the monitor well is a producing well, additional steps may be taken to facilitate use of the monitor well including, without limitation, one or more of adding water or other fluids to the monitor well, installing downhole gauges, and estimating hydrostatic pressure within the well based on the fluid being produced in the monitor well.

The foregoing discussion primarily described implementations of the present disclosure in which pressure changes within a monitor well result from poroelastic coupling with an active well that is being fractured and modifying fracturing operations based on such observations. In other implementations of the present disclosure, fracturing operations may be controlled, at least in part, in response to pressure changes induced in the monitor well due to direct fluid communication between the active well and the monitor well. Such direct fluid communication may occur as a result of a fracture fully extending between the active well and the monitor well, thereby enabling fracturing fluid to enter the monitor well. In such circumstances, the pressure response caused by the direct fluid communication may similarly be used to modify or otherwise control fracturing operations.

In still other implementations, control of fracturing operations is achieved without the use of a separate monitor well. Instead of using a monitor well, a portion of the active well is isolated and equipped with a pressure gauge or similar device for measuring pressure within the isolated section. Similar to the previously discussed monitor well, the isolated section may also include a transducer fracture extending into the surrounding subterranean formation. When an uphole section of the well is subsequently fractured, a pressure response may be observed within the isolated section due to poroelastic coupling between the fractures extending from the uphole section and the transducer fracture extending from the isolated section. This pressure response may subsequently be used to control modify or otherwise control fracturing operations.

FIG. 1 is a schematic diagram of an example well completion environment 100 for completing a fracturing operation in accordance with the present disclosure. The well completion environment 100 includes a subsurface formation 106 through which an active well 120 and a monitor well 122 extend. The active well 120 includes a vertical active well section 102 and a horizontal active well section 104. Similarly, the monitor well 122 is also a horizontal well and includes a vertical monitor well section 108 and a horizontal monitor well section 110.

The monitor well 122 includes at least one transducer fracture 142 extending toward the active well 120 with the area from the tip of the transducer fracture 142 rearward toward the monitor well defining a poroelastic region 134. The poroelastic region 134 corresponds to a portion of the subsurface formation 106 where the active well 120 is poroelastically coupleable with the monitor well 122. Poroelastic coupling, as used herein, refers to a physical phenomenon in which two regions within or adjacent to a porous material are arranged such that when a force or pressure is applied to one region, the force or pressure is transmitted, at least in part, to the second region as a result of the poroelastic properties of the material. Accordingly, the poroelastic region 134 corresponds to a region within the subsurface formation 106 and adjacent a fracture of the monitor well 122 in which the active well 120 and the monitor well 122 may be poroelastically coupled to each other. As described below in more detail, such poroelastic coupling occurs when a fracture formed adjacent the active well 120 propagates and overlaps a fracture of the monitor well 122, referred to herein as a transducer fracture 142, enabling observations of pressure or other response within the monitor well 122 during fracturing of the active well 120. Hence, the monitor well 122 includes at least one transducer fracture 142 extending toward the active well 120 such that a region from the tip of the transducer fracture 142 rearward toward the monitor well 122 defines the poroelastic region 134.

The active well 120 includes an active wellhead 124 disposed at a surface 130. Similarly, the monitor well 122 includes a monitor wellhead 126 at the surface 130. The monitor wellhead 126 further includes a pressure gauge 144 for measuring pressure within the monitor well 122. In certain implementations, instead of or in addition to the pressure gauge 144, the monitor wellhead 126 includes a pressure transducer configured to transmit pressure data from the monitor wellhead 126 to a computing system 150. In the well completion environment 100, the computing system 150 is communicatively coupled to a pumping system 132 (illustrated in FIG. 1 as including a pumping truck 135) such that the computing system 150 can transmit pressure data, control signals, and other data to the pumping system 132 to dynamically adjust parameters of the fracturing operation based on pressure measurements received from the monitor wellhead 126. The pumping system 132 generally provides fracturing fluid into the active well 120 and, in certain implementations, may include additional equipment for modifying characteristics of the fracturing fluid and/or the manner in which the fracturing fluid is injected into the active well 120. Such equipment may be used, for example, to add or change a proppant or other additive of the fracturing fluid in order to modify, among other things, the viscosity, proppant concentration, proppant size, or other aspects of the fracturing fluid. Accordingly, such equipment may include, without limitation, one or more of tanks, pumps, filters, and associated control systems. The computing system 150 may include one or more local or remote computing devices configured to receive and analyze the pressure data to facilitate control of the fracturing operation.

The computing system 150 may be a single computing device communicatively coupled to components of the well completion environment 100, or forming a part of the completion environment 100, or may include multiple, separate computing devices networked or otherwise coupled together. In the latter case, the computing system 150 may be distributed such that some computing devices are located locally at the well site while others are maintained remotely. In certain implementations, for example, the computing system 150 is located locally at the well site in a control room, server module, or similar structure. In other implementations, the computing system is a remote server that is located off-site and that may be further configured to control fracturing operations for multiple well sites. In still other implementations, the computing system 150, in whole or in part, is integrated into other components of the well completion environment 100. For example, the computing system 150 may be integrated into one or more of the pumping system 135, the active wellhead 124, and the monitor wellhead 126. The pressure gauge 144 is configured to measure pressure within the monitor well 126 during fracturing of the active well 120. As shown in the well completion environment 100, the pressure gauge 144 is coupled to the monitor wellhead 126.

The pressure gauge 144 is communicatively coupled to the computer system 150, such as by a pressure transmitter. In alternative implementations, the pressure gauge 144 may be replaced or supplemented with other pressure measurement devices. For example, in certain implementations, pressure may be measured using, without limitation, one or more digital and/or analog pressure gauges coupled to the monitor wellhead 126, downhole pressure transmitters disposed within the monitor well 124, and pressure sensors incorporated into one or more flow meters (such as differential pressure flow meters). The pressure measurement device may be permanently fixed into casing, coiled tubing, or other structure disposed within the active well 120 or may be temporarily inserted into the active well 120 using, for example, a wireline or other conveyance. In still other implementations, other measuring devices may be used to indirectly determine pressure within the monitor well 120, such as by measuring a temperature within the monitor well 120 that is then used to determine pressure within the monitor well 120.

Well completion environment 100 is depicted after perforation but before fracturing of the active well 120. Accordingly, active well horizontal section 104 includes a plurality of perforations 138 extending into subsurface formation 106 and, more specifically, towards the poroelastic region 134. The entire formation surrounding the wellbores may demonstrate poroelasticity. The term poroelastic region is meant to refer to the area, typically between the wellbores, where a propagating fracture from the active wellbore may overlap a fracture (e.g., the transducer fracture 142) extending from the monitor well 122 and produce a poroelastic response in the monitor well 122. The perforations 138 are formed during completion of the active well 120 to facilitate introduction of fracturing fluid into the subsurface formation 106 adjacent the horizontal active well section 104. For example, in certain completion methods, casing is installed within the well and a perforating gun is positioned within the active well 120 adjacent the portion of the subsurface formation 106 to be fractured. The perforating gun includes shaped charges that, when detonated, create perforations that extend through the casing and into the adjacent formation, thereby creating an initial fluid path from the subsurface formation 106 into the active well 120. During fracturing, fracturing fluid is pumped into the active well 120 and the fluid passes through the perforations 138 under high pressures and rate. As pressure increases, the fracturing fluid injection rate increases through the perforations 138, forming fractures that propagate through the subsurface formation 106, thereby increasing the size and quantity of fluid paths between the subsurface formation 106 and the active well 120. In contrast to the active well 120, the monitor well 122 is previously completed and includes one or more fractures 140. It is also possible that the monitor well 122 intersects one or more preexisting fractures, which may serve as transducer fractures. Hence, the monitor well 122 includes at least one transducer fracture 142 extending toward the active well 120 with the area from the tip of the transducer fracture 142 rearward toward the monitor well being the poroelastic region 134.

Alternative fracturing methods may also be used in conjunction with the systems and methods disclosed herein. For example, in certain implementations, the fracturing operation is an open-hole fracturing operation. In contrast to methods in which a casing is installed and then perforated prior to fracturing, open-hole fracturing is performed on an unlined section of the wellbore. Generally, open-hole fracturing involves isolating sections of the uncased wellbore using packers or similar sealing elements. Sliding sleeves or similar valve mechanisms disposed between the packers are then opened to permit pumping of the fracturing fluid into the surrounding formation. As pressure within the formation increases, fractures are formed and propagated. In multistage wells, this process is repeated for each stage moving up the wellbore.

The active wellhead 124 is coupled to a pump system 132 for pumping fracturing fluid into the active well 120. In the well completion environment 100, for example, the pump system 132 includes a pump truck 135 coupled to the active wellhead 124. The pump truck 135 includes a tank or other means for storing the fracturing fluid and a pump coupleable to the active wellhead 124 for pumping fluid into the active well 120. In other embodiments, the pump system 132 includes other equipment for providing fracturing fluid to the active well 120 including, without limitation, storage tanks or other vessels and one or more additional pumps. The pump system 132 may further include equipment configured to modify the fracturing fluid, for example, by adding one or more additives, such as proppants, to the fracturing fluid. The pump system 132 may also include equipment, such as filters, to treat and recycle fracturing fluid. As shown in the implementation of FIG. 1, the pump system 132, and more particularly pump truck 135, is communicatively coupled to the computing system 150. Accordingly, the pump truck 135 can receive sensor data, control signals, or other data from the computing system 150, including data configured to be used in control and monitoring of an ongoing fracturing operation.

During fracturing, fracturing fluid is pumped by the pumping system 132 into the active well 120. The fracturing fluid enters the subsurface formation 106 through the perforations 138. As the fracturing fluid continues to enter the subsurface formation 106, pressure within a portion of the subsurface formation 106 adjacent the perforations 138 increases, leading to the formation and propagation of fractures within the subsurface formation 106. As the fractures from the active well 120 propagate into the poroelastic region 134, the active well 120 and the monitor well 122 become poroelastically coupled. More specifically, one or more dominant fractures (such as the dominant fracture 212 illustrated in FIG. 2A) from active well 120 extend into the poroelastic region 134 and overlaps the transducer fracture 134 of the monitor well 122. As a result, the active well 120 and the monitor well 122 become poroelastically coupled such that forces or pressures applied to the subsurface formation 106 by injection of the fracturing fluid into the active well 120 are transmitted through the poroelastic region 134 and applied to the transducer fracture 142 of the monitor well 122. The transmitted forces or pressures create a pressure response in the monitor well 122 that may be measured using pressure gauge 144 or other pressure measurement device and used to dynamically adjust the fracturing operation. For example, in one embodiment, measurements from pressure gauge 144 are used to determine when to initiate a rate cycle (or change to one or more other fracturing operation parameters) during the fracturing operation. Additional details regarding the relationship between pressure in the monitor well 122 and control of the fracturing operation are discussed below in more detail with respect to FIG. 2A.

In alternative implementations of the present disclosure, one or both of the active well 120 and the monitor well 122 are vertical wells. Moreover, implementations of the present disclosure may include more than one active well and/or more than one monitor well. For example, multiple monitor wells may be used to monitor fracturing of one active well.

In addition to or instead of poroelastic coupling of the active well 120 and the monitor well 122, the active well 120 and the monitor well 122 may be directly coupled such that they are in direct fluid communication with each other. For example, during the fracturing operation, a fracture extending form the active well 120 may intersect one or more of the transducer fracture 142, a different fracture of the monitor well 122, and the monitor well 122 itself. In such instances, pumping of fracturing fluid into the active well 120 will induce a pressure response in the monitor well 122 that may be used to actively control the corresponding fracturing operation. Notably, the active well 120 and the monitor well 122 may be both poroelastically coupled and in direct fluid communication with each other such that the pressure response observed in the monitor well 122 is a result of both poroelastic coupling and direct coupling. Additionally, depending on the porosity of the formation and other factors, pumping fluid into the active well 120 may generate some pressure response in the monitor well 122 without poroelastic coupling or direct fluid communication. For example, after pumping of fracturing fluid for a particular stage has been completed, the recently injected fracturing fluid may leak off into the monitor well 122 creating a pressure response within the monitor well 122 independent of poroelastic coupling.

As noted above, well completion environment 100 includes one active well 120 and one monitor well 122. In alternative implementations, well completion environments in accordance with this disclosure may include more than one of either active wells or monitor wells. For example, in certain implementations, multiple monitor wells may monitor fracture growth in one or more active wells. Because each monitor well has a different location and orientation, each monitor well would therefore identify fracture growth in different directions. Similarly, one monitor well may be used to monitor fracture growth in multiple active wells. For example, one active well may be positioned between two or more active wells such that the monitor well is poroelastically coupleable and provides a pressure response when fracturing any of the active wells.

Figure 2A:
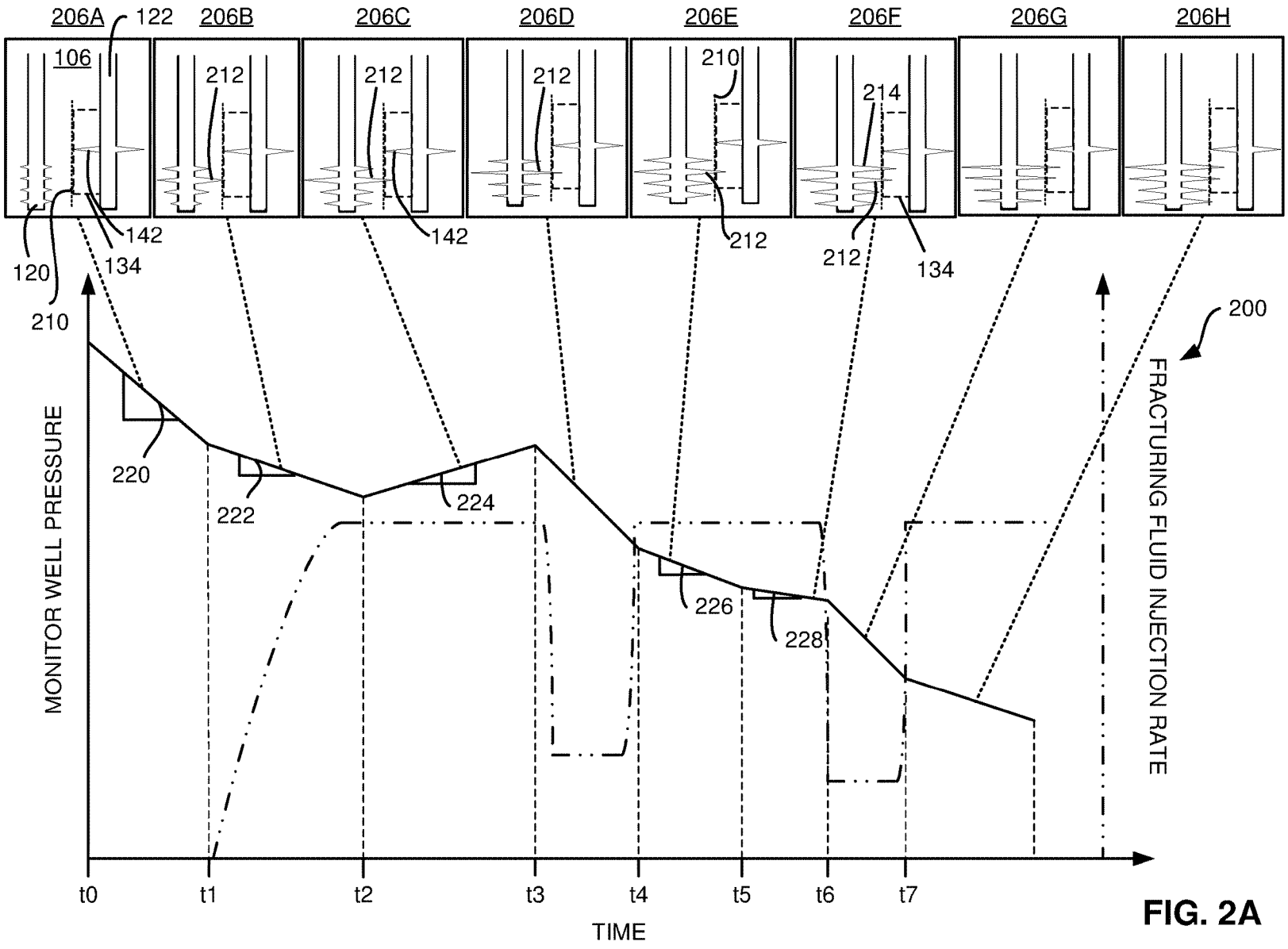
FIG. 2A is an example graph illustrating monitor well pressure and fracturing fluid flow rate over time during a fracturing operation.

FIG. 2A is an example graph 200 illustrating monitor well pressure and fracturing fluid flow rate over time during a fracturing operation according to the present disclosure. For explanatory purposes, the following description of FIG. 2A references components of the well completion environment 100 of FIG. 1. Accordingly, the graph 200 includes a pressure line 202 (shown as a solid line) corresponding to pressure readings obtained from a pressure gauge 144 or transducer configured to measure pressure within the active well 122 and a flow rate line 204 (shown as a periodic dashed line) corresponding to the flow rate of fracturing fluid provided by a pumping system 132 into the active well 120 during the fracturing operation. FIG. 2A further includes a set of schematic illustrations 206A-H. The illustrations 206A-H depict, during various stages of the fracturing operation, each of the horizontal active well section 104, the horizontal monitor well section 110, the poroelastic region 134 disposed between the active well 120 and the monitor well and a plane 210 (to not unnecessarily obscure the illustrations not every feature is labeled in each illustration). The plane 120 corresponds to the point in the poroelastic region 134 beyond which the active well 120 and the monitor well 122 become poroelastically coupled. Accordingly, as a fracture from the active well 120 propagates beyond the plane 120, a pressure response becomes observable within the monitor well 122 due to poroelastic coupling. For purposes of simplicity, only the transducer fracture 142 of the monitor well 122 is depicted in illustrations 206A-H.

The fracturing operation depicted in the graph 200 of FIG. 2A generally illustrates an implementation of systems and methods described herein for controlling rate cycling of a fracturing operation. More specifically, the fracturing operation controls rate cycling of a fracturing operation in the active well 120 based on pressure changes (and/or lack of pressure changes) observed in the monitor well 122, where the changes in the rate of pressure change are due to poroelastic coupling of the active well 120 and the monitor well 122. As previously discussed, rate cycling generally involves pumping fracturing fluid into a subterranean formation at other than a steady flow rate. Accordingly, the pressure changes observed in the monitor well 122 are used to trigger various changes in the flow rate of fracturing fluid pumped into the active well 120. In other implementations, changes in pressure within the monitor well 122 can be used to control other parameters of the fracturing operation alone or in combination with parameters relating to rate cycling. For example, and without limitation, changes in pressure within the monitor well 122 can be used to control one or more fracturing operation parameters including, without limitation, the pressure at which fracturing fluid is pumped into the active well 122, the concentration of proppants or additives within the fracturing fluid, the density of the fracturing fluid, and the type of fracturing fluid used. In many cases, such changes may further be coordinated with rate cycling but may not occur at the same times as rate is changed. For example, one or more of the fluid pressure, proppant/additive concentration, fluid density, and type of fracturing fluid may be changed as the fluid flow rate is increased or decreased at the beginning or end of a rate cycle or at any time after the target rate for the rate cycle is achieved.

Referring now in more detail to FIG. 2A, during time interval t0 to t1, a baseline leak off rate for monitor well 122 is obtained. The baseline leak off rate is the rate at which pressure within monitor well 122 declines absent influence from the active well 120. More particularly, the baseline leak off rate is the rate at which pressure reduces within monitor well 122 absent pressure effects attributable to pumping fracturing fluid into the active well 120 due to poroelastic coupling of the active well 120 and the monitor well 122. The baseline rate is indicated in the graph 200 by a baseline slope 220.

After a baseline leak off rate is established, fracturing fluid is pumped into the active well 122. More specifically, during interval t1 to t2, the pump system 132 is activated and the flow rate of fracturing fluid into the active well 120 is increased until a first flow rate is reached at time t2. As illustrated in the transition between schematic illustration 206A and 206B, the introduction of fracturing fluid into active well 120 induces propagation of fractures originating from the active well 120, including the formation of a first dominant fracture 212. As fluid is pumped into the active well 120 at an increasing flow rate, the first dominant fracture 212 begins to enter the poroelastic region 134 by crossing the plane 120 indicating when poroelastic coupling occurs. During this ramp up period, a pressure increase is observed within the monitor well 122 because of the poroelastic coupling between the first dominant fracture 212 and the transducer fracture 142. This pressure increase is illustrated in the graph 200 as a reduction in slope of the pressure line between times t1 and t2. The rate of pressure change during time interval t1 to t2, illustrated by a first slope 222, is reduced as compared to the baseline slope 220 observed during time interval t0 to t1. Notably, the first slope 222 is still negative, indicating that pressure within the monitor well 122 is still declining despite the pressure effects caused by the fracturing fluid. However, the rate at which the pressure is declining during time interval t1 to t2 is less than that observed during time t0 to t1.

At time t2 (and as shown in illustration 206C) the first flow rate is reached and the first dominant fracture 212 continues to propagate and further overlap the transducer fracture 142. As indicated in time interval t2 to t3, achieving the first flow rate and the corresponding progression of the first dominant fracture 212 into the poroelastic region 134 results in an even greater increase of pressure within monitor well 122 as compared to the pressure increase observed during time interval t1 to t2. In the example provided, the pressure increase experienced during time interval t2 to t3 is significant enough to cause the pressure within monitor well 122 to increase between time t2 and t3 as indicated by a second, positive slope 224.

At time t3, a rate cycle is initiated by reducing the fracturing fluid flow rate provided by the pumping system 132. The reduction in fracturing fluid flow rate induces a relaxation of the poroelastic region 134 and a corresponding reduction in pressure within the monitor well 122. Accordingly, the leak off rate (i.e., the change in pressure of the monitor well 122 over time) during time interval t3 to t4 substantially returns to the baseline leak off rate measured during time interval t0 to t1. As shown in illustration 206D, relaxation of the poroelastic region 134 may further result in closure, in whole or in part, of fractures within the subterranean formation 106, including the first dominant fracture 212.

Figure 2B:
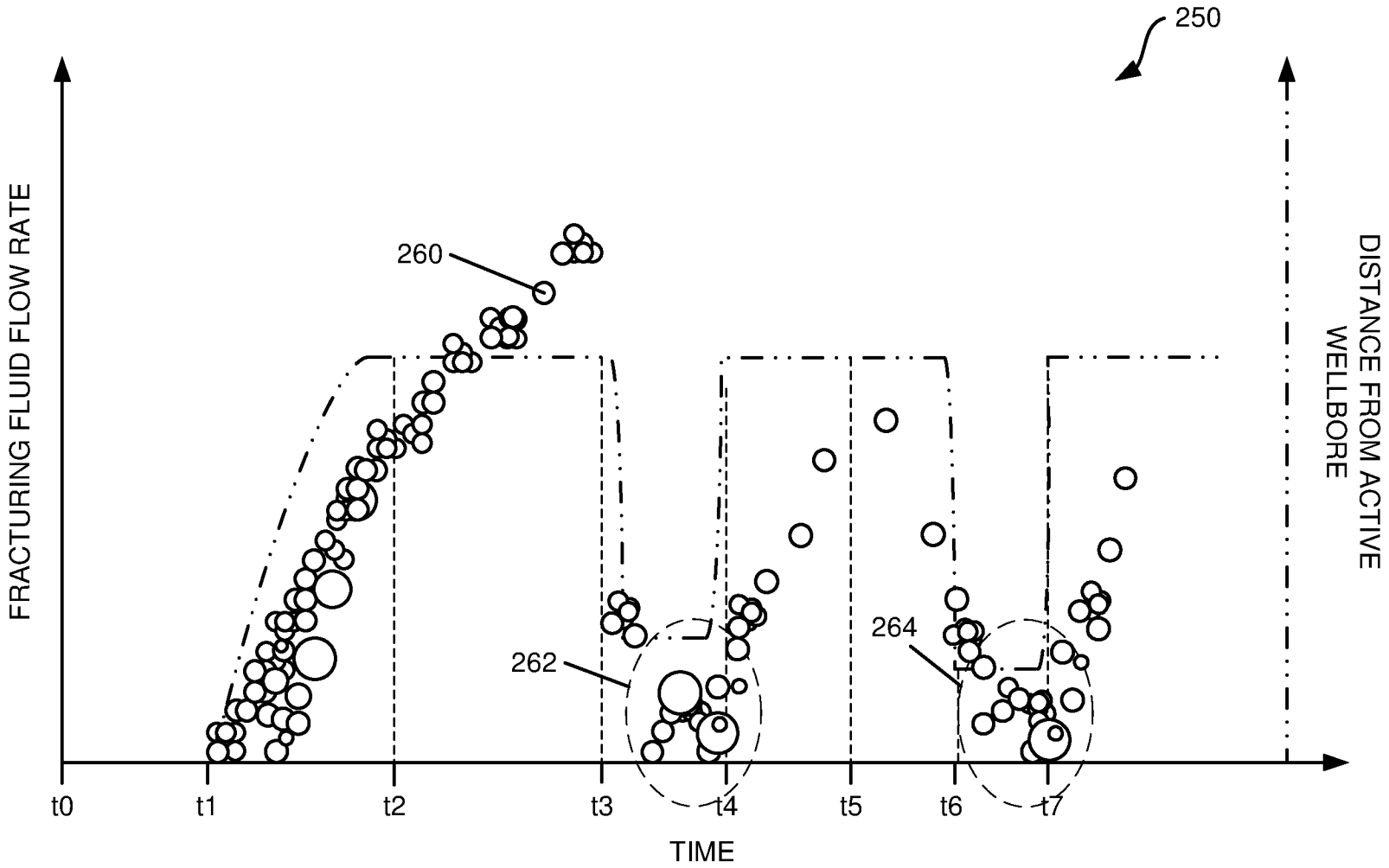
FIG. 2B is a second example graph illustrating microseismic data corresponding to the fracturing operation illustrated by the graph of FIG. 2A.

FIG. 2B is a second graph 250 illustrating additional data corresponding to the fracturing operation illustrated by graph 200 of FIG. 2A and, more specifically, additional data corresponding to the occurrence of microseismic events within the active well 120 during the fracturing operation of FIG. 2A. The data illustrated in the second graph 250 generally corresponds to experimental results observed during fracturing operations similar to that depicted in FIG. 2A. Microseismic events are represented in the second graph 250 as circular indicators, such as indicator 260, with the relative magnitude of the microseismic event indicated by the relative size of each indicator. As illustrated in the second graph 250, initial fracturing of the active well 120 occurs between time interval t1 to t3 and results in microseismic events displaced progressively farther into the subterranean formation from the active wellbore. When the flow of fracturing fluid is reduced at time t3, microseismic events occur nearer the active wellbore, as indicated by a first cluster 262. The microseismic events are generally the result one or more of closure of fractures formed during the prior high flow rate cycle and the formation of new fractures and/or propagation of existing fractures closer to the active wellbore. As described in more detail below, a second rate cycling occurs at time interval t7. The second rate cycling results in a second cluster 264 of microseismic events near the wellbore. Similar to the first cluster 262, the second cluster 264 generally corresponds to closure of fractures formed in the previous high flow rate period (i.e., time interval t4 to t5), or formation of new fractures or propagation of existing fractures near the wellbore. The closure of fractures or slowing of growth during a rate cycle aids in the treatment of smaller, non-dominant fractures by diverting the fracturing fluid away from the dominant fracture. More specifically, the energy required to reinitiate the slowed or closed fracture may exceed that required to begin propagating one of the other smaller, non-dominant fractures. The opening of fractures near the wellbore results in higher fracture intensity and/or complexity near the wellbore and, as a result, greater production from the well.

At time t4, a second fracturing cycle is initiated by increasing the fracturing fluid flow rate to that used during time interval t2 to t3. Similar to time interval t2 to t3, the increased flow rate of fluid into the active well 120 induces a pressure increase within the monitor well 122, as indicated by a third slope 226 which is less negative than the baseline slope 200. Notably, the third slope 226 is also more negative than the second slope 224 observed during time interval t2 to t3 (i.e., during formation and propagation of the first dominant fracture 212). Based on the difference between the second slope 224 and the third slope 226 and the fact that the fracturing fluid flow rate is substantially identical during the two time intervals, it can be inferred that the first dominant fracture 212 receives a lesser proportion of the fracturing fluid being pumped into the active well 120. In other words, a higher proportion of the fracturing fluid is being diverted to secondary fractures, promoting propagation of the secondary fractures.

As noted above, allowing fractures within the subterranean formation to partially or completely close promotes fracturing fluid flow into secondary fractures nearer the wellbore. In certain implementations, the increased diversion of fracturing fluid to secondary fractures observed during time interval t4 to t5 is achieved without the use of known chemical or mechanical diversion techniques, thereby resulting in improved efficiency of the well completion process. In chemical diversion, for example, a first fluid is pumped into the wellbore that solidifies and seals certain fractures in order to divert fracturing fluid to other, unsealed fractures or portions of the wellbore. Following fracturing, a second fluid is pumped into the well to dissolve the first fluid. Similarly, in mechanical diversion, a mechanical device, such as a ball or packer assemblies, is used to temporarily plug a first portion of the wellbore to divert fracturing fluid to a second portion of the wellbore. Subsequently, the mechanical device must be either dissolved or drilled out to reestablish fluid communication with the first portion of the wellbore. Each of these traditional diversion methods requires additional fluid pumping cycles and/or tool runs, resulting in increased completion time and costs.

As the secondary fractures propagate, one of the secondary fractures may overtake the first dominant fracture 212. As shown in illustration 206F and indicated by time interval t5 to t6, a second dominant fracture 214 has propagated into the poroelastic region 134 and overtaken the first dominant fracture 212. Overtaking by one of the secondary fractures may be observed as a variation in the rate of pressure change within the monitor well 122. In the graph 200, the fourth slope 226 corresponds to a rate of pressure change when the first dominant fracture 212 is dominant. Accordingly, if a rate of pressure change is observed within the monitor well 122 that differs from the fourth slope 226, it can be inferred that a secondary fracture has overtaken the first dominant fracture 212. In the graph 200, the rate of pressure change within the monitor well changes at time t5 to a fifth slope 228, indicating a change in the growth rate of the dominate fracture, potentially being the emergence of a new dominant fracture, i.e., the second dominant fracture 214. Unlike the pressure increase experienced during time interval t2 to t3, the pressure increase induced during time interval t5 to t6 is insufficient to cause an increase in pressure within the monitor well 122 but merely causes a further decrease in the leak off rate.

At time t6, a second rate cycle is initiated by reducing the fracturing flow rate for a second time. This reduction induces another relaxation of the poroelastic region 134, facilitating a return of the monitor well 122 to the baseline leak off rate observed during time interval t0 to t1. At time t7, a third fracturing cycle is initiated by increasing the fracturing fluid flow rate.

The process of cycling fracturing fluid flow rate can be repeated as many times as required to achieve sufficient fracturing of the subsurface formation 106. Whether sufficient fracturing of the subsurface formation 106 has been achieved may be determined using various techniques including, without limitation, counting the occurrence of a predetermined number of rate cycles, pumping a predetermined volume of the fracturing fluid into the active well, pumping the fracturing fluid for a predetermined time, observing temperature changes within the subterranean formation, and observing microseismic events within the subterranean formation. In certain implementations, completion of the fracturing operation may be determined by pressure responses in the monitor well. For example, the fracturing operation may be deemed completed when subsequent rate cycling does not induce variable pressure responses in the monitor well 122 or any pressure response at all. Such behavior of the monitor well 122 may indicate that either fracturing fluid is no longer being diverted to fractures other than the dominant fracture or that the majority of fractures from the active well already overlap the transducer fracture.

Figure 3:
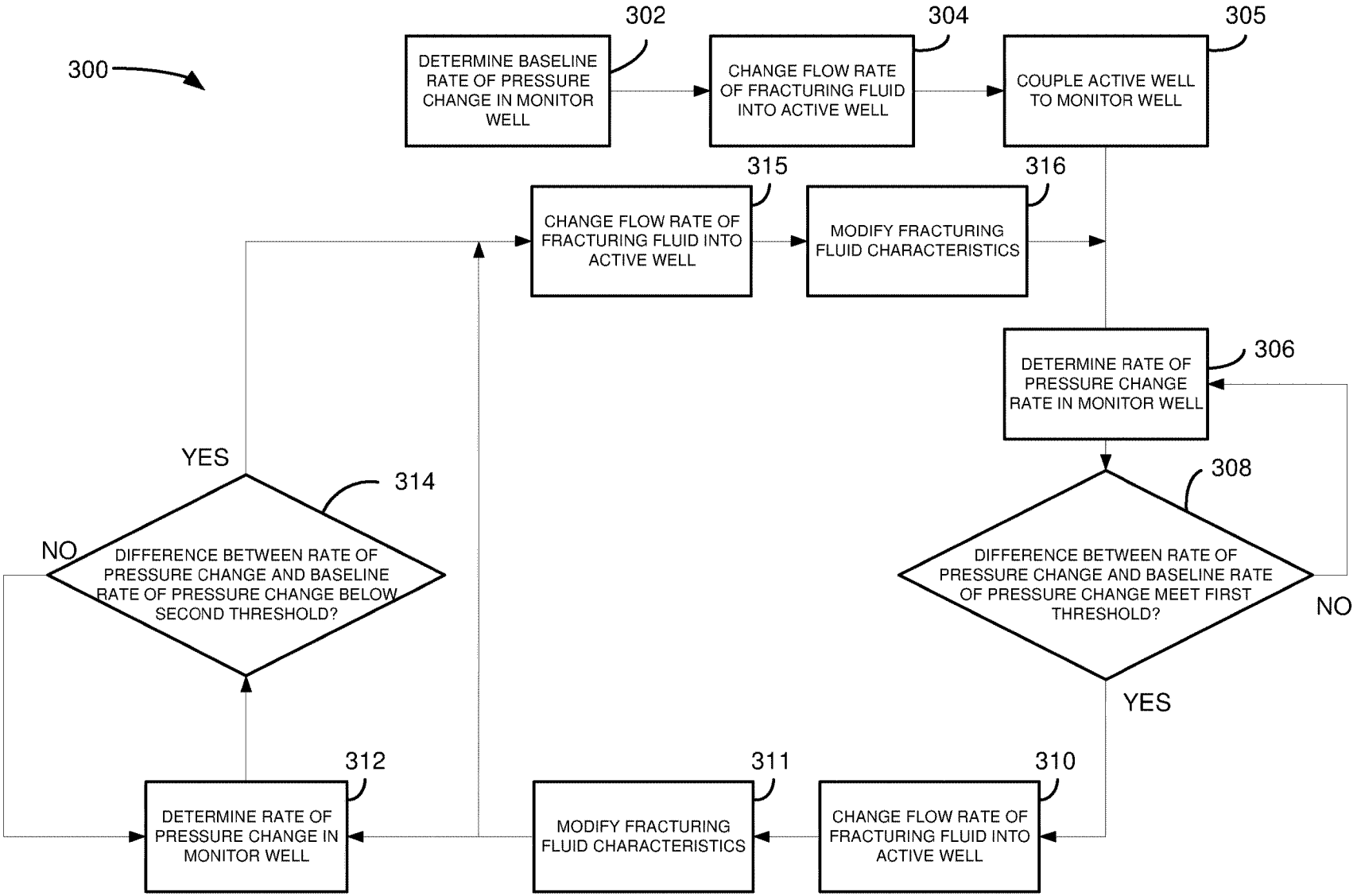
FIG. 3 is a flow chart illustrating an example method for controlling rate cycling during a fracturing operation.

FIG. 3 is a flow chart illustrating an example method 300 for controlling rate cycling during a fracturing operation. Nevertheless, the approach of the method 300 may be more generally applied to controlling other fracturing operation parameters including, but not limited to one or more of fracturing fluid injection rate, fracturing fluid type, proppant concentration, proppant size, and diverter concentration. With reference to the well completion environment 100 (shown in FIG. 1), example method 300 includes an operation 302 that determines a baseline rate of pressure change in the monitor well 122. Determining the baseline rate of pressure change may include observing pressure within the monitor well 122 over time, such as by referring to pressure measurements obtained from a pressure gauge 144 coupled to a monitor wellhead 126 over a known time interval. In certain implementations, the baseline rate of pressure change corresponds to a leak off rate of the monitor well 122.

Prior to obtaining a baseline pressure rate change, the monitor well 122 may be pressurized. In certain implementations, pressurization of the monitor well 122 occurs as a result of completion of the monitor well 122. For example, the monitor well 122 is pressurized as a result of a fracturing operation applied to the monitor well 122. In other implementations, the monitor well 122 may be pressurized by injection of fluid, such as water, into the monitor well 122. In one specific example, the monitor well may be filled with water and the leak off rate measured thereafter. The volume of fluid (water) in the well provides hydrostatic pressure sufficient to measure leak off rate, in one example.

After obtaining a baseline rate of pressure change and coupling, an operation 304 changes the flow rate of fracturing fluid into a well to be fractured, such as the active well 120 shown in FIG. 1. More particularly, after the baseline rate of pressure change is obtained, the flow rate of fracturing fluid into the active well 120 is increased. In one implementation, a pumping system 132 injects the fracturing fluid into the active well 120. Stated differently, fracturing may be initiated in the active well while at the same time monitoring pressure, or some other parameter sufficient to infer a poroelastic effect between the monitor and the active well, at the monitor well.

As fracturing fluid is pumped into the active well 120, an operation 305 couples the active well 120 to the monitor well 122. In certain implementations, the coupling operation includes poroelastically coupling the active well 120 to the monitor well 122. In alternative implementations, the active well 120 and the monitor well 122 are directly coupled and in fluid communication instead of or in addition to being poroelastically coupled.

Subsequent operations 306, 308 identify or otherwise determine the rate of pressure change in the monitor well 122 and whether the difference between the rate of pressure change in the monitor well 122 and the baseline rate of pressure change obtained during operation 302 exceeds a first predetermined threshold. As long as the difference does not exceed the first predetermined threshold, operations 306 and 308 are repeated, either continuously or at discrete time intervals. In other words, the rate of pressure change within the monitor well 122 is observed and compared to the baseline rate of pressure change to determine when injecting fracturing fluid into the active well 120 creates a pressure response in the monitor well 122. The pressure response observed in the monitor well 122 is due, at least in part, to the poroelastic coupling between the active well 120 and the monitor well 122 and the transmission of pressure from the active well 120 to the monitor well 122 through the poroelastic region 134.

The present disclosure contemplates any number of possible fracturing fluid pumping parameter changes based on the pressure response in the monitor well. The difference in slope may be used, the time at which some difference is maintained, the degree of change in pressure, as well as other factors. Hence, various possible parameters and combination of parameters may be used as a threshold. Similarly, the number and type of response to the change may be any number of possibilities. For example, one rate cycle may occur, stepped cycles may occur, cycles may occur at different intervals and to different degrees, other changes, such as proppant or viscosity changes may be coordinated with the changes.

When the observed difference between the dynamically measured rate of pressure change and the base line rate of pressure change exceeds the predetermined threshold, an operation 310 changes the flow rate of fracturing fluid into the active well 120. In certain implementations, the flow rate is decreased to a lower flow rate, including no flow, for a predetermined period of time. In such implementations, the previously injected fluid may be permitted to flow from the active well into a tank or other storage system. In still other embodiments, the flow rate may be increased.

In addition to changing the flow rate of fracturing fluid into the active well 120, an operation 311 to modify characteristics of the fracturing fluid may be carried out. For example, and without limitation, one or more of the density, viscosity, proppant type, proppant concentration, additive concentration, and other characteristics of the fracturing fluid may be modified in response to the rate of pressure change observed in the monitor well.

In certain implementations, an operator may manually change the flow rate of fracturing fluid provided by the pumping system 132 in response to a system generated prompt. For example, the system 150 may generate commands or prompts, in response to some change in the monitor well pressure, guiding the operator to adjust the flow rate provided by the pumping system 132. Commands may be sent directly to the pumping system 132 or may generate an alert, prompt, or similar response on a control panel, graphical user interface, or other device of a user of the pumping system 132. In alternative embodiments, the pumping system 132 is communicatively coupled to a computing device, such as the computing system 150 of FIG. 1, that is configured to receive pressure measurements from the monitor well 122 and to provide control signals to the pumping system 132.

In certain implementations, the fracturing fluid flow rate is reduced during operation 310. After reduction of the fracturing fluid flow rate, operations 312, 314 determine the rate of pressure change in the monitor well 122 and whether the difference between the rate of pressure change in the monitor well 122 and the baseline rate of pressure change obtained during operation 302 are below a second predetermined threshold. As long as the difference is above the second predetermined threshold, operations 306 and 308 are repeated, either continuously or at discrete time intervals. In other words, the rate of pressure change within the monitor well 122 is observed and compared to the baseline rate of pressure change to determine when the pressure response observed in the monitor well 122 has subsided, thereby indicating sufficient relaxation of the poroelastic region 134 between the active well 120 and the monitor well 122. After such subsidence, the fluid flow rate of the fracturing fluid and the fracturing fluid characteristics are again modified in operations 315 and 316, respectively, thereby initiating a second rate cycle. Subsequent cycles may be conducted until sufficient fracturing of the active well 120 is achieved.

In alternative implementations, the duration for which a flow rate is maintained before rate cycling can be based on observations of microseismic events within the active well 120. As previously discussed in the context of FIGS. 2A and 2B, reducing the flow rate of the fracturing fluid pumped into the active well 120 generally leads to the occurrence of microseismic events near the wellbore, which generally indicate closure of fractures or formation and/or propagation of fractures other than the dominant fracture. Accordingly, observation of such microseismic events may be used to determine when to increase the flow rate of fracturing fluid. For example, in certain implementations the flow rate of the fracturing fluid is increased when one or more microseismic events occurs having a minimum predetermined magnitude and/or within a predetermined distance from the wellbore. Alternatively, a flow rate may be maintained for some period of time and/or at some prescribed level prior to rate cycling. Hence, a second threshold is not used to determine when to change flow rates.

Method 300 is intended only as an example embodiment of a method in accordance with the present disclosure and alternative implementations are possible. In one alternative implementation, flow rate of the fracturing fluid is increased and/or decreased in response to the difference between the baseline rate of pressure change and the observed rate of pressure change being maintained for a predetermined amount of time. In still other implementations, other parameters may be modified in addition to or instead of the flow rate of the fracturing fluid. Such parameters include, without limitation, the type of fracturing fluid being used, the relative proportion of components of the fracturing fluid, the amount or type of proppant added to the fracturing fluid, and the amount or type of other additive either added to or excluded from the fracturing fluid. Moreover, modifications to any parameters associated with the fracturing operation may vary from rate cycle-to-rate cycle. For example, the flow rates used during one rate cycle may differ from prior or subsequent rate cycles.

In certain implementations, properties of the fracturing fluid including, without limitation, one or more of the density, viscosity, proppant type, proppant concentration, additive concentration, and other characteristics of the fracturing fluid may be modified in response to the rate of pressure change observed in the monitor well 122. For example, rate cycling may induce only a minor variation or no variation in the rate of pressure change within the monitor well 122. Such minimal changes may indicate that a less than desirable amount of the fracturing fluid is being diverted away from the dominant fracture. To promote diversion of fracturing fluid, various techniques may be applied. For example, the size and/or concentration of proppant may be increased to promote bridging in the dominant fracture, thereby obstructing the flow of fracturing fluid into the dominant fractures. In another technique, the viscosity of the fracturing fluid may be changed. More specifically, a high viscosity fracturing fluid may be used to form a high viscosity "plug" in the dominant fracture that prevents or resists a subsequently injected low viscosity fluid from entering the dominant fracture.

The example implementation of the present disclosure illustrated in FIG. 1 included a wellhead 126 and corresponding pressure gauge 144 for measuring pressure within the monitor well 122. In the example, the monitor well 122 defines a single volume such that pressure changes induced by poroelastic coupling between the active well 120 and any portion of the monitor well 122 are reflected by the pressure gauge 144. In other implementations, however, a monitor well may be divided into isolated intervals with each interval having a respective pressure gauge (or similar sensor adapted to measure pressure) and a respective transducer fracture. By doing so, pressure responses in each interval may be monitored to detect fracture propagation through distinct portions of a subterranean formation. The pressure responses may then be used to modifying fracturing operation parameters, thereby controlling fracturing operations. An example of such an implementation is provided in the following discussion with reference to FIGS. 4 and 5.

Figure 4:
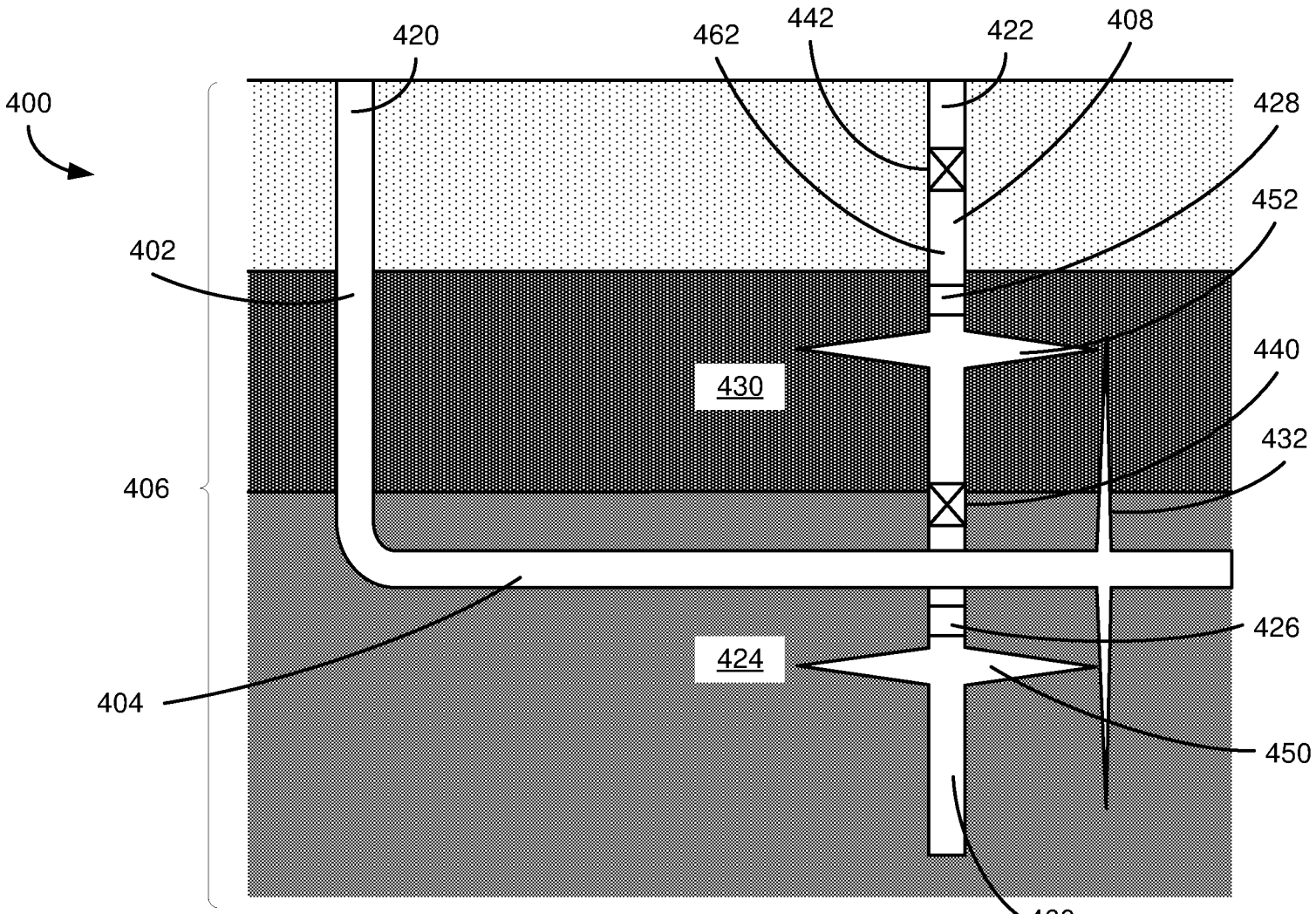
FIG. 4 is a schematic diagram of a second example well environment including multiple monitor well gauges.

FIG. 4 is a schematic diagram of a second example well completion environment 400 for completing a fracturing operation in accordance with the present disclosure. The well completion environment 400 includes a subsurface formation 406 through which an active well 420 and a monitor well 422 extend. The active well 420 includes a vertical active well section 402 and a horizontal active well section 404. As shown in FIG. 4, the horizontal active well section 404 extends through a first zone 424 of the subsurface formation 406.

In the example of FIG. 4, the monitor well 422 includes only a vertical well section 408. However, in other implementations, the monitor well 422 may include other sections extending in other directions, similar to the monitor well 122 of FIG. 1. The monitor well 422 is divided into a first, lower well interval 460 and a second, upper well interval 462.

More specifically, isolation devices, such as isolation devices 440 and 442, are disposed within the monitor well 422 to define the well intervals 460, 462. The isolation devices 440, 442 may be, for example, plugs, packers, or other devices inserted at predetermined locations within the monitor well 422 to define the well intervals 460, 462. The monitor well 422 further includes pressure gauges or similar sensors to measure pressure within the well intervals 460, 462. More specifically, the monitor well 422 includes a lower pressure gauge 426 for measuring pressure within the first, lower interval 460 and an upper pressure gauge 428 for measuring pressure within the second, upper well interval 462.

As shown in FIG. 4, the subsurface formation 406 may be divided into one or more zones, such as a first zone 424 and a second zone 430. Each zone of the subsurface formation 406 generally corresponds to a zone-of-interest with respect to a well completion operation. For example, in certain instances, each zone may correspond to one of a pay zone, a zone including a hazard (such as a water source), or a zone having a particular geological structure or similar properties. In general, however, the zones 424, 430 are sufficiently isolated such that poroelastic coupling between the active well 420 and the monitor well 422 within each of the zones 424, 430 may be separately identified by a pressure response within a corresponding interval of the monitor well 422. For example, isolation between the zones 424, 430 may result from the zones 424, 430 being distinct strata of the subsurface formation 406, from one or more intermediate strata disposed between the zones 424, 430, or from the zones 424, 430 being at sufficiently different well depths.

By dividing the monitor well 422 into isolated and separately monitored intervals corresponding to distinct zones of the subsurface formation 406, propagation of fractures extending from the active well 420 may be tracked as those fractures extend through each of the zones of the subsurface formation 406. More specifically, as fractures from the active well 420 cross into different zones of the subsurface formation 406, the fractures become poroelastically coupled with intervals of the monitor well 422. Accordingly, by monitoring pressure responses within the intervals of the monitor well 422, the occurrence and approximate degree of propagation of a fracture into specific zones of the subsurface formation 406 may be determined.

Referring more specifically to the example of FIG. 4, the lower pressure gauge 426 and the upper pressure gauge 428 measure pressure within intervals 460 and 462 of the monitor well 422, respectively. During a fracturing operation a fracture 432 may be formed and propagate from the active well 420. As the fracture 432 extends through the zone 424 of the subsurface formation 406, the fracture 432 becomes poroelastically coupled to a lower transducer fracture 450 of the monitor well 422, resulting in a pressure response within the lower interval 460 that is measured by the lower pressure gauge 426. Because the lower zone 424 of the subsurface formation 406 is isolated from the upper zone 430 of the subsurface formation 406, a corresponding pressure increase is not observed within the second well interval 462. However, as the fracture 432 further propagates through the subsurface formation 406 and into the upper zone 430, the fracture 432 becomes poroelastically coupled to a transducer fracture 452 of the upper interval 462 of the monitor well 422 and a corresponding pressure increase is measured by the upper pressure gauge 428. Accordingly, an operator is able to determine when the fracture 432 transitions between the lower zone 424 and the upper zone 430 of the subsurface formation 406.

In certain implementations, the monitor well 422 may be a previously active well that has been repurposed. In such implementations, the transducer fractures 450, 452 may be fractures that were previously formed during initial completion of the previously active well. Accordingly, isolating intervals of the monitor well 422 may include the steps of, among other things, identifying the location of existing fractures (e.g., by seismic or similar analysis) extending from the monitor well 422, determining which fractures extend into zones-of-interest of the subterranean formation, and identifying depths within the monitor well 422 in which isolation devices may be installed to define the intervals for monitoring propagation of fractures within each of the zones-of-interest.

In other implementations, targeted placement of the transducer fractures may be used to locate the transducer fractures within specific zones of the subterranean formation. For example, based on seismic or similar geological data, zones of the subterranean formation and their corresponding depths may be identified. Fracturing operations may then be applied within one or more intervals of the monitor well corresponding to the zones-of-interest to create transducer fractures extending from the intervals into the subterranean formation. In conjunction with such fracturing operations, the intervals may also be isolated, such as by installing isolation devices within the monitor well between the intervals.

Identifying a transition between zones may be used to control a fracturing operation in various ways. For example, if extension of the fracture 432 into the upper zone 430 is desired but no pressure increase within the upper interval 462 is measured by the upper pressure gauge 428, the fracturing operation may be adjusted to increase vertical propagation of the fracture 432. Such adjustments may include, without limitation, one or more of increasing the viscosity of the fracturing fluid, increasing the size of proppants added to the fracturing fluid, modifying the amount or type of additives introduced into the fracturing fluid, increasing the injection rate of the fracturing fluid, or applying any other of a number of modifications to the fracturing operation directed to increasing fracture propagation.

Conversely, if propagation of the fracture 432 into the second interval 430 is not desired or is to be otherwise limited to the lower zone 424, an increase in pressure measured by the upper pressure gauge 428 may be used to identify when undesirable fracture growth into the upper zone 430 has occurred. In response, the fracturing operation may be modified to reduce further vertical propagation of the fracture 432. Such modifications may include, without limitation, decreasing the viscosity of the fracturing fluid, decreasing proppant size, adding a diverting agent into the fracturing fluid or otherwise performing a diversion operation, reducing the injection rate of the fracturing fluid, initiating a rate cycling operation, or applying any other of a number of modifications to the fracturing operation directed to reducing vertical propagation of the dominant fracture.

Although FIG. 4 includes only a lower pressure gauge 426 and an upper pressure gauge 428, any number of pressure gauges or sensors may be disposed within the monitor well 422 in order to measure pressure within different isolated intervals of the monitor well 422. Moreover, although the monitor well 422 is illustrated in FIG. 4 as being substantially vertical and that the first zone 424 and the second zone 430 of the subsurface formation 406 are similarly illustrated as being vertically arranged layers, other arrangements of the gauges, intervals, and zones are also contemplated. For example, one or more pressure gauges may be disposed within a horizontal or other directional section of the monitor well 422. Accordingly, although the monitor well 422 includes each of a lower pressure gauge 426 and an upper pressure gauge 428, the terms "upper" and "lower" are not intended to limit implementations according to the present disclosure to the vertical monitor well configuration illustrated in FIG. 4. Rather, "upper" and "lower" are merely intended to convey that the pressure gauges 426, 428 are disposed within different intervals of the monitor well 422.

Figure 5:
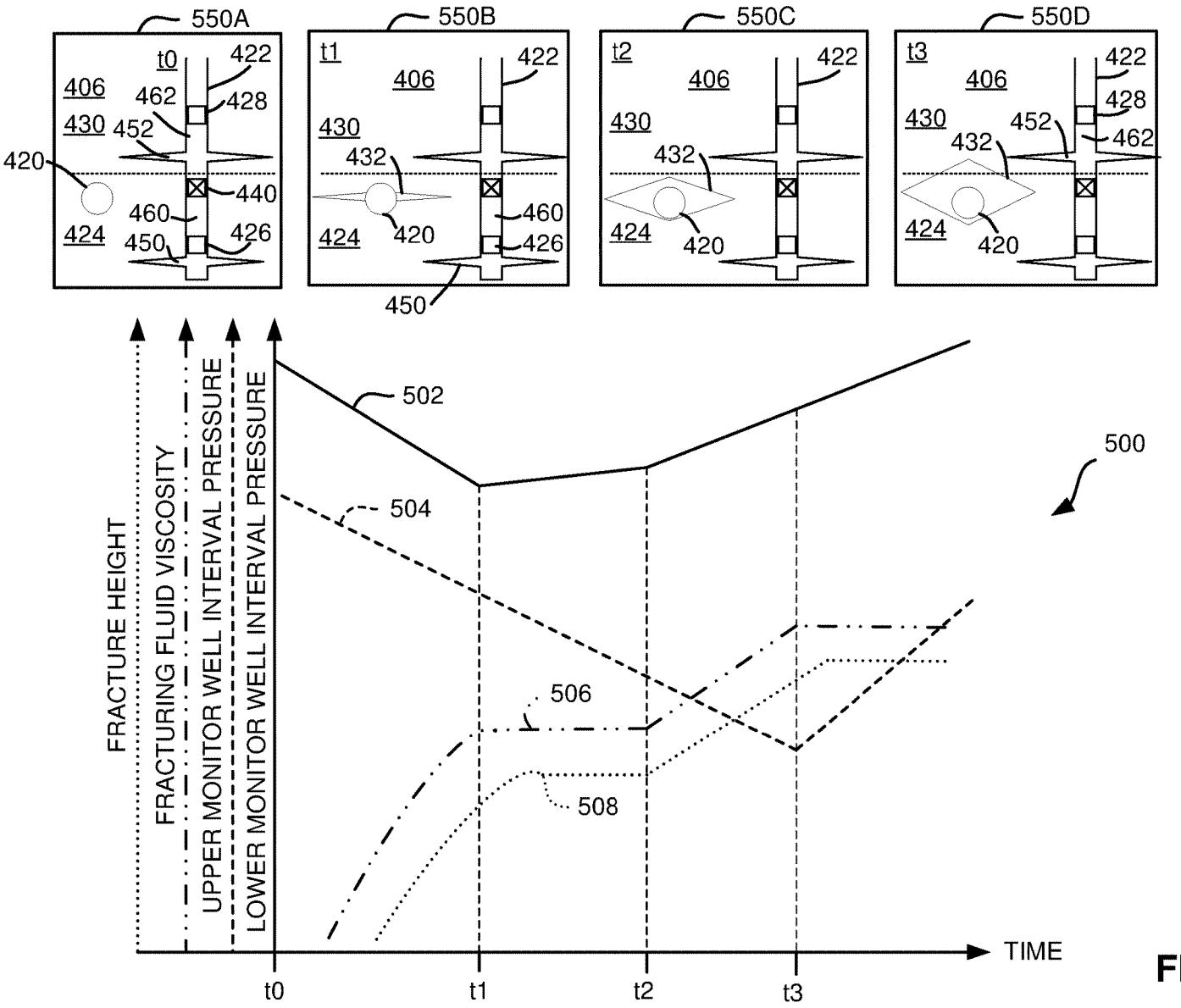
FIG. 5 is a second example graph illustrating a fracturing operation conducted in the well environment of FIG. 4.

FIG. 5 is an example graph 500 illustrating various parameters and measurements corresponding to a fracturing operation over time. For explanatory purposes, the following description of FIG. 5 references items and components of the well completion environment 400 of FIG. 4. Illustrations 550A-D provide schematic illustrations of the subterranean formation 406 during the fracturing operation illustrated by the graph 500. The graph 500 includes a first pressure line 502 (shown as a solid line) corresponding to pressure readings obtained from a lower pressure gauge 426 of a monitor well 422 (each identified in illustration 550A) and a second pressure line 504 (shown as a dashed line) corresponding to pressure readings obtained from an upper pressure gauge 428 (also identified in illustration 550A) of the monitor well 422.

As shown in illustration 550A, the monitor well 422 is divided by an isolation device 440 into a lower interval 460 and an upper interval 462 within which pressure measurements are obtained by the lower pressure gauge 426 and the upper pressure gauge 428, respectively. The lower interval 460 includes a lower transducer fracture 450 that extends into a lower zone 424 of the subterranean formation 406. Similarly, the upper interval 462 includes an upper transducer fracture 452 that extends into an upper zone 430 of the subterranean formation 406.

The graph 500 further indicates each of a fracturing fluid viscosity 506 and a fracture height 508. Although various fracturing operation parameters may be controlled in order to modify fracture propagation, the example illustrated in the graph 500 is directed to an implementation in which fracturing fluid viscosity is the primary parameter by which fracture propagation is controlled. In other implementations according to the present disclosure, fracture propagation may be controlled by modifying one or more other operational parameters in addition to or instead of fracturing fluid viscosity. Examples of such parameters are discussed in more detail below in the context of FIGS. 6-9, as well as previously relative to rate cycling.

Referring now to the fracturing operation illustrated by the graph 500 in more detail, at time t0, a fracturing fluid is injected into the active well 420 but a poroelastic response is not observed by either of the lower pressure gauge 426 or the upper pressure sensor 428. Accordingly, each of the first pressure line 502 and the second pressure line 504 indicate a substantially constant decrease of pressure (i.e., leak off) within each of the intervals 460, 462. As shown in illustration 550A, such a response by the lower pressure gauge 426 and the upper pressure gauge 428 may be the result of a fracture not being formed or otherwise not extending sufficiently into either of the lower zone 424 or of the upper zone 430 of the subterranean formation 406, respectively.

To induce fracturing from the active well 420, the viscosity of the fracturing fluid is increased as illustrated by an upward trend in the fracturing fluid viscosity line 506 between time t0 and time t1. A corresponding increase in the fracture height is similarly observed during this time period, indicating growth of a fracture 432 from the active well 420. At time t1, the slope of the first pressure line 502 becomes positive, indicating poroelastic coupling between the fracture 432 and the lower transducer fracture 450. More specifically, poroelastic coupling between the fracture 432 and the lower transducer fracture 450 results in an increase of pressure within the lower interval 460 of the monitor well 422 as measured by the lower pressure gauge 426. Notably, the second pressure line 504 does not exhibit a similar change, indicating that a similar pressure increase is not being observed within the upper interval 462 of the monitor well 422. Accordingly, it can be concluded that although fracture growth has occurred, such growth is limited to within the lower zone 424 of the subsurface formation 406 and does not extend into the upper zone 430 of the subsurface formation 406.

In response to the fractures failing to extend into the upper zone 430, the viscosity of the fracturing fluid is further increased between times t2 and t3 to encourage further propagation of the fracture 432 from the active well 420. At time t3, a pressure increase is detected by the upper pressure gauge 428, indicating poroelastic coupling between the fracture 432 and the upper transducer fracture 452 of the monitor well 422. In other words, increasing the viscosity of the fracturing fluid resulted in sufficient fracture propagation such that the fracture 432 extended into the upper zone 430 of the subsurface formation 406. As the fracture 432 entered into the upper zone 430, the fracture 432 became poroelastically coupled to the upper transducer fracture 452 such that a pressure response was measured by the upper pressure gauge 428 within the upper interval 462 of the monitor well 422.

In summary, the example of FIG. 5 illustrates one implementation of the present disclosure in which multiple pressure gauges are disposed in isolated intervals within the monitor well 422 and each pressure gauge measures pressure within its respective interval. The responses observed form each pressure gauge may be used to track fracture propagation through a subterranean formation 406. The process generally includes performing a first fracturing operation using a first set of fracturing operation parameters. By observing and comparing pressure responses from the pressure gauges, one or more parameters of the fracturing operation may be modified to alter propagation of the fractures through the subterranean formation 406. In the example of FIG. 5 specifically, the modification included increasing the viscosity of the fracturing fluid in order to increase propagation. Subsequent readings obtained from the pressure gauges may then be used to confirm whether the desired effects of the modification have occurred. To the extent the desired effects have not occurred, the parameters of the fracturing operation may be further modified and the resulting pressures measured and analyzed accordingly.

Figure 6:
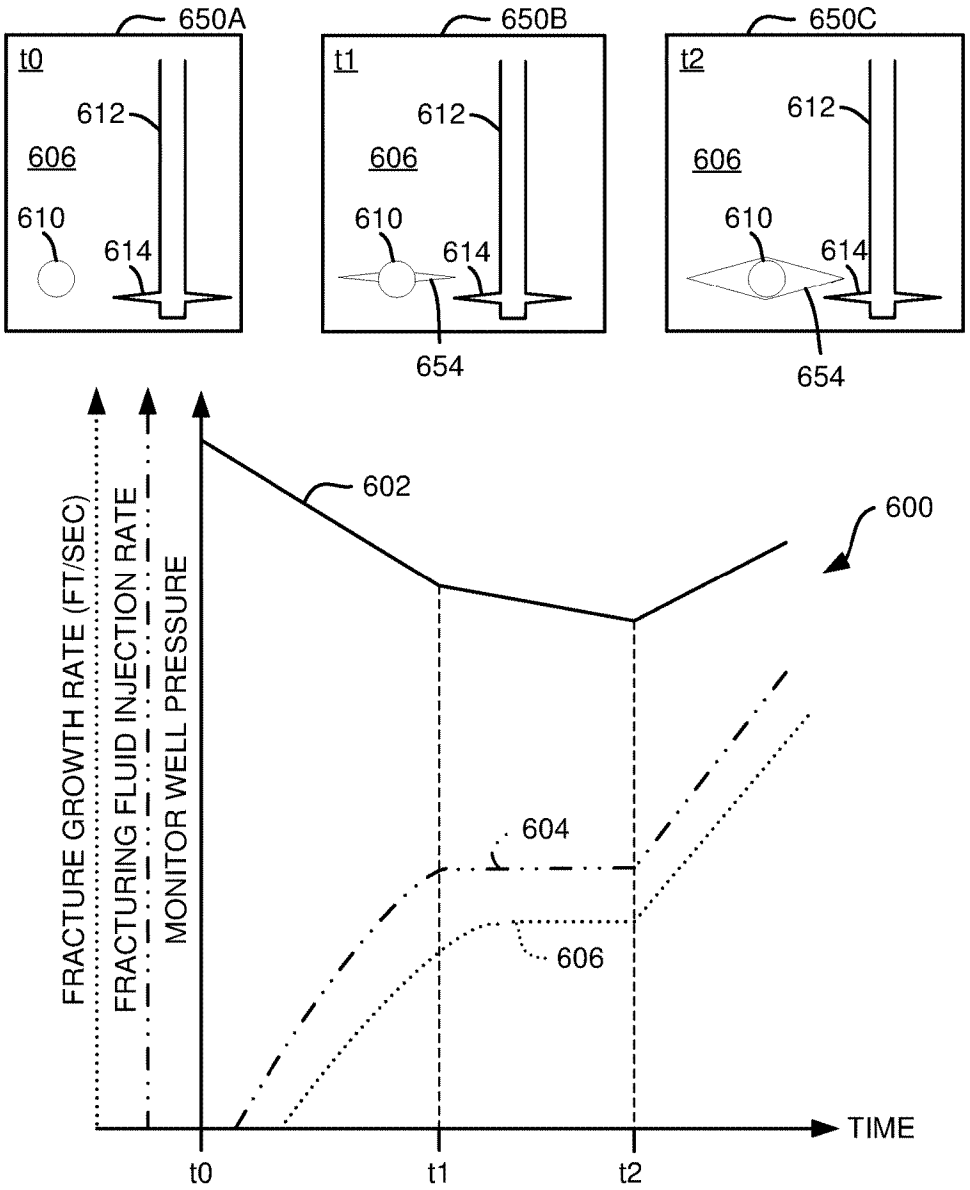
FIG. 6 is a third example graph illustrating a fracturing operation in which fracturing injection rate is modified in response to monitor well pressure.

FIG. 6 is an example graph 600 illustrating another fracturing operation in accordance with this disclosure. Further reference is made to schematic illustrations 650A-C, which depict a subterranean formation 606 at various stages of a fracturing operation conducted on an active well 610. The graph 600 includes a pressure line 602 corresponding to a pressure measurement obtained from a monitor well 612. As shown in illustrations 650A-C, the monitor well 612 may include one or more transducer fractures 614 extending into the subterranean formation 606. The graph 600 further includes an injection rate line 604 (shown as a dashed and dotted line) and a fracture growth rate line 606 (shown as a dotted line). Similar to the example fracturing operation illustrated in FIGS. 2A and 2B, the fracturing operation of FIG. 6 illustrates how a fracturing fluid injection rate may be modified to control fracture propagation during a fracturing operation.

At time t0, no fracturing fluid has been injected into active well 610 and, as a result, no fractures have started propagating from the active well 610. From time t0 to time t1, the fracturing fluid injection rate is increased, resulting in a corresponding increase in fracture growth rate. At time t1, initial poroelastic coupling occurs between a dominant fracture 654 of the active well 610 and the monitor well 612.

As illustrated by the interval between time t0 to t1, the poroelastic coupling results in a decreased rate of pressure loss (i.e., a decreased leak off rate) within the monitor well 612. To further propagate the fracture 654 and increase the poroelastic coupling between the active well 610 and the monitor well 612, the fracturing fluid injection rate is increased at time t2. The resulting propagation of the dominant fracture 654 is then observed as a positive rate of pressure change from time t2 onward.

Figure 7:
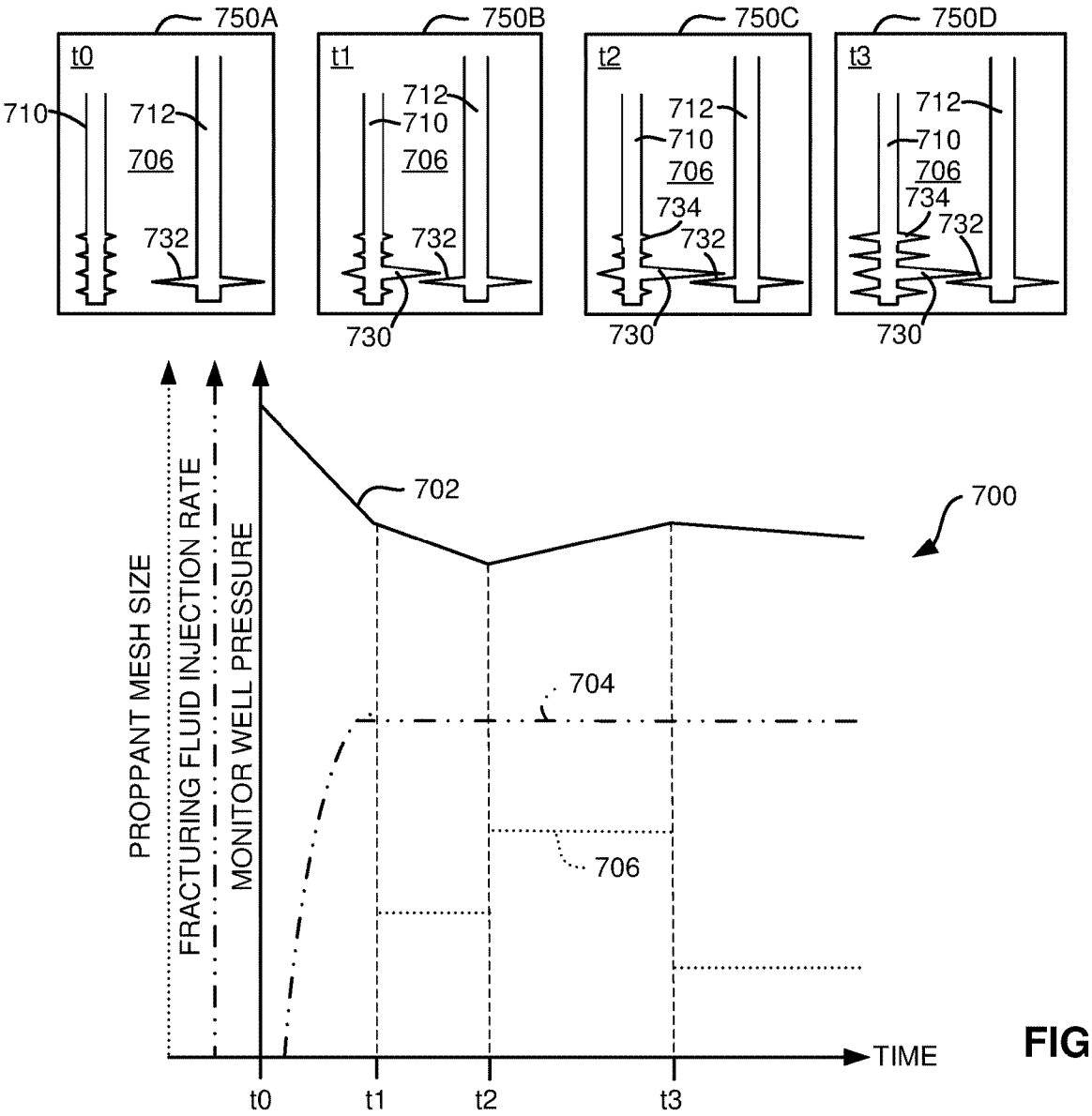
FIG. 7 a fourth example graph illustrating a fracturing operation in which fracturing injection rate and proppant size are modified in response to monitor well pressure.

FIG. 7 is another example graph 700 illustrating a fracturing operation. Further reference is made to schematic illustrations 750A-D, which depict a subterranean formation 706 at various stages of a fracturing operation conducted on an active well 710. The graph 700 includes a pressure line 702 corresponding to a pressure measurement obtained from a monitor well 712. As shown in illustrations 750A-D, the monitor well may include one or more transducer fractures 732 extending into the subterranean formation 706. The graph 700 further includes an injection rate line 704 (shown as a dashed and dotted line) and a proppant mesh size line 706 (shown as a dotted line).

At time t0, no fracturing fluid has been provided into active well 710 and, as a result, fractures have not started propagating from the active well 710. From time t0 to time t1, the fracturing fluid injection rate is increased and subsequently held constant. At time t1, a first proppant having a first size is introduced into the active well 710 with the fracturing fluid. As indicated by the pressure line 702 during the interval between time t1 and t2, injection of the fracturing fluid with the proppant of the first size results in propagation of a dominant fracture 730 and subsequent poroelastic coupling between the dominant fracture 730 and a transducer fracture 732 of the monitor well 712. Such poroelastic coupling is indicated by the rate of pressure change within the monitor well 712 becoming less negative (i.e., the rate at which pressure is lost from the monitor well 712 is reduced).

Between times t2 and t3, the original mesh is changed to a second, larger mesh while the fracturing fluid injection rate is held constant. By using a larger mesh, the size of proppant particles in the fracturing fluid is increased. In response to increasing the proppant size, the rate of pressure change within the monitor well 712 is further increased, generally indicating that further propagation of the dominant fracture 730 has occurred. Such redirection may occur, for example, if the larger proppant size results in non-dominant fractures, such as non-dominant fracture 734, being blocked or "screened out" by the larger proppant particles. In such instances, fracturing fluid could be restricted or otherwise unable to enter the non-dominant fractures, thereby reducing their propagation while also being redirected to the dominant fracture 730, thereby increasing its propagation.

In response to the rate of pressure change increase observed between times t2 and t3, the mesh size is changed again to a third, smaller mesh resulting in a decrease in proppant particle size. For purposes of this example, the fracturing fluid injection rate is maintained at a constant rate. In response to reducing the proppant size, the rate of pressure change as measured within the monitor well 712 decreases, implying that an increased proportion of the fracturing fluid is being direct to the non-dominant fractures, such as non-dominant fracture 734, resulting in their propagation.

Figure 8:
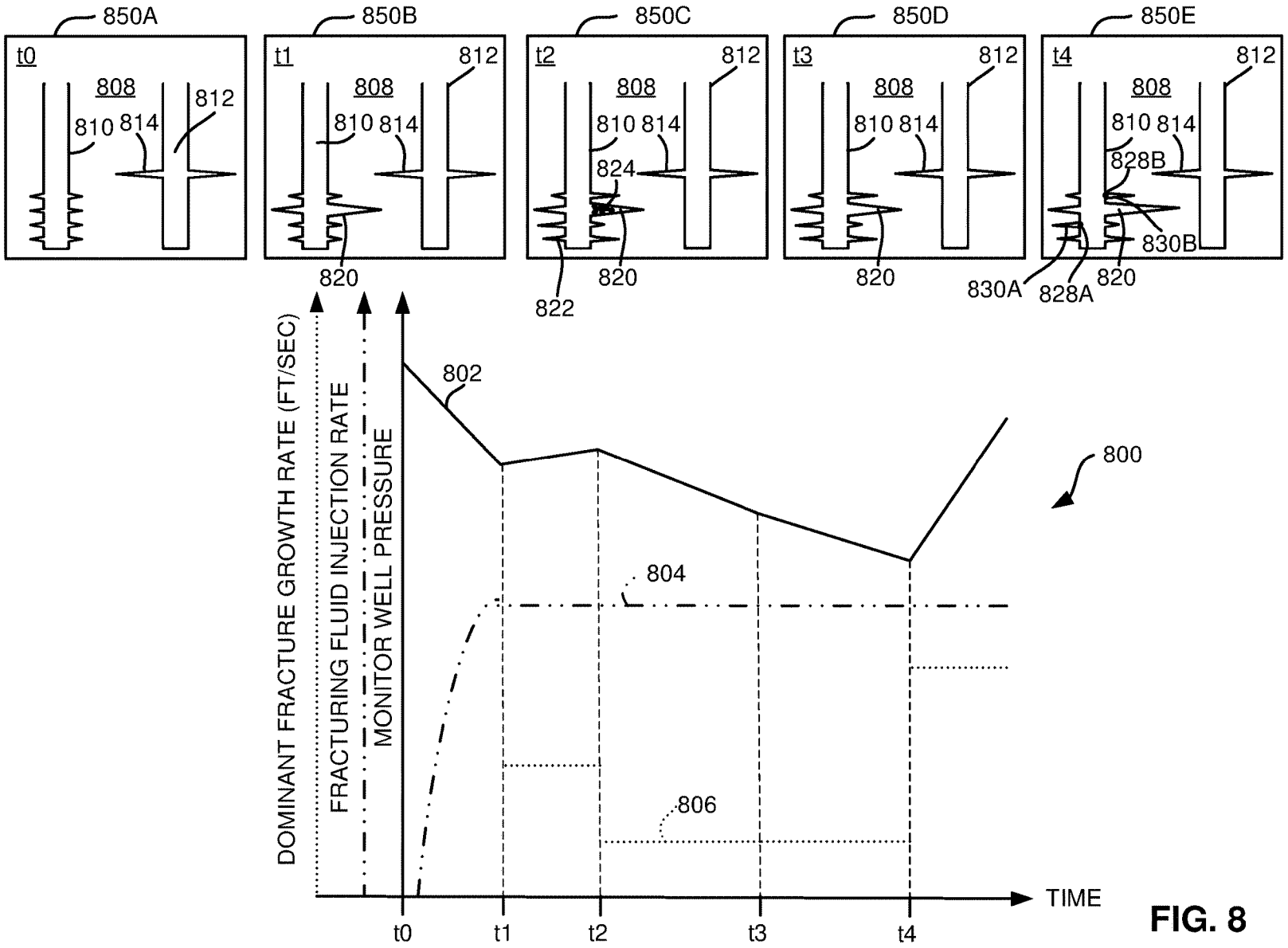
FIG. 8 a fourth example graph illustrating a fracturing operation in which diversion operations are undertaken in response to monitor well pressure.

FIG. 8 is another example graph 800 illustrating application of a diversion operation during a broader fracturing operation. In an example diversion operation a chemical, such as an acid or resin and generally referred to as a diverting agent, may be injected into a well to restrict or block flow of a treatment fluid into pathways extending through a subterranean formation. As a result of the diverting agent, treatment fluids that are subsequently injected into the well are diverted to other, less restricted pathways within the subterranean formation, thereby improving distribution of the treatment fluid. The diverting agent may be subsequently dissolved or otherwise removed to restore flow through the previously obstructed pathways. In the context of fracturing operations, for example, diversion may be used to improve the distribution of fluid between fractures within an interval by temporarily blocking dominant fractures and then injecting a fracturing fluid to propagate non-dominant fractures. The diverting agent may then be removed in order to allow further propagation of the dominant fracture albeit with a more even distribution of fluid between dominant and non-dominant fractures.

FIG. 8 illustrates an example fracturing operation in which the pressure (or pressure-related property, such as a rate of pressure change) within a monitor well 812 is used to determine the effectiveness of a diversion operation. One or more parameters of the fracturing operation are modified in accordance with the feedback from the monitor well 812. Further reference is made to schematic illustrations 850A-E, which depict a subterranean formation 808 through which the monitor well 812 and the active well 810 extend at various stages of the fracturing operation. The graph 800 includes each of monitor well pressure 802 (solid line), fracturing fluid injection rate 804 (dashed and dotted line), and dominant fracture growth rate 806 (dotted line) over time. As shown in illustrations 850A-E, the monitor well 812 may include one or more transducer fractures, such as transducer fracture 814, extending into the subterranean formation 808.

In certain implementations of the present disclosure, such poroelastic coupling may be used to determine when a diverting agent should be introduced to stop or slow further propagation of the dominant fracture 820. For example, a pressure increase within the monitor well 812 may be observed before anticipated. In such circumstances, the pressure increase within the monitor well 812 may indicate a higher proportion of fracturing fluid had been directed into only certain fractures, such as the dominant fracture 820, thereby causing increased propagation of those certain fractures and underdevelopment of other fractures within the subsurface formation 808. In response, a diversion operation may be initiated. Such a diversion operation may include, among other things, one or more of adding a diverting agent to the fracturing fluid, modifying the ratios of other additives to the fracturing fluid, changing the fracturing fluid injection rate, or altering any other parameter of the fracturing operation.

The rate of pressure change in the monitor well 812 may also be used to determine the effectiveness of a previously performed diversion operation. For example, if the rate of pressure change in the monitor well 812 decreases after a diversion operation, it may be an indication that the diversion operation was successful and that a larger proportion of the fracturing fluid is being diverted to other fractures. Alternatively, if the rate of pressure change in the monitor well 812 remains constant or increases after a diversion operation, it may be an indication that the diversion operation was unsuccessful. Such circumstances may be the result of, among other things, insufficient diverting agent injected into the active well 810 or other non-dominant fractures becoming blocked or obstructed by the diversion operation. In response to observing a constant or increased rate of pressure change within the monitor well 812, parameters of the fracturing operation may be modified. For example, a second diversion operation which may include first introducing a dissolving agent into the well to remove the previously injected diverting agent.

In the example of FIG. 8, the graph 800 illustrates responses to each of a successful and unsuccessful diversion operation conducted on the active well 810. Referring back to the graph 800, between time t0 and t1, fracturing fluid is injected into the active well 810, resulting in the propagation of a dominant fracture 820 from the active well 810. At time t1, the dominant fracture 820 sufficiently propagates to result in poroelastic coupling between the dominant fracture 820 and the transducer fracture 814. Such poroelastic coupling may be observed, for example, as an increase of pressure within the monitor well 812. As shown in the graph 800, the increase of pressure within the monitor well 812 generally coincides with an increase in the rate of growth of the dominant fracture 820 extending from active well 810.

In response to detecting a pressure increase in the monitor well 812, a diversion operation may be initiated in which a diverting agent is injected into the active well 810 to block or at least partially obstruct the dominant fracture 820. The time period between t2 and t3 illustrates the effect of a successful diversion operation. Specifically, as shown in illustration 850C, the diverting agent 824 introduced at time t2 reduces the amount of fracturing fluid entering the dominant fracture 820, which is indicated as a reduction in the rate of fracture growth 806 and a negative rate of pressure change within the monitor well 812. The fracturing fluid is instead diverted to other non-dominant fractures, such as fracture 822, causing their propagation instead. At t3 and as shown in illustration 850D, the diverting agent 824 (shown in illustration 850C) may then be removed, such as by introducing a dissolving agent.

For illustrative purposes, at time t4, a second diversion operation is initiated. As shown in illustration 850E, this second operation is unsuccessful in that diverting agent 828A, 828B blocks or otherwise obstructs non-dominant fractures 830A, 830B. Such an unsuccessful diversion operation may result in increased fracturing fluid being directed into the dominant fracture 820, thereby increasing the growth rate of the dominant fracture 820 and corresponding poroelastic coupling between the dominant fracture 820 and the monitor well 812. As a result, the rate of pressure change within the monitor well 812 may increase.

Various parameters of the fracturing operation may be modified in response to identifying an unsuccessful diversion operation. For example, in certain implementations, a dissolving agent may be introduced to remove the previously injected diverting agent and a subsequent diversion operation may be initiated. Parameters of the subsequent diversion operation may also be modified in light of the previous unsuccessful diversion attempt. For example, one or more of the diverting agent type or ratio may be modified as compared to the unsuccessful diversion operation. Other parameters, including, without limitation, the fracturing fluid injection rate, fracturing fluid viscosity, and ratio of other additives may also be modified in the subsequent diversion operation or any phase of a fracturing operation following either a successful or unsuccessful diversion operation.

Systems according to the present disclosure may also be used to identify if and when direct fluid communication occurs between an active well and an offset well, such as a monitor well. Such communication between an active well and an offset well (such as a monitor well) is sometimes referred to as a "frac hit" and can lead to, among other things, damage to the offset well, reduced fracturing efficiency of the active well, and other costly and time-consuming issues. Although frac hits are ideally avoided by careful monitoring of fracturing operations, should a frac hit occur, rapid response and remediation can enable operators to reduce further damage to the offset well and minimize fracturing operation downtime.

Figure 9:
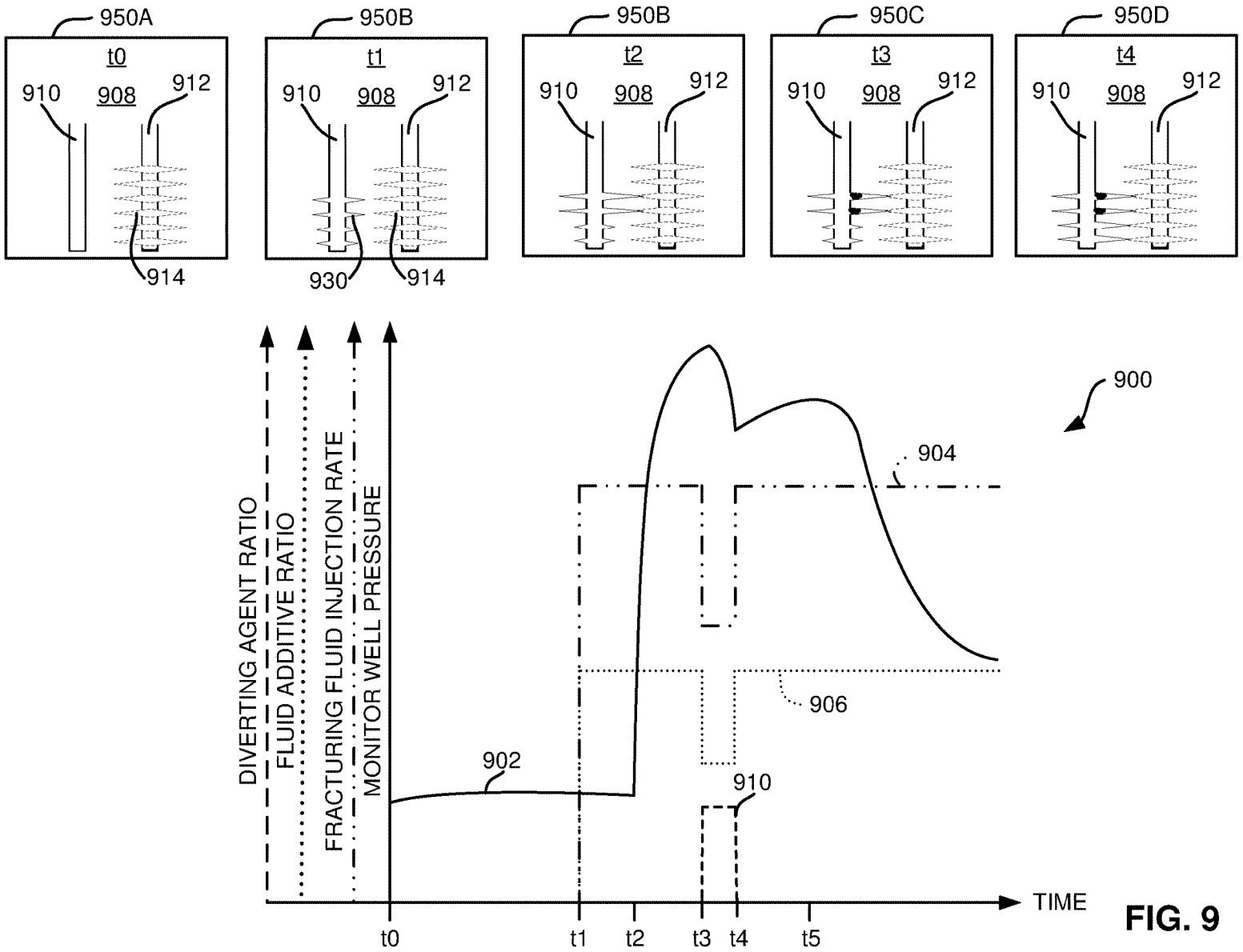
FIG. 9 a fifth example graph illustrating a fracturing operation in which operation parameters are modified in response to direct fluid communication between an active well and a monitor well.

FIG. 9 is a graph 900 illustrating a fracturing operation in which direct fluid communication occurs between an active well 910 and a monitor well 912. Further reference is made to schematic illustrations 950A-E, which depict a subterranean formation 908 through which the monitor well 912 and the active well 910 extend at various stages of the fracturing operation. The graph 900 illustrates each of monitor well pressure 902 (solid line), a fracturing fluid injection rate 904 (dashed and dotted line), a fluid additive ratio 906 (dotted line), and a diverting agent ratio 910 (dashed line). As shown in illustrations 950A-E, the monitor well 912 may include one or more preexisting fractures, such as fracture 914, extending into the subterranean formation 908.

During the period between time t0 and t1, little or no fracturing fluid is injected into the active well 910. Accordingly, no significant change occurs to the pressure within the monitor well 912. At time t1, injection of the fracturing fluid (which includes an additive) is initiated, resulting in the propagation of fractures, such as fracture 930, from the active well 910. A sharp increase in pressure within the monitor well 912 is observed beginning at time t2, indicating fluid communication between one or more fractures extending from the active well 910 and a fracture of the monitor well 912. Such a pressure response may also occur in response to establishing fluid communication between fractures of the active well 910 and the primary wellbore of the monitor well 912.

At time t3, various actions are initiated in response to the direct fluid communication between the active well 910 and the monitor well 912. Specifically, each of the fracturing fluid injection rate and the additive ratio are reduced and a diverting agent is introduced into the active well 910. As illustrated in the graph, the reduction of the fracturing fluid injection rate may result in an initial drop in pressure within the monitor well 912.

At time t4, after diverting agent has been introduced into the active well 910 and given an opportunity to block flow between the active well 910 and the monitor well 912, the fracturing operation is continued by increasing the fracturing fluid injection rate and the additive ratio. In certain implementations, such an increase may be to pre-diversion levels, however, a reduced fracturing injection rate or reduced additive ratio as compared to pre-diversion levels may also be applied to reduce the likelihood of undoing the diversion operation or causing further direct fluid communication between the active well 910 and the monitor well 912. As shown in the time period between times t4 and t5, increasing the fracturing fluid injection rate results in the pressure within the monitor well 912 increasing, peaking at time t5, then reducing and levelling off, indicating a successful diversion operation.

The foregoing examples of fracturing operations generally involved fracturing a single stage of an active well, measuring a corresponding response in a monitor well, and then adjusting the fracturing operation to continue fracturing the current stage. Although systems and methods according to the present disclosure are well-suited for such single stage applications, data obtained from the monitor well during fracturing of one stage may also be used to modify or dictate parameters for fracturing operations for subsequent stages. In certain implementations, one or more characteristics of the pressure data obtained from the monitor well during fracturing of a first stage may be used to dictate, among other things, a fracturing fluid injection rate, an additive ratio, a viscosity, a proppant size, or other fracturing operation parameter of a subsequent stage. For example, systems in accordance with this disclosure may monitor pressure within the monitor well to determine whether a value corresponding to the pressure exceeds one or more thresholds. In response to the value exceeding a threshold, the system may automatically modify parameters of subsequent stages. In other implementations, the pressure data of the monitor well may be used in conjunction with other data including, without limitation, data collected from other sensors during the same or prior fracturing operations, seismic data for the subterranean region being fractured, historical well data, production data, and the like. Such data may be collected and analyzed to determine fracturing operation parameters using various techniques including, without limitation, data mining, statistical analysis, and machine learning and other artificial intelligence-based techniques implemented as one or more algorithms that receive the various collected data and provide parameter values for fracturing operations.

FIG. 10 is a table 1000 illustrating a portion of an example fracturing operation plan and, more specifically, a fracturing operation plan that includes automated rate cycling and subsequent monitoring of the success of the automated rate cycling. As shown, the table 1000 includes entries for each of stages 47 and 48 of the fracturing operation.

In general, the fracturing operation plan includes instructions and operational parameters for conducting one or more fracturing operations, each of which may include multiple stages. For example, the instructions may include, among other things, activating, deactivating, or modifying the performance of one or more pieces of equipment for carrying out the fracturing operation and/or changes to parameters governing operation of such equipment. The fracturing operation may further include thresholds, limits, and other logical tests. Such tests may be used, for example, to generate alerts or alarms, to initiate control or other routines, to select subsequent operational steps, or to modify current or subsequent steps in the fracturing operation. In implementations of the present disclosure, the fracturing operation plan may be executed, at least in part, by a computing system and the fracturing operation plan may be stored within memory accessible by the computing system. For example, in certain implementations the fracturing operation plan may include computer-executable instructions that may be executed by the computing system in order to control at least a portion of a fracturing operation. Executing the fracturing operation plan may then cause the computing system to, among other things, issue commands to equipment in accordance with the fracturing operation plan, receive and analyze data related to steps in the fracturing operation plan, and update or otherwise modify parameters of the fracturing operation plan in accordance with the received data.

The fracturing operation plan may also include instructions for operations that require manual intervention by an operator. For example, in some implementations, executing a fracturing operation in accordance with the fracturing operation plan may require an operator to provide confirmation or acknowledgement prior to a computing system executing one or more steps of the fracturing operation plan. In other implementations, more direct intervention by the operator may be required. For example, the operator may be required to manually activate, deactivate, or modify performance parameters of equipment.

Referring now to the example fracturing operation illustrated by the table 1000, an initial trigger 1002 is provided for each stage of the fracturing operation. The trigger 1002 is generally a condition that, when met, initiates a rate cycle operation, as indicated in the "Action" column 1004. For example, in stage 47, the trigger to initiate rate cycling is an increase of 5 psi within the monitor well following initiation of the first ramp. The first ramp generally corresponds to the first injection of fracturing fluid and initiation of fracture propagation for the stage. Similarly, in stage 47, the rate cycling trigger is an increase of 20 psi following the first ramp. Notably, the trigger of either of stages 47 and 48 may be dynamically determined, at least in part, by pressure responses observed in the monitor well during fracturing of one or prior stages.

In response to the trigger, rate cycling is initiated by reducing the fracturing fluid injection rate for a predetermined amount of time. For stages 47 and 48, such rate cycling includes reducing the injection rate of fracturing fluid to 0 bpm for three minutes. Following a rate cycle, each stage may also include a test to determine the effect of the rate cycling. As noted in table 1000, the test 1006 for each of stages 47 and 48 is an observed rate of pressure change decrease of more than 20%. If such a decrease in the rate of pressure change is observed, the fracturing operation proceeds according to the base schedule per column 1008. If, however, no such pressure rate decrease is observed within a predetermined time (e.g., five minutes), a subsequent rate cycle may be initiated or other adjustments to the fracturing operation parameters may be applied, as shown in column 1010. For example, as indicated for each of stages 47 and 48, the fracturing fluid is changed to a linear gel fracturing fluid.

Figure 11:
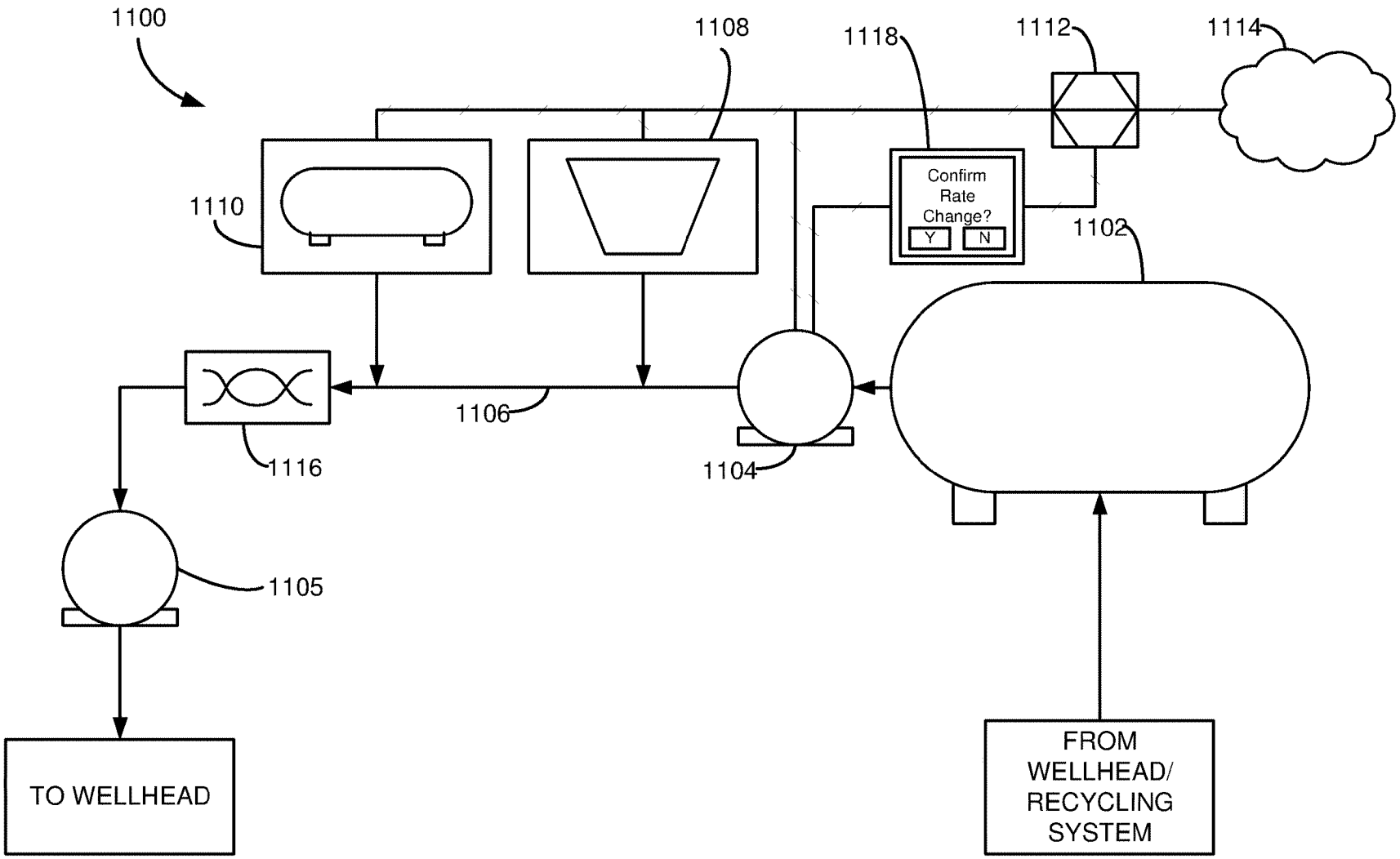
FIG. 11 is a schematic illustration of a pumping system for use in systems according to the present disclosure.

FIG. 11 is a schematic illustration of a pumping system 1100 for use in systems according to the present disclosure. Pumping system 1100 includes a primary fluid storage 1102 coupled to a pump or pumps 1104 and 1105 configured to pump fluid from primary fluid storage 1102 along an outlet 1106 and to a wellhead of an active well to facilitate fracturing of the active well. A proppant system 1108, an additive system 1110, and a blender 1116 are further coupled to an outlet line 1106. Each of the proppant system 1108, the additive system 1110, and the pump 1104 are further communicatively coupled to a computing device 1112. In certain implementations, computing device 1112 is also communicatively coupled, either directly or indirectly, to a display of a control panel, human machine interface, or similar computing device.

During operation, the computing device 1112 transmits control signals to the pump 1104 to control pumping of fluid from the primary fluid storage 1102 by the pump 1104. As fluid is pumped from the fluid storage 1102 to the active well through the outlet 1106, proppants and other additives may be introduced into the fluid by the proppant system 1108 and the additive system 1110, respectively. In the pumping system 1100, each of the proppant system 1108 and the additive system 1110 are each communicatively coupled to and controllable, at least in part, by the computing device 1112. Accordingly, the computing device 1112 can control the amount of proppant and additive introduced into the fluid. The outlet 1106 may further include a blender 1116 or similar mixing device configured to mix the fluid from the primary fluid storage 1102 with proppants introduced by the proppant system 1108 and/or additives introduced by the additive system 1110.

The pumping system 1100 may also operate, at least in part, based on control signals received from a user. For example, the pumping system 1100 includes a display 1118 or similar device for providing system data, alerts, prompts, and other information to a user and for receiving input from the user. As shown in FIG. 11, the display 1118 may be used to prompt a user to confirm initiation of a change to the flow rate of fracturing fluid provided by the pumping system 1100. In alternative implementations, the display 1118 may further allow the user to receive other prompts and to issue other commands, such as those corresponding to operation of the proppant system 1108, the additive system 1110, or other components of the pumping system 1100.

In certain implementations, the primary fluid storage 1102 is coupled to the wellhead to permit recycling of fluid during a fracturing operation. Return fluid from the wellhead may require filtering or other processing prior to reuse and, as a result, the pumping system 1100 may further include or be coupled to equipment configured to treat return fluid. Such equipment may include, without limitation, settling tanks or ponds, separators, filtration systems, and reverse osmosis systems.

As illustrated in FIG. 11, the computing device 1112 is communicatively coupled to a network 1114 and is configured to receive data over the network 1114. For example, in certain implementations the computing device 1112 receives pressure measurements taken from a monitor well, such as the monitor well 122 shown in FIG. 1, and/or control signals from a control system or other computing device, such as computing system 150 (shown in FIG. 1), derived from such pressure measurements. Computing device 1112 then controls the pumps 1104, 1105, the proppant system 1108, the additive system 1110, and other components of the pump system 1100 based on the measurement data and/or control signals. In alternative implementations, one or more components of the pump system 1100 are manually controlled, at least in part, by an operator. For example, in certain implementations, the output of the pump pumps 1104, 1005 is manually controlled by an operator who receives pressure measurement data from a second operator at the monitor well 122 or by reading a gauge or display configured to communicate pressure within the active well 120.

The foregoing implementations of the present disclosure have generally included an active well undergoing a fracturing operation and an offset or monitor well. During the fracturing operation, pressure changes within the monitor well resulting from poroelastic coupling between the active well and the monitor well are used to evaluate the fracturing operation and to modify the fracturing operation accordingly.

Although the present disclosure may be implemented using such two-well approaches, single-well approaches are also possible. For example, prior to undergoing a fracturing operation, a portion of the active well may be isolated and one or more pressure gauges or other pressure measurement devices may be installed to measure pressure within the isolated portion of the active well. The isolated portion of the active well may also include a transducer fracture extending into the surrounding formation. In such an arrangement, the isolated portion of the active wellbore may function similarly to the previously discussed monitor well for purposes of analyzing and controlling a fracturing operation of other portions of the active well. More specifically, as fractures are formed in another section of the active well during a fracturing operation, the new fractures can become poroelastically coupled to the transducer fracture of the isolated portion. This poroelastic coupling results in pressure effects within the isolated portion of the active well indicative of the growth of the new fracture (or fractures) and, more generally, the progress of the fracturing operation. As a result, the pressure within the isolated portion of the active well may be used to analyze and control the fracturing operation. This concept is discussed below in more detail with reference to FIG. 12.

Figure 12:
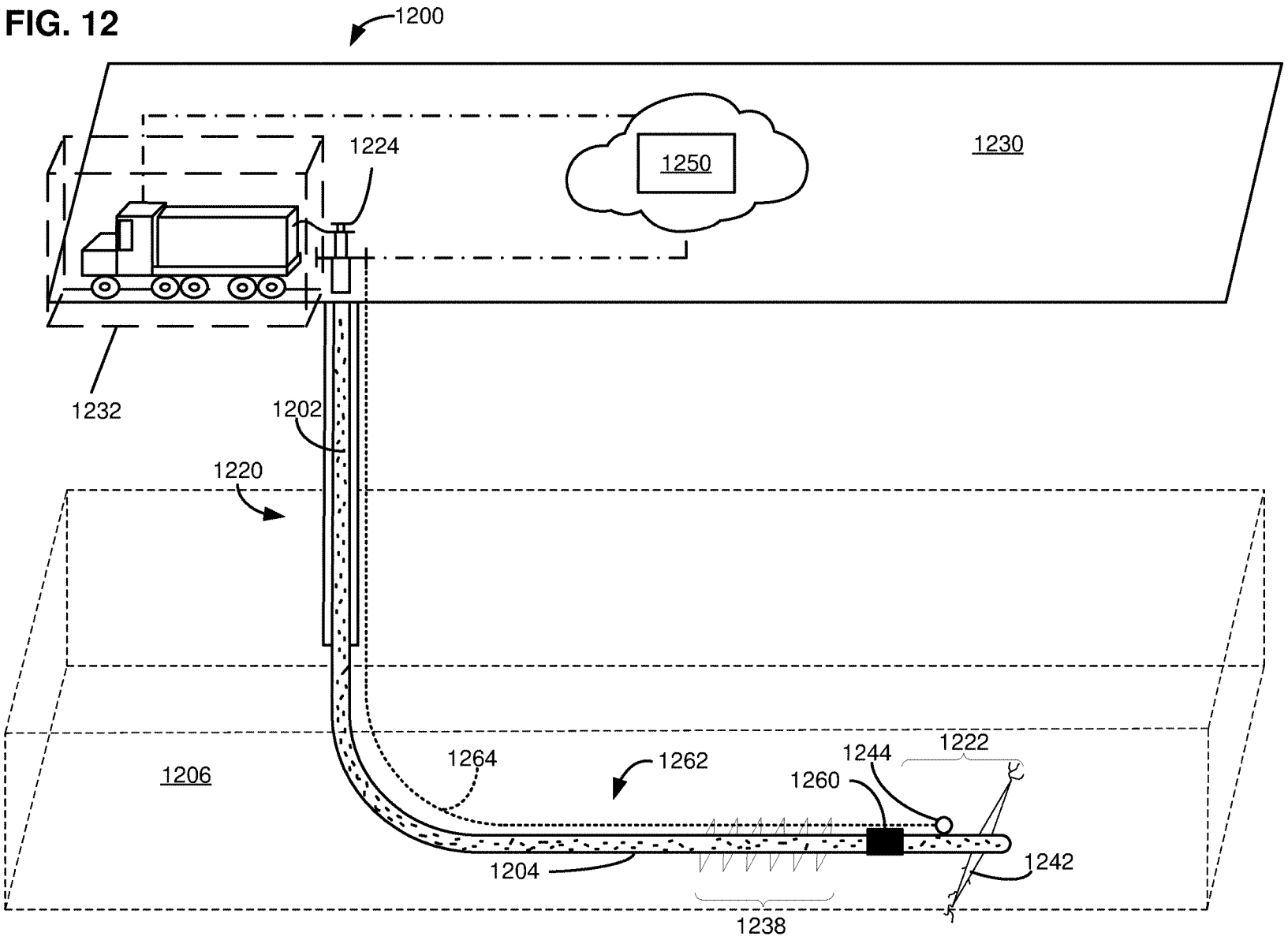
FIG. 12 is a schematic illustration of a second example well completion environment for completing a fracturing operation in accordance with the present disclosure.

FIG. 12 is a schematic diagram of an example well completion environment 1200 for completing a fracturing operation in accordance with the present disclosure. The well completion environment 1200 includes a subsurface formation 1206 through which a well 1220 extends. The well 1220 includes a vertical well section 1202 and a horizontal well section 1204. The horizontal active well section 1204 includes an isolated well section 1222 that is isolated from an uphole section 1262 of the well 1220. The isolated well section 1222 may be created, for example, by installing a bridge plug 1260, packer, or similar isolation device within the well 1220 between the uphole section 1262 and the portion of the well 1220 to be isolated. As illustrated in FIG. 12, the isolated well section 1222 may correspond to a toe of the well 1220. The isolated well section 1222 may include at least one transducer fracture 1242 extending into the subterranean formation 1206.

The well 1220 may include a wellhead 1224 disposed at a surface 1230 of the well completion environment 1200, the wellhead 1224 including sensors, gauges, and similar instrumentation for capturing data regarding the well completion environment 1200 and, in particular, fracturing operations conducted in the well 1220. The wellhead 1224 and other instrumentation of the well completion environment 1200 may generally be communicatively coupled to a computing system 1250 that receives signals and measurements from the instrumentation and controls various well-related operations. As shown in FIG. 12, one such instrument may be a pressure gauge 1244 (or similar pressure measurement device) disposed or otherwise adapted to measure pressure within the isolated well section 1222. In the illustrated example of FIG. 12, the pressure gauge 1244 is disposed downhole and coupled to the isolated well section 1222. The pressure gauge 1244 is also communicatively coupled to the wellhead 1224 by a tubing encapsulated cable 1264. Accordingly, pressure measurements corresponding to the pressure within the isolated well section 1222 may be obtained from the pressure gauge 1244 and communicated to the computing system 1250 via the wellhead 1224. The computing system 1250 may then control well-related operations (such as fracturing operations) based, at least in part, on the pressure measurements provided by the pressure gauge 1244.

The well completion environment 1200 is depicted after perforation but before fracturing of the uphole section 1262 of the well 1220. Accordingly, the horizontal section 1204 includes a plurality of perforations 1238 extending into subsurface formation 1206. The perforations 1238 are formed during completion of the well 1220 to facilitate introduction of fracturing fluid into the subsurface formation 1206 adjacent the horizontal well section 1204. During fracturing, fracturing fluid is pumped into the active well 1220 and the fluid passes through the perforations 1238 under high pressures and rate into the subsurface formation 1206. As pressure increases, the fracturing fluid injection rate increases through the perforations 1238, forming fractures that propagate through the subsurface formation 1206, thereby increasing the size and quantity of fluid paths between the subsurface formation 1206 and the uphole section 1262 of the well 120.

As fractures form and propagate from the uphole section 1262 into the subsurface formation 1206, the fractures become poroelastically coupled to the transducer fracture 1242 and corresponding pressure responses within the isolated well section 1222 are measured within the isolated well section 1222 by the pressure gauge 1244. In response to the measurements obtained by the pressure gauge 1244, the computing system 1250 may modify one or more parameters associated with the fracturing operation. For example, the computing system 1250 may be communicatively coupled to a pumping system 1232 configured to inject fracturing fluid into the well 1220 and to modify various properties of the fracturing fluid. Accordingly, the pumping system 1232 may include various pieces of equipment configured to pump fracturing fluid into well 1220 and, in certain implementations, may include additional equipment for modifying characteristics of the fracturing fluid and/or the manner in which the fracturing fluid is injected into well 1220. Such equipment may be used, for example, to add or change a proppant or other additive of the fracturing fluid in order to modify, among other things, the viscosity, proppant concentration, proppant size, or other aspects of the fracturing fluid. Accordingly, such equipment may include, without limitation, one or more of tanks, pumps, filters, and associated control systems. The computing system 1250 may include one or more local or remote computing devices configured to receive and analyze the pressure data to facilitate control of the fracturing operation.

As previously discussed in the context of two-well arrangements, such parameters may include, among other things and without limitation, a fracturing fluid injection rate, a fracturing fluid viscosity, a proppant size, an additive ratio of the fracturing fluid, and initiation of a diversion operation.

Figure 13:
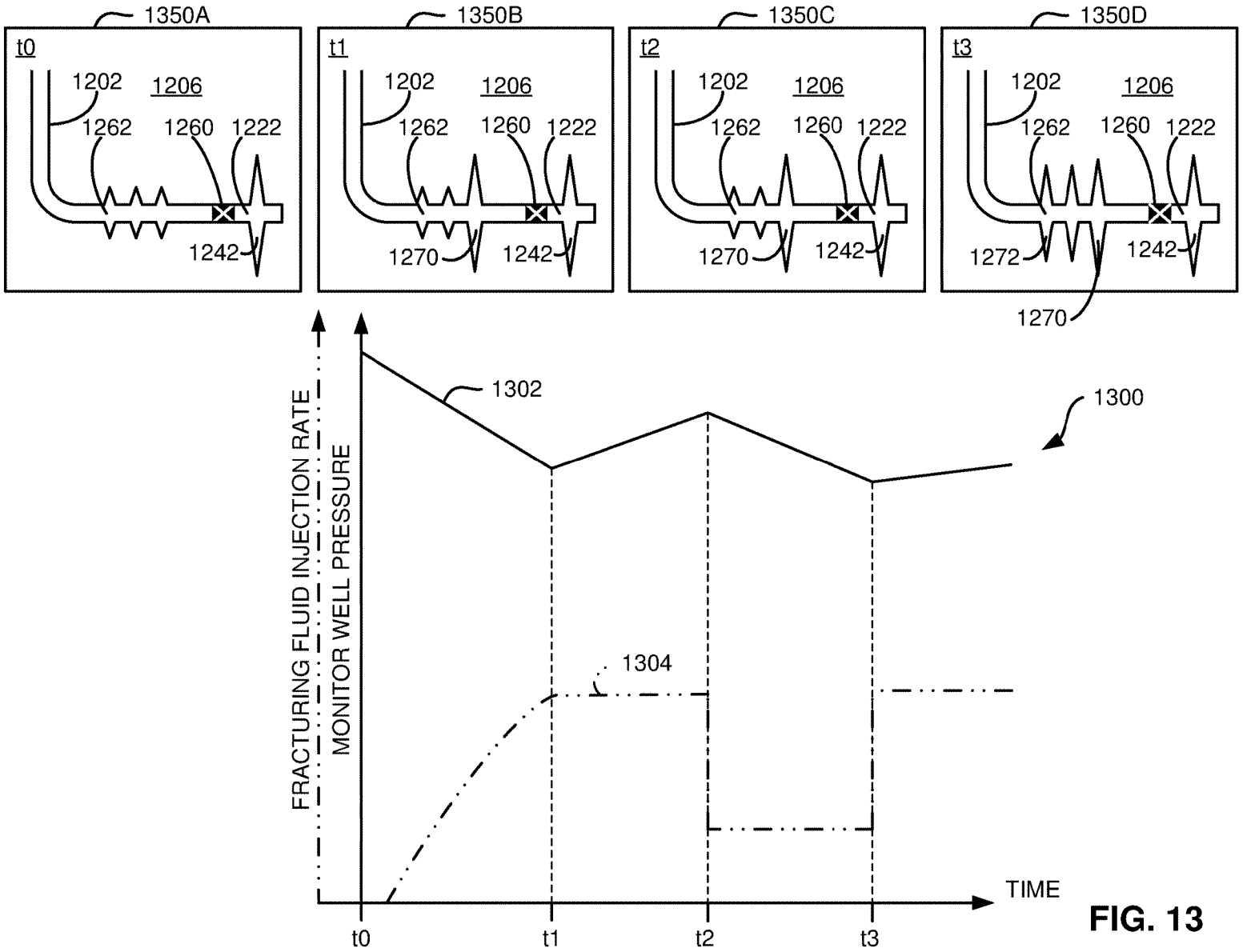
FIG. 13 is an example graph illustrating pressure within an isolated section of a well and fracturing fluid flow rate over time during a fracturing operation of the well.

FIG. 13 (with reference to elements of FIG. 12) illustrates an example implementation of a one-well implementation of the present disclosure in which pressure within the isolated well section 1222 is used to initiate a rate cycling operation. More specifically, FIG. 13 illustrates an example of how a fracturing fluid injection rate may be modified to control fracture propagation during a fracturing operation.

FIG. 13 includes a graph 1300 illustrating a fracturing operation in accordance with this disclosure. Further reference is made to schematic illustrations 1350A-D, which depict the subterranean formation 1206 at various stages of a fracturing operation conducted on the well 1220. As illustrated in illustrations 1350A-D, the well 1220 includes uphole sections 1202 and 1262 and an isolation device 1260 separating the uphole sections 1202 and 1262 from the isolated well section 1222. The graph 1300 includes a pressure line 1302 corresponding to a pressure measurement obtained from the isolated well section 1222 (for example, by using a downhole pressure instrument, such as the pressure gauge 1244 of FIG. 12). As shown in illustrations 1350A-D, the isolated well section 1222 may include one or more transducer fractures 1242 extending into the subterranean formation 1206. The graph 1300 further includes an injection rate line 1304 shown as a dashed and dotted line.

At time t0, no fracturing fluid has been injected into the well 1220 and, as a result, no fractures have started propagating from the uphole section 1262 of the well 1220. Between time t0 and time t1, the fracturing fluid injection rate is increased, causing growth of a dominant fracture 1270 from the uphole section 1262, as indicated by the transition between illustrations 1350A and 1350B. During this time, pressure within the isolated well section 1222 exhibits a relatively steady decrease, which may be associated with leak off from the isolated well section 1222 into the surrounding formation 1206.

At time t1, the fracturing fluid injection rate is maintained at a first level. Also at time t1, initial poroelastic coupling occurs between the dominant fracture 1270 of the uphole section 1262 and the transducer fracture 1242 extending from the isolated well section 1222. As illustrated by the interval between time t1 and t2 and the corresponding upward trend in the pressure line 1302, the poroelastic coupling results in an increase rate of pressure change within the isolated well section 1222.

In response to the increased rate of pressure change within the isolated well section 1222, a rate cycle is initiated at time t2. Such rate cycling includes reducing the fracturing fluid injection rate at time t2. As a result of reducing the fracturing fluid injection rate, pressure within the isolated well section 1222 begins to decrease as indicated by a downward trend in the pressure line 1302 between t2 and t3. In other words, leak off from the isolated well section 1222 resumes in light of the reduced fracturing fluid injection rate and the corresponding reduced pressure effects applied to the transducer fracture 1242 by the dominant fracture 1270.

After a predetermined time, a predetermined reduction in pressure within the isolated well section 1222, or any other similar event, the rate cycle is completed by subsequently increasing the fracturing fluid injection rate at time t3. As shown in illustration 1350D, such rate cycling may facilitate the diversion of increased fracturing fluid into and corresponding propagation of one or more non-dominant fractures (such as non-dominant fracture 1272) extending from the uphole well section 1262. Such direction of the fracturing fluid into the non-dominant fractures may be exhibited as a decrease in the rate of pressure change within the isolated well section 1222 as compared to the rate of pressure change exhibited before rate cycling (e.g., between times t1 and t2). In other words, the rate cycling resulted in an increased proportion of the fracturing fluid being diverted into the non-dominant fractures located uphole relative to the dominant fracture 1270. As a result, the pressure effects resulting from poroelastic coupling between the dominant fracture 1270 and the transducer fracture 1242 were reduced as indicated by a reduced upward pressure trend as compared to before the rate cycling operation (i.e., between times t1 and t2).

FIG. 13 is only an example of a one-well implementation of the present disclosure. In other implementations, other fracturing operation parameters may be modified in response to pressure changes measured within the isolated well section 1222 and, more specifically, such changes resulting from poroelastic coupling of the isolated well section 1222 with one or more fractures originating from the uphole well section 1262. For example, and without limitation, one or more of a viscosity, an additive ratio, a proppant type, a proppant concentration, a proppant size, or other characteristic of the fracturing fluid may be modified in response to the pressure within the isolated well section 1222. Similarly, pressure within the isolated well section 1222 may also be used to initiated and/or otherwise control other processes during the fracturing operation. Such processes may include, for example, a diversion operation as discussed in more detail in the example fracturing operations of FIGS. 8 and 9.

Fracturing Operation Monitoring Using Sealed Monitor Wells

In the previous implementations discussed herein, fracturing operations for a target well were monitored in part using an offset/monitor well. More specifically, pressure changes within the monitor well resulting from poroelastic coupling between a monitoring fracture (or factures) of the monitor well and the fractures formed during fracturing of the target well are used to determine progress of the fractures of the target well and, subsequently, to control fracturing operations (e.g., by triggering a rate cycle).

In another aspect of the present disclosure, systems and methods are provided for monitoring of hydraulic fracturing treatments using a sealed monitor well instead of the monitoring fracture of the previous implementations. The sealed monitor well may be cased but unperforated and substantially filled with a fluid (e.g., water). In certain applications, sufficient fluid may be present in the monitor well due to previous well operations. However, in other applications, additional fluid may be added to the sealed monitor well prior to sealing the monitor well to completely fill the monitor well to surface with fluid.

In certain implementations, the monitor well or one or more portions of the monitor well may be sealed such that fluid is substantially maintained therein. As discussed herein, the terms "sealed" and "isolated" recognize that at least some leakage may nevertheless occur from a monitor well that is sealed or isolated relative to an external environment (e.g., the subterranean formation) or from a portion of a monitor well that is further sealed or isolated from another portion of the monitor well. Among other sources, such leakage may be the result of small leaks in a casing of the monitor well; leaks through or around packers isolating sections of the monitor well; and leaks through valves, fittings, flanges, or other similar equipment (including such equipment incorporated into a wellhead of the monitor well). Accordingly for purposes of the present disclosure and unless otherwise specified, the term "sealed" or "isolated" in the context of wells described herein (including, without limitation, both monitor and target wells) or portions of such wells should be understood to include instances where the well or portion of the well may be subject to at least some leakage.

The monitor well is fitted with one or more pressure transducers, which may be disposed at various locations within the monitor well and/or installed in a wellhead of the monitor well. As fractures from an adjacent target well approach and/or overtake the monitor well, force is exerted on the monitor well, increasing the internal pressure of the monitor well as measured by the pressure transducers. Based on measurements of such pressure changes, the progress of fracturing operations of the target well may be ascertained. Similar to the previous implementations discussed herein, fracturing operations of the target well may then be controlled or otherwise modified in response to the pressure changes observed in the monitor well.

Various sections of the monitor well could also be isolated from each other and pressure may be monitored in each section. By doing so the monitor well may be divided into distinct chambers or monitoring portions to better define the subsurface effects being monitored. Sectioning of the monitor well may be achieved, for example, by bridge plugs, packers, or other suitable isolation tools. In certain implementations transducers may be deployed via a tubing string to monitor pressure in each isolated section.

Monitor wells for use in the systems and methods described herein may be preexisting wells or may be drilled specifically for purposes of monitoring fracturing operations. In general, however, the monitor wells are preferably located proximate the target well such that the monitor well extends across a growth path for fractures extending from the target well and, if possible, transverse or generally perpendicular to the predominant fracture growth direction. In some instances, the monitor well, or at least a portion thereof, will be generally parallel the well bore being fractured.

During fracturing operations of the target well, hydraulic fractures approach the monitor well and induce stresses in the rock surrounding the monitor well. As such stresses increase, such as by the introduction of additional hydraulic fracturing fluid into the target well, portions of the monitor well may be compressed. Such compression may result in pressure changes (increases) within the monitor well for several reasons. For example, assuming that the monitor well is sealed, the pressure change within the monitor well may be a result of the compressive forces from the fracture and associated fracturing fluids intercepting or otherwise interacting with the monitor well casing and thereby acting upon fluid contained within the monitor well. Pressure increases may also be observed due to compression of the monitor well casing reducing the inner diameter of the monitor well, thereby causing the level of liquid maintained within the monitor well to increase and, as a result, the hydraulic head provided by the liquid.

In certain cases, interaction between the hydraulic fractures extending from the target well and the monitor well may also be observed as an initial reduction in pressure within the sealed monitor well. For example, as a fracture extends from the target well, the forces and pressures within the formation associated with the propagating fracture may reduce in-situ stresses on the monitor well and, as a result, may cause a decrease in pressure within the monitor well. Once the fracture reaches the sealed monitor well, the net stress (added to the steady state in-situ stresses) induced by the extending fracture may switch from being tensile to compressive. In the immediate vicinity of the fracture surface, the induced compressive stresses may be approximately equal to the fracture fluid pressure within the extending fracture at the particular point of interest. Accordingly, a pressure reduction may be observed as the fracture approaches the monitor well followed by an increase in pressure once the fracture tip passes the monitor well.

In certain implementations, a single monitor well may be used to monitor fracturing operations for two or more target wells. In one particular example, a single monitor well may be used to facilitate a "zipper" fracturing operation for multiple target wells. Such an operation may generally include fracturing of multiple target wells in an alternating manner to improve overall operational efficiency. For example, a first stage of a first well may be plugged and perforated using a wireline or similar tool. As the first stage of the first well is fractured, a first stage of a second well may be plugged and perforated, preferably (although not necessarily) from the same or a nearby well pad such that the same wireline tool and pumping system may be used in the second well. A second stage of the first well may then be plugged and perforated while the first stage of the second well is fractured. This process is repeated for each stage of the first and second wells. In such implementations, a monitor well may be disposed between each of the multiple wells undergoing fracturing operations to direct or control such operations. For example, a single monitor well may be disposed between the first well and the second well to determine when a given stage of the first well has been sufficiently fractured and, as a result, when to begin fracturing a corresponding stage of the second well (and vice versa).

In another example operation, the monitor well may be positioned between a depleted region and two or more target wells being completed in a zipper operation. Alternatively, the monitor well may be located on the opposite side of the depleted area such that the depleted area and the two or more target wells are disposed on the same side of the monitor well. The target wells may then be alternatingly completed using the monitor well to determine whether completion order is affecting fracture propagation direction. For example, if stages in a target well further away from the region of depletion are fractured ahead of comparable stages of a target well closer to the region of depletion, the fractures in the target well closer to the region of depletion could be driven towards the depleted region. By monitoring pressure within the monitor well, one may identify such interactions between the target wells and may determine fracture order or delays between zipper operations to minimize such interactions.

One or more pressure transducers may be disposed along the monitor well or otherwise positioned to measure pressure within the monitor well. Without limitation, example locations for pressure transducers include at a heel of the monitor well, at a toe of the monitor well, at one or more intermediate locations between the heel and the toe, and at the wellhead of the monitor well. In certain implementations, pressure transducers may be disposed along the monitor well that correspond to different stages of the target well. By providing pressure transducers at multiple locations along the monitor well, additional information regarding the actual or approximate location at which fractures from the target well overtake the monitor well may be ascertained. In certain implementations, the information from the pressure transducers may also be supplemented or validated by strain measurements obtained from strain gauges or one or more optical fibers disposed along the wellbore and which measure strain on the casing caused by interactions with the fracture of the target well. For example and without limitation, such strain measurement devices may be distributed along the casing of the monitor well, particularly between the heel and the toe of the monitor well and could include discrete strain gauges of optical fibers.

Pressure gauges or similar pressure and/or force measurement devices may also be used to monitor external formation pressure and forces exerted by the formation on the monitor well, providing additional details regarding fractures extending from the target well and the monitor well. In certain implementations, communication may be established between the formation and such external gauges by perforation shots directed away from the monitor well into the rock using a perforation gun located on the casing exterior of the monitor well. In another implementation, the inner diameter of the monitor well casing may be divided into discrete, isolated chambers, each having its own pressure transducer. Internal pressure sensing transducers could also be deployed inside the casing via tubing with isolation between sections via packers or deployed on the casing outer diameter and ported to the inner diameter.

In general, pressure measurement devices configured to measure pressure of a common, open portion of a wellbore will exhibit substantially the same pressure response as each other. Accordingly, to the extent pressure within specific portions of the monitor well are to be observed, such portions may be isolated (e.g., using packers, etc.) to define separate pressure measurement zones or monitoring portions/sections. However, it should be appreciated that maintaining fluid communication between at least a portion of the wellbore and a wellhead may be advantageous. For example, a pressure transducer disposed at a relatively shallow location within the well can be used to detect pressure responses caused by interactions of fractures and the monitor well provided the location of measurement by the pressure transducer is in fluid communication with the location of the interaction (e.g., by disposing the pressure transducer below a water or similar fluid level in the well bore). Advantages of doing so include, but are not limited to, a reduction in the required transducer pressure rating and improved pressure measurement resolution.

Although strain measurements are described herein as being used to validate or as otherwise supplemental to pressure measurements, systems and methods described herein may also rely on strain measurements as the primary (e.g., with pressure measurements used as supplemental data) or the only way of identifying interactions between the monitor and target wells. Accordingly, to the extent the foregoing disclosure discusses the use of pressure transducers and pressure measurements, it should be appreciated that strain gauges and strain measurements may generally be implemented in a similar manner.

As previously discussed, the pressure response measured in the monitor well may be, at least in part, due to pressure exerted on a fluid sealed within the monitor well. To the extent air or other compressible fluid is disposed within the sealed monitor well (for example, near the wellhead), such compressible fluid may negatively impact the accuracy, resolution, and timeliness with which pressure responses within the monitor well may be detected. Accordingly, the monitor well may be prepared such that the monitor well is substantially filled with a liquid, such as water. For example, water may be pumped or otherwise provided into the monitor well prior to fracturing of the target well and air or other compressible fluids may be substantially removed from the monitor well prior to sealing the monitor well.

Figure 14:
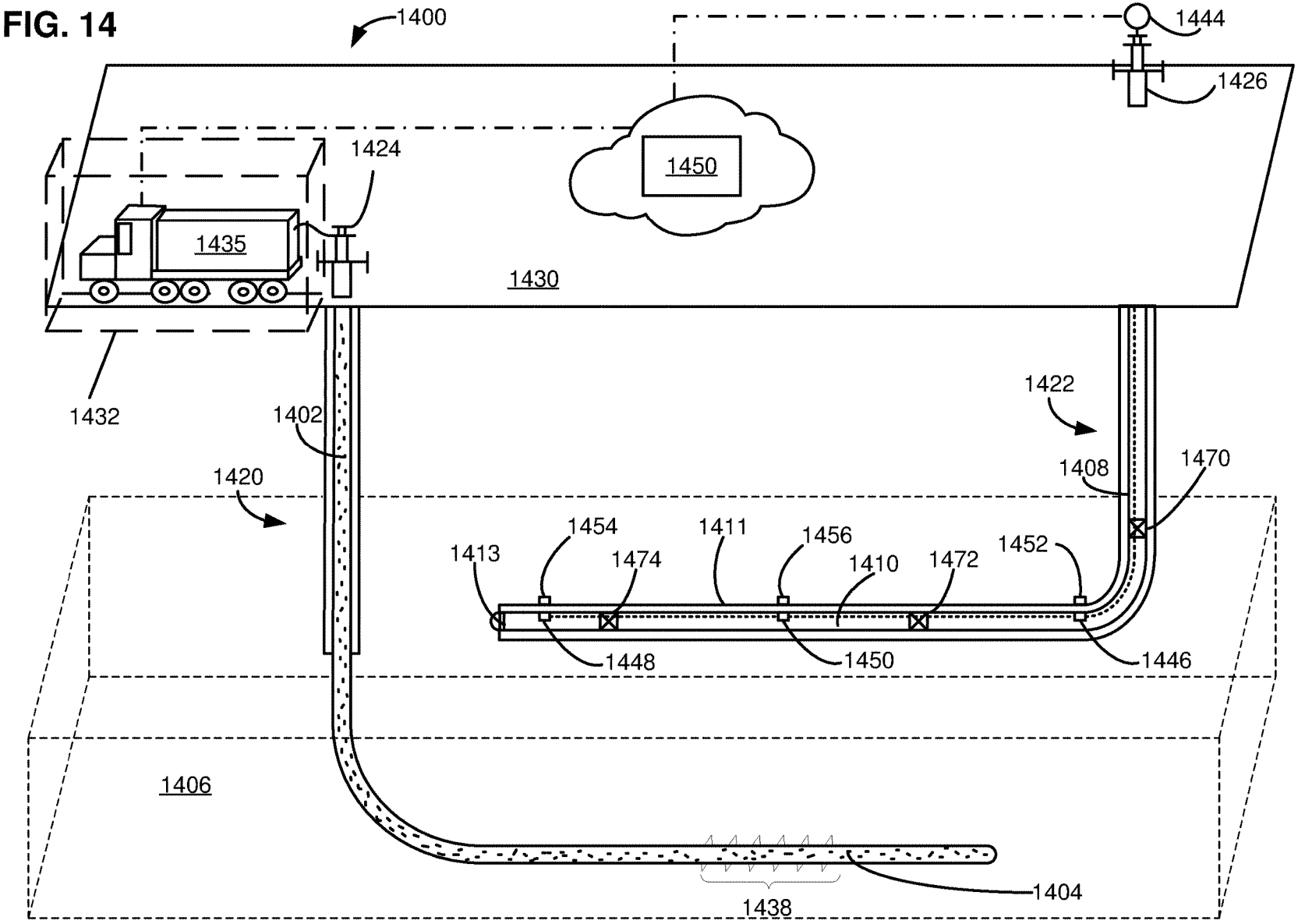
FIG. 14 is a schematic diagram of an example well completion environment including a target well and a monitor well and illustrating a fracturing operation in accordance with the present disclosure.

FIG. 14 is a schematic diagram of an example well completion environment 1400 for completing a fracturing operation in accordance with the present disclosure. The well completion environment 1400 includes a subsurface formation 1406 through which an active or target well 1420 and a monitor well 1422 extend. The target well 1420 includes a vertical active well section 1402 and a horizontal active well section 1404. Similarly, the monitor well 1422 is also a horizontal well and includes a vertical monitor well section 1408 and a horizontal monitor well section 1410. The monitor well 1422 and target well 1420 are shown from substantially offset vertical sections; however, it is also possible that the monitor well 1422 and the target well 1420 may be initiated from the same pad. Thus, the relative orientation of the wells 1420, 1422 is provided as an example and should not be construed as limiting.

In implementations of the present disclosure, the monitor well 1422 may generally be located relative to the target well 1420 such that the monitor well 1422 is likely to interact with fractures extending from the target well 1420. For example, the monitor well 1422 may be located to at least partially extend through the same strata of the subterranean formation through which the target well 1420 passes and/or may be disposed at a particular distance from the target well 1420 to which it may reasonably be assumed that fractures will extend.

In contrast to the monitor well 122 of the well completion environment 100 discussed in the context of FIG. 1, the monitor well 1422 may be sealed. For example, as illustrated in FIG. 14, each of the vertical monitor well section 1408 and the horizontal monitor well section 1410 may be encompassed by a casing 1411. The horizontal well section 1410 may also include a plug 1413 or similar downhole feature such that the internal volume of the monitor well 1422 is closed. In alternative implementations of the present disclosure, one or both of the target well 1420 and the monitor well 1422 may be vertical wells. In some instances, a monitor well may be one that will be completed, or has been completed, and may in some instances be a producing well or previously producing well. Moreover, implementations of the present disclosure may include more than one active well and/or more than one monitor well. Accordingly, one or more monitor wells may be used to monitor fracturing of one or more active wells.

The target well 1420 includes a target wellhead 1424 disposed at a surface 1430. Similarly, the monitor well 1422 includes a monitor wellhead 1426 at the surface 1430. The monitor wellhead 1426 may further include multiple pressure gauges and transducers for measuring pressure at various locations within the monitor well 1422. For example, the monitor well 1422 includes each of a wellhead pressure transducer 1444, a heel pressure transducer 1446 located in or near the heel of the monitor well 1422, a toe pressure transducer 1448 located near the toe of the monitor well 1422, and an intermediate pressure transducer 1450 disposed between the heel pressure transducer 1446 and the toe pressure transducer 1448. The pressure transducers 1446, 1448, and 1450 are positioned to measure pressure within monitor well 1422. It should be appreciated that the quantity and placement of pressure transducers in implementations of the present disclosure are not limited to the arrangement illustrated in FIG. 14 and any suitable number of pressure transducers for measuring pressure within the monitor well 1422 may be used.

In addition to pressure transducers 1444, 1446, 1448, and 1450, various other sensors and transducers may be used in implementations of the present disclosure. For example, each of the heel pressure transducer 1446, the intermediate pressure transducer 1450, and the toe pressure transducer 1448 are supplemented with a respective strain gauge, strain transducer, or other externally sensing pressure transducers 1452, 1454, and 1456. Each of the strain gauges 1452, 1454, and 1456 is coupled to the casing 1411 adjacent the respective pressure transducer 1446, 1448, and 1450. Accordingly, each of the strain gauges 1452, 1454, and 1456 may measure strain on the casing 1411 at their respective locations. It should be appreciated that while the strain gauges 1452, 1454, and 1456 are shown as having a one-to-one relationship with the pressure transducers 1446, 1448, and 1450, more or fewer strain gauges may be used in other implementations of the present disclosure and the strain gauges may be positioned at locations along the casing 1411 that do not necessarily correspond to a location of a pressure transducer. Moreover, different combinations of sensors are possible, and implementations without pressure sensors are possible. Fiber based sensing arrangements that can detect a fracture approaching and/or intercepting the monitor well are also possible. For example, a fiber optic-based strain gauge may be disposed on the casing 1411 to facilitate strain measurements.

Each of the pressure transducers 1444, 1446, 1448, and 1450 may be configured to measure pressure within a respective monitoring portion of the monitor well 1422. To do so, one or more packets, plugs, or similar isolation tools may be disposed at various locations within the monitor well 1422. For example, as illustrated in FIG. 14, three packers 1470, 1472, and 1474, are disposed at various locations within the monitor well 1422 to form three distinct sections of the monitor well 1422, each including a respective one of the pressure transducers 1444, 1446,1448, and 1450 to measure pressure within the section.

Another example of sensors that may be used in implementations of the present disclosure include, without limitation, externally sensing pressure transducers. In one example implementation, such transducers may be installed with perforation guns on the outer diameter of the monitor well casing 1411 and perforations may be shot away from the casing 1411 (i.e., not penetrating the casing). As a result, the perforations together with the externally sensing pressure transducers form a pressure sensing system that will sense fractures extending from the target well 1420 as they approach the monitor well 1422. Yet another type of sensor that may be used in implementations of the present disclosure is a contact stress or tactile pressure sensor, which generally measure contact stresses or contact pressure between two mating surfaces. Accordingly, such sensors may be mounted to an exterior surface of the casing 1411 to measure contact forces and pressure exerted onto the outer surface of the casing 1411.

Each of the gauges, sensors, and transducers of the environment 1400 is adapted to obtain a corresponding measurement. Such measurement data may then be transmitted to a computing system 1450. In the well completion environment 1400, the computing system 1450 is communicatively coupled to a pumping system 1432 (illustrated in FIG. 14 as including a pumping truck 1435) such that the computing system 1450 can transmit pressure data, control signals, and other data to the pumping system 1432 to dynamically adjust parameters of the fracturing operation based on pressure measurements received from the monitor well 1422 and monitor well wellhead 1426. The pumping system 1432 generally provides fracturing fluid into the target well 1420 and, in certain implementations, may include additional equipment for modifying characteristics of the fracturing fluid and/or the manner in which the fracturing fluid is injected into the target well 1420. Such equipment may be used, for example, to add or change a proppant or other additive of the fracturing fluid in order to modify, among other things, the viscosity, proppant concentration, proppant size, or other aspects of the fracturing fluid. Accordingly, such equipment may include, without limitation, one or more of tanks, pumps, filters, and associated control systems. The computing system 1450 may include one or more local or remote computing devices configured to receive and analyze the pressure data to facilitate control of the fracturing operation.

The computing system 1450 may be a single computing device communicatively coupled to components of the well completion environment 1400, or forming a part of the completion environment 1400, or may include multiple, separate computing devices networked or otherwise coupled together. In the latter case, the computing system 1450 may be distributed such that some computing devices are located locally at the well site while others are maintained remotely. In certain implementations, for example, the computing system 1450 is located locally at the well site in a control room, server module, or similar structure. In other implementations, the computing system is a remote server that is located off-site and that may be further configured to control fracturing operations for multiple well sites. In still other implementations, the computing system 1450, in whole or in part, is integrated into other components of the well completion environment 1400. For example, the computing system 1450 may be integrated into one or more of the pumping system 1435, the active wellhead 1424, and the monitor wellhead 1426.

The pressure transducers 1444-1450 (and any other transducers or sensors, such as the strain gauges 1452-1456) are communicatively coupled to the computer system 1450, such as by respective transmitters. Similar transducers and sensors may also be installed or disposed in the target well 1420 and communicatively coupled to the computer system 1450 to measure or otherwise obtain data regarding conditions in the target well 1420. Although described herein as measuring pressure and strain, other transducers and sensors that may be implemented in the well environment 1400 may also measure temperature, flow rate, level, various chemical measurements, or any other condition or quantity that may be of interest in either the target well 1420 or the monitor well 1422.

Well completion environment 1400 is depicted after perforation but before fracturing of the target well 1420. Accordingly, active well horizontal section 1404 includes a plurality of perforations 1438 that extend into the formation 1406 from the target well 1420. In the implementation illustrated in FIG. 14, the perforations 1438 are formed and extend from an uncased portion of the target well 1420 into the surrounding formation 1406. In contrast, in implementations in which fracturing operations are to occur in a cased portion of a target well, the perforations would also extend through the well casing. The perforations 1438 may be formed during the initial completion of the target well 1420 to direct fracturing fluid into the subsurface formation 1406 at the respective perforations. For example, in certain completion methods, casing is installed within the well and a perforating gun is positioned within the target well 1420 adjacent the portion of the subsurface formation 1406 to be fractured. The perforating gun includes shaped charges that, when detonated, create perforations that extend through the casing and into the adjacent formation, thereby creating an initial fluid path from the target well 1420 into the formation. During fracturing, fracturing fluid is pumped into the target well 1420 and the fluid passes through the perforations 1438 under high pressure and rate. The injection of fracturing fluid into the formation at the perforations forms one or more fractures that emanate from the well into the subsurface formation 1406. The fractures form fluid paths between the subsurface formation 1406 and the target well 1420 so that oil and/or gas in the formation flows to and into the well.

Alternative fracturing methods may also be used in conjunction with the systems and methods disclosed herein. For example, in certain implementations, the fracturing operation is an open-hole fracturing operation. In contrast to methods in which a casing is installed and then perforated prior to fracturing, open-hole fracturing is performed on an unlined section of the wellbore. Generally, open-hole fracturing involves isolating sections of the uncased wellbore using packers or similar sealing elements. Sliding sleeves or similar valve mechanisms disposed between the packers are then opened to permit pumping of the fracturing fluid into the surrounding formation. As pressure within the formation increases, fractures are formed and propagated. In multi-stage wells, this process is repeated for each stage moving up the wellbore. Of course, multi-stage fracking may also be performed in a cased well.

The active wellhead 1424 is coupled to a pump system 1432 for pumping fracturing fluid into the target well 1420. In the well completion environment 1400, for example, the pump system 1432 includes a pump truck 1435 coupled to the active wellhead 1424. The pump truck 1435 includes a tank or other means for storing the fracturing fluid and a pump connected to the active wellhead 1424 for pumping fluid into the target well 1420. In other embodiments, the pump system 1432 includes other equipment for providing fracturing fluid to the target well 1420 including, without limitation, storage tanks or other vessels and one or more additional pumps. The pump system 1432 may further include equipment configured to modify the fracturing fluid, for example, by adding one or more additives, such as proppants or chemicals, to the fracturing fluid. The pump system 1432 may also include equipment, such as filters, to treat and recycle fracturing fluid. As shown in the implementation of FIG. 14, the pump system 1432, and more particularly pump truck 1435, is communicatively coupled to the computing system 1450. Accordingly, the pump truck 1435 can receive sensor data, control signals, or other data from the computing system 1450, including data configured to be used in controlling and monitoring of an ongoing fracturing operation.

In addition to being sealed, the monitor well 1422 may contain and be substantially filled with a liquid, such as water. In certain implementations, during preparation of the monitor well 1422, liquid may be introduced into the monitor well 1422 or otherwise allowed to substantially fill the monitor well 1422 in order to displace air, gaseous hydrocarbons, or other highly compressible fluids or media that may be present in the monitor well 1422. By doing so, the monitor well 1422 may be made to be more responsive to applied stresses than if the monitor well 1422 contained the highly compressible fluid. For purposes of this disclosure, the term "substantially filled" should not be interpreted to mean any specific degree to which the monitor well 1422 is filled. Rather, the monitor well 1422 is sufficiently filled if the amount of fluid present within the monitor well 1422 provides improvement in detecting a pressure response of the monitor well 1422 due to interactions with a fracture extending from the target well 1420 as compared to if the monitor well 1422 did not contain any such fluid.

Figure 15A:
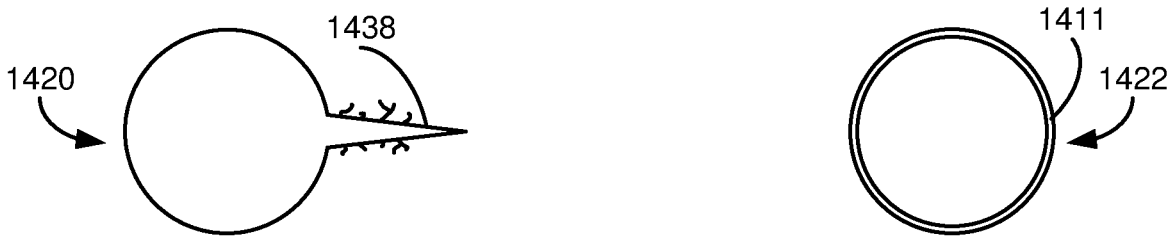
FIGS. 15A-D are cross-sectional views of a target well and a monitor well during a fracturing operation in accordance with the present disclosure.
Figure 15B:
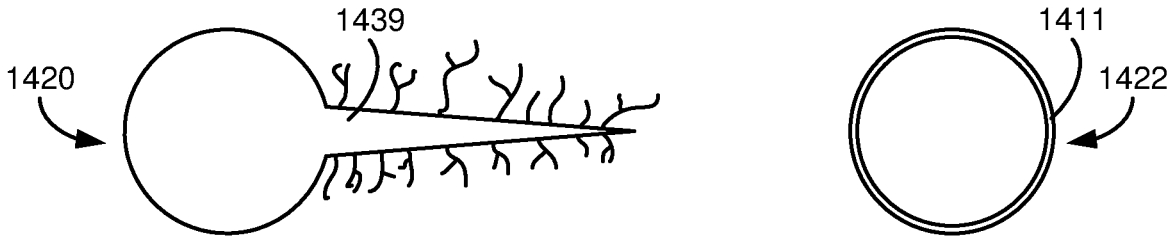

FIGS. 15A-D are cross-sectional views of the well environment 1400 illustrating the formation and propagation of fractures from the target well 1420 toward the monitor well 1422 to illustrate various aspects of the present disclosure. In the following description, reference is also made to elements of the well completion environment 1400 illustrated in FIG. 14. Referring first to FIG. 15A, each of the target well 1420 and the monitor well 1422 are shown prior to injection of fracturing fluid. For simplicity, only one perforation 1438 is illustrated extending from the target well 1420, however, it should be appreciated that multiple perforations may extend from the target well 1420 in multiple directions. As pumping system 1432 pumps fracturing fluid into the target well 1420, the fracturing fluid enters the subsurface formation 1406 through the perforations 1438. As the fracturing fluid continues to enter the subsurface formation 1406, pressure within a portion of the subsurface formation 1406 adjacent the perforations 1438 increases, leading to the formation and propagation of fractures 1439 within the subsurface formation 1406, as illustrated in FIG. 15B.

Figure 15C:
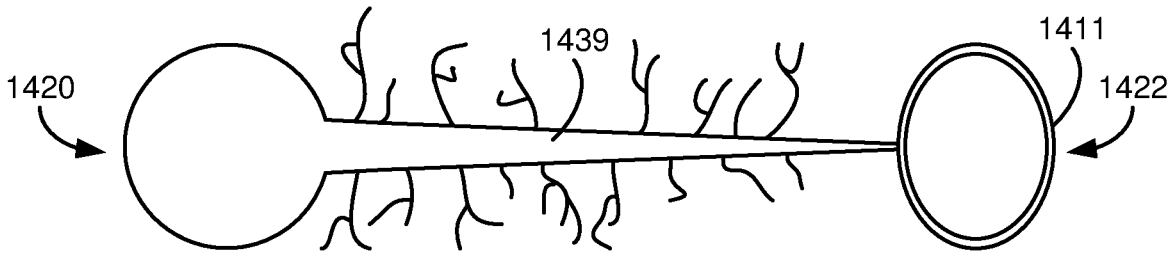

As illustrated in FIG. 15C, as the fractures 1439 grow and continue to propagate outward toward the monitor well 1422, stresses are induced in the portion of the subsurface formation 1406 disposed between the target well 1420 and the monitor well 1422. Such stresses may result in force being applied to the monitor well 1422 and may result in deformation of the monitor well 1422 or, more specifically the casing 1411 of the monitor well. Such deformation results in change of pressure within the monitor well 1422 which may be attributable to the external pressure exerted on the casing 1411 and/or the change in hydraulic head caused by the changing diameter of the casing 1411.

The change of pressure within the monitor well 1422 may generally be an increase as the fracture crosses the path of the monitor well 1422, however, in at least some cases the pressure within the monitor well 1422 may also decrease as the fracture approaches the monitor well 1422 and relieves in-situ stresses within the formation 1406. Accordingly, while the current disclosure focuses on pressure increases as being the primary change indicating interaction between fractures of the target well 1402 and the monitor well 1422, implementations of the present disclosure may also rely on pressure decreases within the monitor well 1422 as indicative of interactions between the fracture and the monitor well 1422.

Figure 15D:
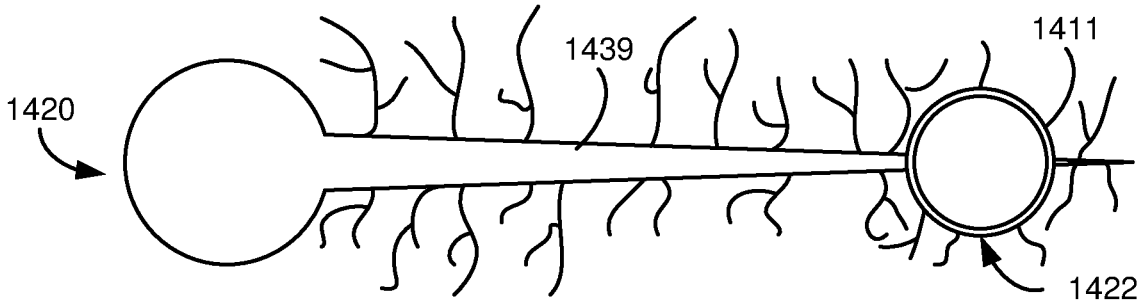

Although illustrated in FIG. 15C as resulting in a lateral compression of the monitor well 1422, it should be appreciated that such deformation is not intended to be to scale and illustrates just one possibility of deformation that may result from stresses induced in the subsurface formation 1406. Actual deformation of the monitor well 1422 may differ and may depend on, among other things, the actual direction of propagation of the fracture 1439 from the target well 1420, the relative location and change of location relative to the monitor well 1422 (above, below, intercepting, etc.) and the various properties of the subsurface formation 1406. As the fractures continue to propagate and cross the path of monitor well 1422, as illustrated in FIG. 15D, the compressive effects on the monitor well 1422 may increase, resulting in further deformation of the monitor well casing 1411 and increased pressure within the casing 1411.

Pressure changes within the monitor well 1422 provide information regarding the propagation of fractures from the target well 1420 and, as a result, identifying and characterizing such pressure changes may be used to control fracturing operations, among other things. Generally, pressure changes observed in the monitor well 1422 during pumping of fracturing fluid into the target well 1420 indicate when fractures extending from the target well 1420 have propagated near or have crossed the path of the monitor well 1422. Accordingly, the time between initiating injection of fracturing fluid into the target well 1420 and a corresponding response in the monitor well 1422, the total fluid volume pumped into the active stage 1438 before identifying a response in the monitor well 1422, the degree of the pressure response in the monitor well 1422, the rate of change of the pressure within the monitor well 1422, and other information related to the pressure response (or other sensed response) in the monitor well 1422 may be used to control one or more fracturing operation parameters or otherwise inform fracturing operations. Fracturing operation parameters generally refers to any aspect of a fracturing operation that may be controlled or varied to modify the fracturing operation. Example fracturing operation parameters include, without limitation, fracturing fluid viscosity, proppant size, proppant concentration, fracturing fluid additive ratios, fracturing fluid injection rate, fracturing fluid injection duration (e.g., for rate cycling), duration between pumping cycles, fracturing fluid injection pressure, fracturing fluid composition, and the like.

As previously discussed, pressure transducers may be disposed at various locations of the monitor well 1422, such as the heel pressure transducer 1446, the intermediate pressure transducer 1450, and the toe pressure transducer 1448. By implementing multiple pressure transducers along the length of the monitor well 1422, localized pressure changes may be observed and, as a result, the approximate location of fractures inducing such pressure changes may be inferred. As illustrated in FIG. 14, identifying the location of the fractures may be facilitated by isolating portions of the wellbore (such as by using packers 1470-1474) and using one or more pressure transducers to measure pressure within each isolated portion of the monitor well 1422. Accordingly, when a pressure response is measured by a particular subset of the pressure transducers, it may be assumed that fractures have crossed the monitor well 1422 at some point along the corresponding section.

Another advantage gained by isolating sections of the monitor well 1422 and including pressure transducers for measuring pressure responses in each isolated section is that the pressure response in the smaller section increases and is therefore more easily observable than if the monitor well was not subdivided. For example, in a 20,000 foot well (as measured from surface to toe) without isolation and filled with a fluid, the entire fluid volume is compressed as a fracture approaches and/or crosses over the monitor well 1422. As a result of the compressibility of the fluid within the well, the observed response in an "open" (i.e., without isolation) 20,000 foot well may be relatively small (e.g., on the order of only 1 psi). However, if a bridge plug or similar device is set at 10,000 feet (or any other depth that divides the wellbore), the sensed pressure change in the lateral would double (e.g. on the order of 2 psi) because only half of the fluid is available to be compressed as is available in the fully open scenario. Further subdividing the monitor well 1422 further increases the response. Continuing the current example, suppose a 10,000 foot lateral portion of the well is divided into five 2,000 foot sections, each of which is isolated from each other. If a fracture were to cross the monitor well 1422 near the center of one of the 2000 foot sections, the induced pressure change would be on the order of 10 psi since only 1/10th of the entire fluid volume of the monitor well 1422 is being compressed. Accordingly, in addition to being useful in determining the approximately location at which a fracture has approached/crossed the monitor well 1422, isolating and monitoring sections of the monitor well 1422 improves the sensitivity with which the monitor well 1422 is able to detect such interactions.

In an example application, suppose a dominant fracture propagates from the target well 1420 to overtake the monitor well 1422 near the toe of the monitor well 1422. If the toe portion of the monitor well 1422 is isolated, only the toe pressure transducer 1448 may register a pressure increase, may register a pressure increase before the other pressure transducers (for example, if the dominant fracture expands to cross two sections of the monitor well 1422), or may register a pressure increase that is greater than the other pressure transducers. As a result, it may be assumed that the dominant fracture is likely in the vicinity of the toe of the monitor well 1422. The location of dominant fractures may also be inferred from other sensors, such as the strain gauges 1452-1456. For example, if a dominant fracture extends from the target well 1420 and overtakes the monitor well 1422 near the toe of the monitor well 1422, the toe strain gauge 1454 may measure strain on the monitor well casing 1411 that precedes and/or exceeds strain measured by the strain gauges 1452, 1456 disposed at the heel and intermediate locations of the monitor well 1422. Moreover, other strain sensors may not detect a change from a fracture proximate a distant sensor.

As previously noted, if sections of the monitor well 1422 are not isolated, each pressure transducer along the monitor well 1422 may register approximately the same pressure measurement at steady state. However, by observing how pressure changes propagate through the monitor well 1422, an approximation of the location at which a fracture crosses the monitor well may be ascertained. In other words, while pressure may ultimately equalize along the length of the monitor well 1422, different portions of the monitor well 1422 may reach pressure at slightly different times. As a result, the earliest locations to reach pressure may be used to approximate the location of the fracture. Other measurements, such as strain, may also be used alone or in combination with pressure measurements in open wells to facilitate identification of fracture locations.

Notably, while the target well 1420 shown in FIG. 14 is illustrated as including only a single stage, systems and methods in accordance with the present disclosure may be applied to multi-stage wells. More specifically, the target well 1420 may be divided into multiple stages that are consecutively plugged, perforated, and fractured and the monitor well 1422 may be used to monitor the formation and propagation of fractures for each stage. In certain implementations, the monitor well 1422 may include multiple groups of one or more pressure transducers or similar sensors distributed along the wellbore 1411 with each of the groups aligning or otherwise corresponding with a respective stage of the target well 1420. Accordingly, as each stage of the target well 1420 is fractured, respective responses may be observed in the monitor well 1422 Nonetheless, in some implementations a limited set of sensors or simply one sensor may be used to measure responses of the monitor well.

The pressure response of the monitor well 1422 may vary in applications in which multiple fractures from the target well 1420 cross the monitor well 1422. For example, an initial fracture may cross the monitor well 1422, resulting in a first increase in pressure within the monitor well 1422. When propagation of this initial fracture halts and pressure within the initial fracture begins to subside (e.g., due to fluid leak off from the fracture being greater than fluid being supplied to the fracture), a corresponding decline in pressure within the monitor well 1422 may be observed. If a second fracture from the target well 1420 (or other well) subsequently crosses the monitor well 1422 (e.g., following a rate cycle or similar operation), a second, smaller pressure increase as compared to that observed with the initial fracture may be observed in the monitor well 1422.

If a third fracture subsequently crosses the monitor well 1422, the pressure response of the monitor well 1422 may be dependent on the location at which the third fracture crosses the monitor well 1422. For example, if the third fracture is between the first and second fractures, little to no response may be observed in the monitor well 1422. However, if the third fracture is not disposed between the first and second fractures, another pressure increase may be observed in the monitor well 1422.

Following a fracturing operation and, in particular, after cessation of pumping fracturing fluid into any fractures formed during such an operation, the fracturing fluid may gradually leak into the surrounding formation, which may be observed in the monitor well 1422 as a gradual decline in pressure. When pressure within the monitor well 1422 returns to pre-fracturing operation levels, it may be assumed that the fractures induced during the operation have closed (which may, in certain cases, require hours or days to occur). Accordingly, pressure changes within the monitor well 1422 following a fracturing operation may be used to determine when closure time has occurred and when to initiate subsequent well operations.

Figure 16:
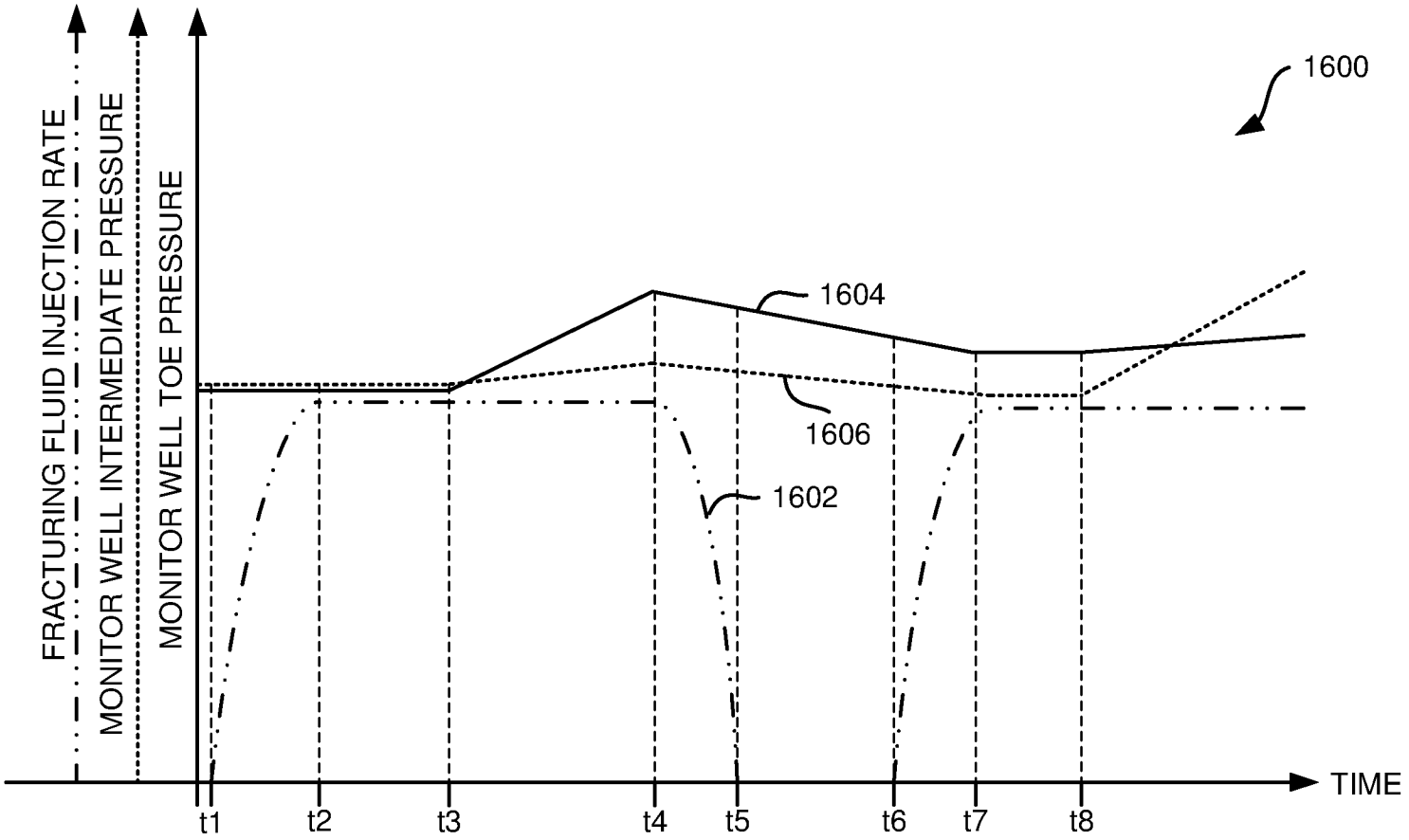
FIG. 16 is a graph illustrating a pressure response of a monitor well during an example fracturing operation of a target well.

FIG. 16 is a graph 1600 illustrating an example fracturing operation consistent with the foregoing description. The graph 1600 illustrates various metrics over time during an example fracturing operation. More specifically, the graph 1600 includes a first line 1602 indicating fracturing fluid injection rate into the target well 1420, a second line 1604 indicating first pressure measurements taken at a first location of the monitor well 1422, and a third line 1606 indicating second pressure measurements taken at a second location of the monitor well 1422. For purposes of the current example, the first location of the monitor well 1422 (indicated by the second line 1604) is assumed to be a toe of the monitor well 1422 and, as a result, the pressure measurement indicated by the second line 1604 may correspond to measurements obtained from the toe pressure transducer 1448. Similarly, the second location of the monitor well 1422 indicated by the third line 1606 is assumed to be at an intermediate location of the monitor well 1422 and, as a result, the pressure measurement indicated by the third line 1606 may correspond to pressure measurements obtained from the intermediate pressure transducer 1450. For purposes of FIG. 16, it is assumed that the pressure lines 1604, 1606 correspond to pressure measurements obtained from pressure transducers disposed in respective isolated sections of the wellbore.

Referring still to FIG. 16, beginning at t1, the fracturing fluid injection rate is gradually increased to a first injection rate at time t2. During the time period between t1 and t2, the pressure in each of the first location and the second location of the monitor well 1422 remains substantially constant, indicating that fractures have not yet sufficiently propagated from the target well 1420 to interact with the monitor well 1422.

At time t3, a pressure change is observed in each of the first and second monitor well locations, indicating that a dominant fracture from the target well 1420 has sufficiently propagated toward and influenced pressure within the monitor well 1422. As illustrated by the difference in slope between the toe pressure measurement line 1604 and the intermediate pressure measurement line 1606, the dominant fracture has likely propagated at or near the toe of the monitor well 1422 and, more specifically, has approached and/or crossed the isolated section of the monitor well 1422 corresponding to the toe. As previously mentioned, the location of the dominant fracture may be verified by, among other things, strain gauge readings corresponding to locations of the casing 1411 of the monitor well 1422.

At time t4, a rate cycle is initiated by reducing the fracturing fluid injection rate from the first rate and eventually stopping injection at time t5 (at time t5 it is also possible that the rate may be substantially reduced from the first rate (e.g., 90 barrels per minute to 10 barrels per minute)). In response, the pressures and stresses within the formation may gradually subside, as indicated by a gradual decline in the pressures observed in the monitor well and indicated by lines 1604 and 1606. As previously discussed, rate cycling by alternating periods of high fracturing fluid injection with low or no fracturing fluid injection may enable the development and propagation of other additional fractures extending from the target well 1420 and, as a result, to promote more complete fracturing of the subterranean formation 1406.

Although FIG. 15 illustrates an immediate decline in monitor well pressure in response to reducing the fracturing fluid injection rate, it should be appreciated that in certain cases a delay may be present between the reduction in injection rate and an observed pressure response in the monitor well 1422. Such a delay may depend on, among other things, the leak off rate into the surrounding formation. Also, pressure within the monitor well 1422 may continue to increase after reducing injection rate and even if pressure within the target well 1420 decreases as fluid may continue to flow towards the tip of the fracture.

At time t6, the injection rate is increased until a target injection rate is reached at time t7. At time t7 and until time t8, there is not a pressure response in the monitor well, which may indicate that the fracture that caused the first pressure increase is not growing but rather that new fractures are propagating from the target well 1420. At time t8, the pressure within the monitor well 1422 is again observed as increasing, indicating that stresses induced by the injection of fracturing fluid into the target well 1420 are causing corresponding pressure responses in the monitor well 1422. However, unlike during the time period of t3 to t4, in which a greater response was observed in the toe of the monitor well 1422, the time period beginning at t8 indicates a sharper response in the intermediate portion of the monitor well 1422 and, as a result, indicates the development of fractures proximate the intermediate portion of the monitor well 1422. In other words, FIG. 16 indicates that the rate cycling undertaken was successful in forming and/or propagating additional fractures from the target well 1420.

As previously noted, FIG. 16 illustrates a case in which pressure lines 1604 and 1606 are obtained from pressure transducers disposed in respective isolated sections of a monitor well. In other implementations, however, the pressure transducers may be disposed at different locations of an open (i.e., not isolated) well or disposed in the same isolated portion of the monitor well 1422. In such cases, the pressure measurements obtained from such transducers may be substantially the same (e.g., a slight offset may be present due to differences in hydrostatic head attributable to the location of the transducers within the monitor well 1422) or otherwise track each other throughout the fracturing operation. Accordingly, to differentiate if and when new fractures cross the monitor well 1422 other metrics may be required. For example and without limitation, in one implementation the location of a fracture may be approximated by determining which pressure transducer leads the other (provided the pressure transducers sample the pressure within the monitor well 1422 at a sufficiently high rate). In other implementations, other sensors may be used alone or in combination with the pressure transducers to determine the location of fractures. For example, strain gauges or other force sensors disposed on the casing of the monitor well 1422 may be used to determine the location of forces applied to the casing by propagating fractures.

Figure 17:
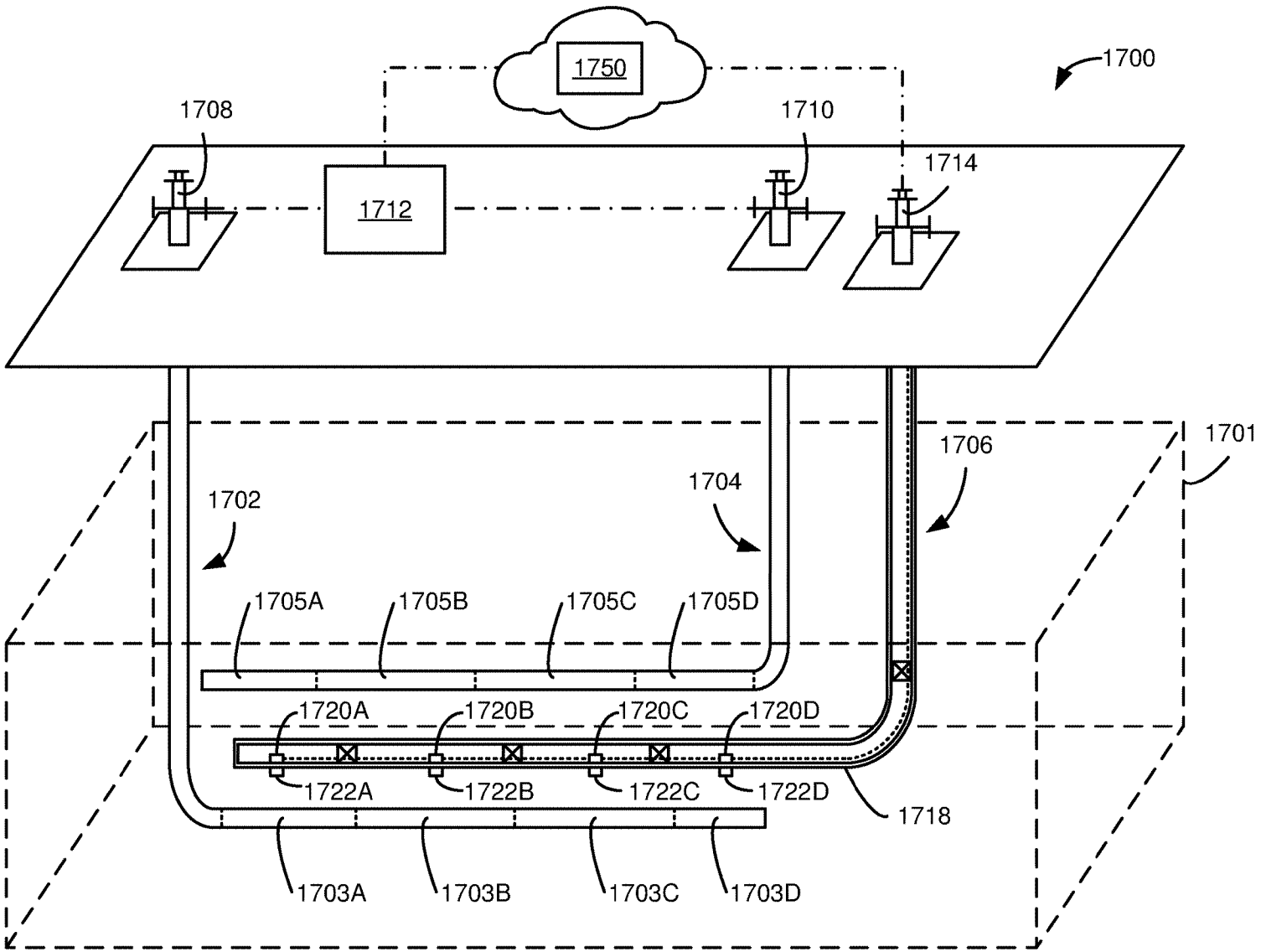
FIG. 17 is a schematic diagram of another example well completion environment including two target wells and a monitor well and illustrating a fracturing operation in accordance with the present disclosure.

FIG. 17 is a schematic illustration of an alternative well environment 1700 including a first target well 1702, a second target well 1704, and a monitor well 1706, which may be sealed, extending through a subterranean formation 1701 and illustrates the use of the single monitor well 1706 for monitoring and controlling fracturing operations in each of the target wells 1702, 1704. As illustrated, the monitor well 1706 is generally disposed between the target wells 1702, 1704 such that the monitor well 1706 may intercept fractures propagating from each of the target wells 1702, 1704. The monitor well 1706 and each of the target wells 1702, 1704 are shown from substantially offset vertical sections; however, it is also possible that the monitor well 1706 and target wells 1702, 1704 may be initiated from the same pad. Thus, the relative orientation of the wells is provided as example and should not be construed as limiting. Moreover, it should be appreciated that the location of the monitor well 1706 of FIG. 17 is provided as an example and, as a result, should not be viewed as limiting. For example, in the specific context of FIG. 17, any of wells 1702, 1704, and 1706 may be configured as a monitor well for operations conducted on the other two wells. More generally, in multi-well applications, the monitor well 1706 is positioned such that it may intercept fractures extending from any number of target wells.

Each of the target wells 1702, 1704 is divided into a respective set of stages. More particularly, the first target well 1702 is divided into stages 1703A-D (from the toe to the heel of the first target well 1702) and the second target well 1704 is divided into stages 1705A-D (from the toe to the heel of the second target well 1704). During completion, each stage of each of the target wells 1702, 1704 may be fractured in order from the toe to the heel, the heel to the toe, or any other suitable order. Fracturing generally includes a process of isolating the stage being fractured (such as by installing a downhole isolation plug), perforating the stage, and pumping fracturing fluid into the perforations to form and propagate fractures from the active target well into the surrounding formation.

As illustrated in FIG. 17, each of the target wells 1702, 1704 includes a respective wellhead assembly 1708, 1710 adapted to be coupled to a pumping system 1712. The pumping system 1712 may generally include equipment adapted to control injection of fracturing fluid into the target wells 1702, 1704 and general processing of such fracturing fluid. Among other things, the pumping system 1712 may be adapted to modify the injection rate and/or pressure of the fracturing fluid, size, and/or concentration of proppant in the fracturing fluid, concentration of any additives in the fracturing fluid, and any other similar parameter associated with injecting fracturing fluid into either of the target wells 1702, 1704. Although illustrated as being coupled to a shared pumping system 1712, each of the target wells 1702, 1704 may instead by coupled to a respective pumping system, each of which is adapted to monitor and control fracturing operations for one of the target wells 1702, 1704. The monitor well 1706 and the target wells 1702, 1704 are shown from substantially offset vertical sections; however, it is also possible that the wells 1702-1706 may be initiated from the same pad. Thus, the relative orientation of the wells is provided as example and should not be construed as limiting.

The monitor well 1706 may also include a wellhead 1714, may be at least partially sealed, and may be at least partially filled with a liquid, such as water, or other relatively incompressible substance to facilitate observations of pressure responses within the monitor well 1706. In one implementation, the monitor well 1706 may be encompassed by a casing 1718 and may include one or more plugs (not shown) to seal portions of the monitor well 1706. The monitor well 1706 may further include various sensors disposed in the wellhead 1714, along the casing 1718, or within the casing 1718 to monitor pressure within the monitor well 1706, strain on the casing 1718, and other operational parameters. For example, the monitor well 1706 includes multiple pressure transducers 1720A-D disposed along its length as well as corresponding strain gauges 1722A-D coupled to the casing 1718. In certain implementations, the strain gauges 1722A-D may be replaced or supplemented with other strain measurement devices, such as an optical fiber.

As illustrated in FIG. 17, each of the pressure transducers 1720A-D is disposed in a respective isolated section of the monitor well 1706. In particular bridge plugs 1770A-D are installed along the length of the monitor well 1706 to form the isolated sections of the monitor well 1706, which are isolated both from each other and from the surrounding formation. Nevertheless and as previously discussed in the context of FIG. 14-16, in at least some implementations of the present disclosure, the monitor well 1706 may be at least partially open such that the pressure transducers 1720A-D measure pressure within the same volume.

Although discussed herein as being cased but not completed, it should be appreciated that monitor wells in accordance with the present disclosure may also be at least partially completed. For example, in one implementation a partially completed (e.g., a well including at least one fracture) well may be configured as a monitor well by installing a solid bridge plug or similar isolation tool above the uppermost fracture. By doing so, a sealed portion of the well is isolated from any previously completed portions. Internal pressure of the sealed portion may then be monitored and used to assess interaction of the well with the offset wells being completed.

Each of the pumping system 1712 and the various sensors and transducers of the monitor well 1706 are communicatively coupled to a computer system 1750. The computer system 1750 is generally configured to receive measurements from the sensors of the monitor well 1706 and, based on the received measurements, to control operation of the pumping system 1712.

As described below in more detail, the monitor well 1706 is used to monitor and facilitate fracturing operations for each of the target wells 1702, 1704. In one example implementation, the monitor well 1706 may be used to facilitate alternate fracturing of stages of the first target well 1702 with those of the second target well 1704. For example, the monitor well 1706 may be used to monitoring fracturing operations for the toe stage 1703A of the first target well 1702. In response to determining that sufficient fracturing of the toe stage 1703A has occurred (e.g., by a suitable pressure response of the monitor well 1706), the computing system 1750 may then initiate fracturing of the toe stage 1705A of the second target well 1704. This process may be repeated for at least some of the remaining stages of the target wells 1702, 1704

As illustrated in FIG. 17, the target wells 1702, 1704 extend through the subterranean formation 1701 in substantially opposite directions and originate from separate well pads. However, in other implementations, the target wells 1702, 1704 may extend adjacent to one another and/or may originate from a common well pad. For example, in so-called "zipper" fracturing operations, multiple target wells are drilled such that at least a portion of the wells are substantially parallel to one other. Such target wells may also extend from a common well pad. The stages of the target wells are then fractured alternately. For example, a first stage of a first target well is fractured followed by a first stage of a second target well followed by a second stage of the first target well, and so on. It should be appreciated that alternately fracturing the wells may include fracturing one or more stages at a time. In other words, a first set of stages may be fractured in the first well followed by a first set of stages of the second well, followed by a second set of stages of the first well, and so on, with each set of stages including one or more stages. In addition to providing a more complete fracturing of the subterranean formation through which the target wells extend, such operations may provide substantial efficiencies by allowing each well to be serviced/completed from a single well pad and/or by enabling preparation (e.g., plugging and perforating) of stages of one of the target wells during fracturing of the other.

In applications in which multiple wells may be fractured from a common well pad, the wellheads of such wells may include a manifold adapted to redirect flow of fracturing fluid between the target wells. In such cases, the manifold (or other similar valve systems for redirecting fracturing fluid flow between target wells) may also be in communication with the pumping system 1712 and/or the computing system 1750 such that the pumping system 1712 and/or the computing system 1750 may control the flow of fracturing fluid between the target wells.

Figure 18:
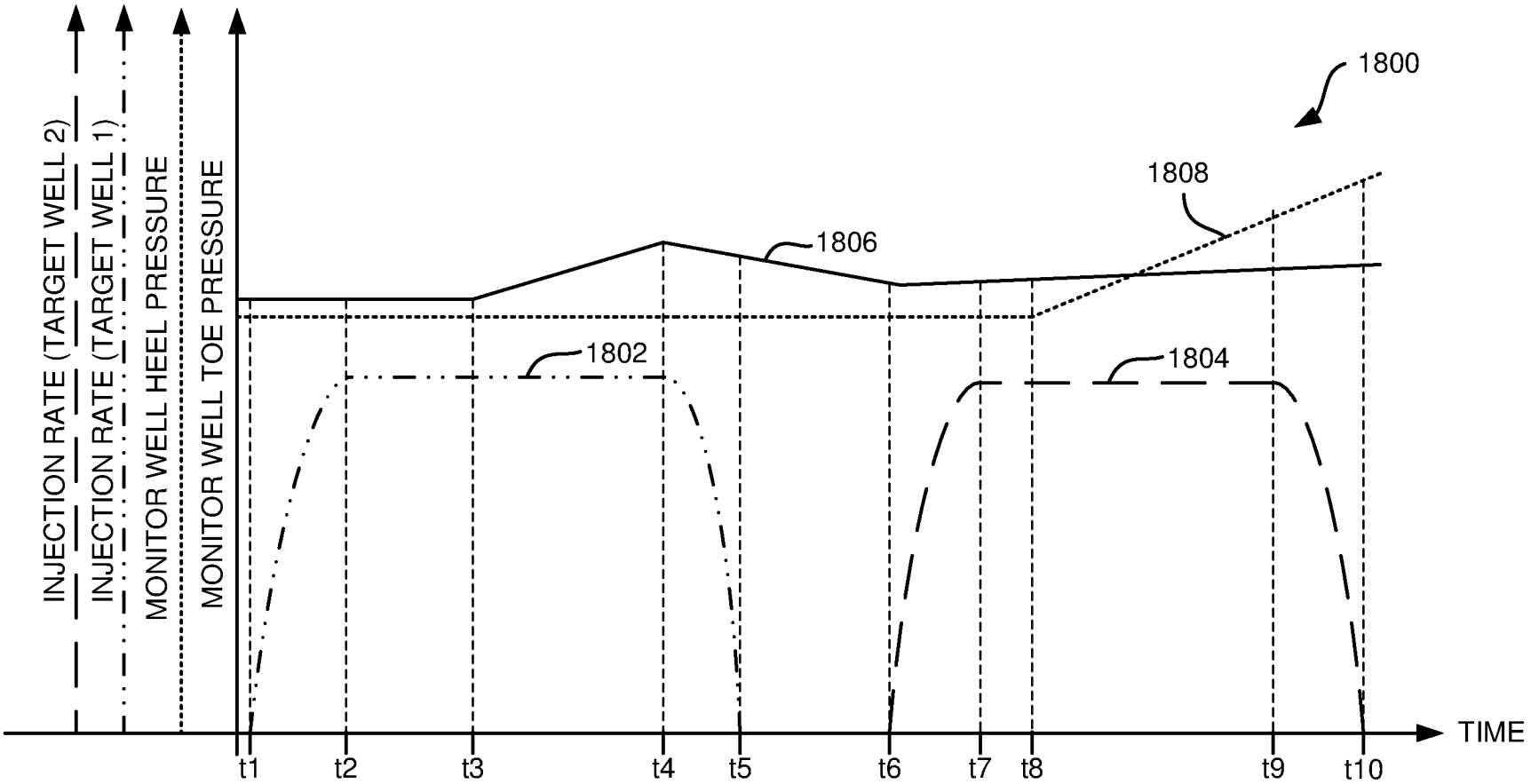
FIG. 18 is a graph illustrating a pressure response of a monitor well during an example fracturing operation of two target wells.

FIG. 18 is a graph 1800 illustrating an example fracturing operation consistent with the foregoing description of fracturing multiple target wells using a single monitor well. The graph 1800 illustrates various metrics over time during an example fracturing operation. More specifically, the graph 1800 includes a first line 1802 indicating fracturing fluid injection rate into the first target well 1702, a second line 1804 indicating fracturing fluid injection rate into the second target well 1704, a third line 1806 indicating first pressure measurements taken at a first location of the monitor well 1706, and a fourth line 1808 indicating second pressure measurements taken at a second location of the monitor well 1706. For purposes of the current example, the first location of the pressure transducer in the monitor well 1706 (indicated by the third line 1806) is assumed to be at a heel of the monitor well 1706 (or more specifically an isolated heel section of the monitor well 1706) and, as a result, the pressure measurements indicated by the third line 1806 may correspond to pressure measurements obtained from the heel pressure transducer 1720D. Similarly, the second location of the pressure transducer in the monitor well 1706 (indicated by the fourth line 1808) is assumed to be at a toe of the monitor well 1706 (or, more specifically, an isolated toes section of the monitor well 1706) and, as a result, the pressure measurement indicated by the fourth line 1808 may correspond to measurements obtained from the toe pressure transducer 1720A.

Beginning at t1, the fracturing fluid injection rate for the first target well 1702 is gradually increased to a first injection rate at time t2. During the time period between t1 and t2, the pressure in each of the first location and the second location of the monitor well 1706 remains substantially constant, indicating that fractures have not yet sufficiently propagated from the first target well 1702 to interact with the monitor well 1706.

At time t3, a pressure change is observed at the first monitor well location (i.e., the isolated heel portion of the monitor well 1706), indicating that a dominant fracture from the first target well 1702 has sufficiently propagated toward and influenced pressure within the monitor well 1706 (e.g., by intersecting the monitor well 1706), as measured by pressure transducer 1720D. The presence of the dominant fracture from the first target well 1702 may be verified by, among other things, strain gauge readings obtained from the strain gauge 1722D. As noted above, in other implementations, such strain gauge readings may be supplemented or substituted by strain readings obtained using an optical fiber disposed along the wellbore. In contrast, the pressure measurements obtained at the second monitor well pressure transducer 1720A location (i.e., the isolated toe portion of the monitor well 1706) remain relatively unchanged.

At time t4, the fracturing fluid injection rate for the first target well 1702 is reduced from the first rate. In the specific illustrated example, this decrease eventually results in complete cessation of fracturing fluid being provided into the first target well 1702 at time t5. Alternatively the fracturing fluid injection rate may instead be reduced to a sufficiently low level that interactions between the first target well 1702 and the monitor well 1706 are significantly reduced. In either case, reducing the fracturing fluid injection rate may cause the pressures and stresses within the formation to gradually drop, as indicated by a gradual decline in the pressures observed in the heel of the monitor well 1706 between times t4 and t6.

At time t6, fracturing of the second target well 1704 begins. More specifically, the fracturing fluid injection rate for the second target well 1704 is increased until a target injection rate is reached at time t7. At time t8, the pressure within the monitor well 1706 is again observed as increasing. However, such increase is observed primarily in the isolated toe portion of the monitor well 1706, indicating that dominant fractures from the toe stage 1705A of the second target well 1704 have sufficiently propagated to influence pressure within at least a portion of the monitor well 1706. When such a response is detected, the injection of fracturing fluid into the second target well 1704 may be reduced or stopped, as indicated by the transition between times t9 and t10.

The foregoing process may be repeated for additional stages of the target wells 1702, 1704. In other words, fracturing fluid may be injected into a stage of the first target well 1702 until a sufficient pressure or other response is detected in the monitor well 1706. After such a response, fracturing fluid may be diverted or otherwise provided to the second target well 1704 to fracture a corresponding stage of the second target well 1704. As previously discussed, during periods in which one of the target well 1702, 1704 is being fractured, the other target well may be prepared for a subsequent fracturing operation, such as by running wireline or similar tools to plug and/or perforate the target well not currently being fractured.

In certain cases, preparation for subsequent fracturing operations may include pumping fluid downhole. For example, plug and perforating tools are often transported downhole using a pump down operation. Such pumping activities in a previously fractured well may result in a response in the monitor well due to at least some of the fractures remaining open. Accordingly, in certain multi-well implementations of the present disclosure, differentiation must be made between monitor well responses attributable to preparation-related activities and those attributable to propagation of fractures from wells being actively fractured. In some cases, such differentiation may be achieved by identifying where the pressure response is observed. For example, if previously formed fractures from a first well crossed a toe portion of the monitor well and a second well is being actively fractured in proximity to the heel of the monitor well, pressure responses observed in the toe portion of the monitor well during both preparation activities in the first well and active fracturing of the second well may be disregarded (or otherwise not attributed to the active fracturing of the second well).

While the pressure transducers in the foregoing example are described as being in isolated sections of the monitor well, it should be appreciated that in other implementations, the pressure transducers may be disposed at different locations of an open (i.e., not isolated) well or disposed in the same isolated portion of the monitor well. In such cases, the pressure measurements obtained from such transducers may be substantially the same or otherwise track each other. Accordingly, to differentiate if and when new fractures cross the monitor well and, in particular, when fractures originate from a first well of a multi-well operation versus a second well, other metrics may be required. For example and without limitation, in one implementation the location of a fracture may be approximated by determining which pressure transducer leads the other. In other implementations, other sensors may be used alone or in combination with the pressure transducers to determine the location of fractures. For example, strain gauges or other force sensors disposed on the casing of the monitor well may be used to determine the location of forces applied to the casing by propagating fractures. In either case, the location of fractures crossing the monitor well in combination with known information regarding the location of the wells being fractured and likely fracture propagation paths for each well, may be used to identify when fractures from a given well have crossed the monitor well.

Figure 19:
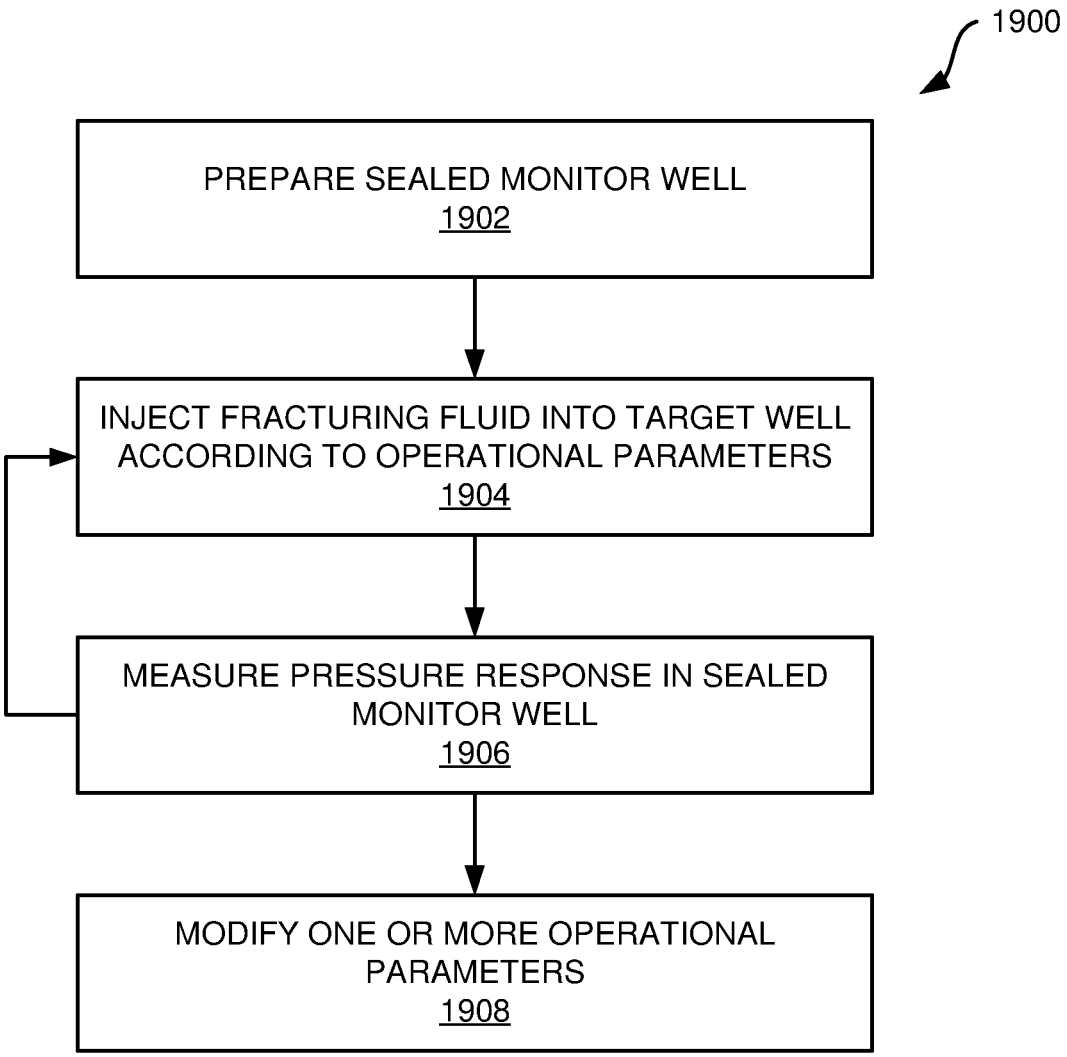
FIG. 19 is a flow chart illustrating a method of performing a fracturing operation in accordance with the present disclosure.

FIG. 19 is a flow chart illustrating an example method 1900 of fracturing one or more target wells in a subterranean formation. In general, such fracturing is facilitated by a monitor well that extends through the subterranean formation. More specifically, the monitor well is positioned relative to the target well(s) such that as fractures propagate through the subterranean formation and induce stresses therein, a corresponding pressure response is observable within the monitor well. Based on such pressure responses, parameters of the fracturing operation may be dynamically modified.

At operation 1902 the monitor well is prepared. Preparation of the monitor well may include one or more of drilling the monitor wellbore, installing a casing within the monitor well and sealing a portion of the monitor wellbore. To improve the pressure response of the monitor well, the monitor well may also be filled with a liquid, such as water. Accordingly, preparation of the monitor well may further include injecting liquid into the monitor well. Injecting liquid into the monitor well may also facilitate the removal of gasses and other relatively compressible fluids from within the monitor well that may negatively impact the responsiveness of the monitor well. Preparation of the monitor well may also include installation of surface and/or subsurface transducers in the monitor well and/or splitting the monitor well into two or more separate pressure chambers, each with its own transducer, to monitor individual, isolated pressure responses at specific locations along the monitor well. For example, in implementations in which the monitor well is a vertical well, the monitor well may be divided into isolated sections. Fracture height and growth may subsequently be tracked by monitoring the progression and sequence of pressure responses in the isolated sections.

In implementations in which preparation of the monitor wellbore includes drilling of the monitor wellbore, such drilling may be performed to locate the monitor well such that the monitor well extends through a plane perpendicular to at least a portion of the intended target well. For example, the monitor wellbore may be drilled to be at least partially parallel to the target well. In implementations in which multiple target wells are to be fractured, the monitor well may be drilled to extend between the target wells or it may be located such that all target wells are on one side of the monitor well. In general, however, the monitor well may be drilled such that the monitor well extends through a location in the subterranean formation through which fractures of the target well are likely to propagate or within which stresses are likely to be induced during fracturing of the target well.

With the monitor well prepared, a fracturing fluid is pumped into the target well according to one or more fracturing operation parameters (operation 1904). As fracturing fluid is pumped into the target well resulting in formation and/or propagation of fractures from the target well and, more specifically, from perforations formed in the target well.

As the fractures propagate through the subterranean formation, they extend toward the monitor well and induce a measured pressure response within the monitor well (operation 1906). To measure the pressure response, the monitor well includes one or more pressure transducers or similar sensors configured to measure pressure within the monitor well and to communicate such measurements to a computing system. One or more pressure transducers may be distributed along the monitor well and/or may be located within a wellhead of the monitor well. In general, the measured pressure response may correspond to any change in pressure within at least a portion of the monitor well. For example and without limitation, the measured pressure response may be an absolute change in pressure, a relative change in pressure, an increase or decrease in a rate of pressure change, or any other pressure-related metric.

In certain implementations, one or more additional sensors may be used to verify and locate the pressure response. For example and without limitation, one or more strain gauges may be disposed along the casing of the monitor well to measure deformation of the casing in response to stresses induced in the subterranean formation during fracturing operations. Similar to the measured pressure response, the measured strain response may be considered to indicate a fracture if a measured strain response meets certain criteria. For example and without limitation, the measured strain response may correspond to an absolute change in strain, a relative change in strain, an increase or decrease in a rate of change of strain, or any other strain-related metric.

As illustrated in FIG. 19, the process of injecting fracturing fluid (operation 1904) and measuring the pressure response within the monitor well (operation 1906) may be repeated until, for example, a particular response (e.g., a pressure increase, a pressure decrease, a rate of pressure change, etc.) is measured. In response to identifying and optionally verifying the pressure change response within the monitor well, one or more of the fracturing operation parameters may be modified (operation 1908). In one example implementation, modifying the fracturing operation parameters may include reducing the fracturing fluid injection rate, including reducing the injection rate to zero. Modifying the fracturing operation parameters may also include, without limitation, one or more of modifying the injection rate and/or pressure of the fracturing fluid, modifying the size and/or concentration of proppant in the fracturing fluid, changing a concentration of any additives in the fracturing fluid, and changing any other similar parameter associated with injecting fracturing fluid into the target wells.

In one example implementation, modifying the fracturing operation parameters may include each of reducing an injection rate for a first target well and increasing an injection rate for a second target well. In implementations in which each of the first target well and the second target well are coupled to respective pumping systems, each pumping system may be controlled to change the injection rates. In other implementations in which fracturing fluid is provided to both target wells from a common pumping system, modifying the injection rates for the target wells may include actuating one or more valves or similar fluid control devices to adjust the proportion of fracturing fluid delivered to each target well.

Although the example method 1900 refers to only a single monitor well, implementations of the present disclosure may include multiple monitor wells and, as a result, may include preparing one or more of the monitor wells. Accordingly, implementations of the method 1900 according to the present disclosure are not limited to instances in which only a single monitor well is used.

Figure 20:
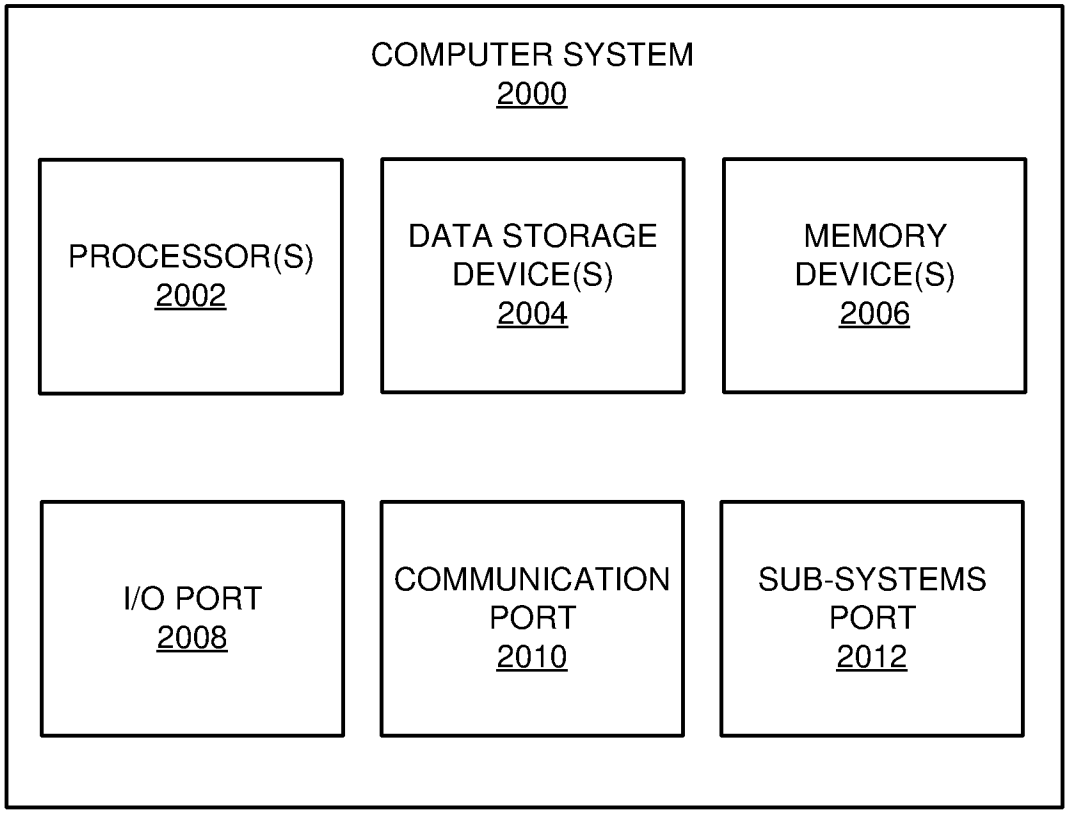
FIG. 20 is an example computing system that may implement various systems and methods of the presently disclosed technology.

Referring to FIG. 20, a detailed description of an example computing system 2000 having one or more computing units that may implement various systems and methods discussed herein is provided. It will be appreciated that specific implementations of these devices may be of differing possible specific computing architectures not all of which are specifically discussed herein but will be understood by those of ordinary skill in the art.

The computing system 2000 is generally configured to receive and process pressure measurement data from a pressure transducer or similar sensor associated with the monitor well, such as the monitor well 122 shown in FIG. 1 (or any other monitor well discussed herein). Processing of pressure measurement data from the monitor well 122 may include, without limitation, performing one or more calculations on the pressure measurement data, transmitting the pressure measurement data, storing the pressure measurement data, formatting the pressure measurement data, displaying the pressure measurement data or data derived therefrom, and generating or suggesting control signals in response to the pressure measurement data. In one implementation, for example, the computing system 2000 is communicatively coupled to the pumping system 132 and is configured to generate and send control signals to the pumping system 132 to adjust the properties of the fracturing fluid provided by the pumping system 132.

The computer system 2000 may be a computing system capable of executing a computer program product to execute a computer process. Data and program files may be input to the computer system 2000, which reads the files and executes the programs therein. Some of the elements of the computer system 2000 are shown in FIG. 20, including one or more hardware processors 2002, one or more data storage devices 2004, one or more memory devices 2008, and/or one or more ports 2008-2012. Additionally, other elements that will be recognized by those skilled in the art may be included in the computing system 2000 but are not explicitly depicted in FIG. 20 or discussed further herein. Various elements of the computer system 2000 may communicate with one another by way of one or more communication buses, point-to-point communication paths, or other communication means not explicitly depicted in FIG. 20.

The processor 2002 may include, for example, one or more of a central processing unit (CPU), a graphics processing unit (GPU), an application specific integrated circuit (ASIC), a tensor processing unit (TPU), an a artificial intelligence (AI) processor, a microprocessor, a microcontroller, a digital signal processor (DSP), and/or one or more internal levels of cache. There may be one or more processors 2002, such that the processor 2002 comprises a single central-processing unit, or a plurality of processing units capable of executing instructions and performing operations in parallel with each other, commonly referred to as a parallel processing environment.

The computer system 2000 may be a conventional computer, a distributed computer, or any other type of computer, such as one or more external computers made available via a cloud computing architecture. The presently described technology is optionally implemented in software stored on the data stored device(s) 2004, stored on the memory device(s) 2006, and/or communicated via one or more of the ports 2008-2012, thereby transforming the computer system 2000 in FIG. 20 to a special purpose machine for implementing the operations described herein. Examples of the computer system 2000 include personal computers, terminals, workstations, clusters, nodes, mobile phones, tablets, laptops, personal computers, multimedia consoles, gaming consoles, set top boxes, and the like.

The one or more data storage devices 2004 may include any non-volatile data storage device capable of storing data generated or employed within the computing system 2000, such as computer executable instructions for performing a computer process, which may include instructions of both application programs and an operating system (OS) that manages the various components of the computing system 2000. The data storage devices 2004 may include, without limitation, magnetic disk drives, optical disk drives, solid state drives (SSDs), flash drives, and the like. The data storage devices 2004 may include removable data storage media, non-removable data storage media, and/or external storage devices made available via a wired or wireless network architecture with such computer program products, including one or more database management products, web server products, application server products, and/or other additional software components. Examples of removable data storage media include Compact Disc Read-Only Memory (CD-ROM), Digital Versatile Disc Read-Only Memory (DVD-ROM), magneto-optical disks, flash drives, and the like. Examples of non-removable data storage media include internal magnetic hard disks, SSDs, and the like. The one or more memory devices 2006 may include volatile memory (e.g., dynamic random access memory (DRAM), static random access memory (SRAM), etc.) and/or non-volatile memory (e.g., read-only memory (ROM), flash memory, etc.).

Computer program products containing mechanisms to effectuate the systems and methods in accordance with the presently described technology may reside in the data storage devices 2004 and/or the memory devices 2006, which may be referred to as machine-readable media. It will be appreciated that machine-readable media may include any tangible non-transitory medium that is capable of storing or encoding instructions to perform any one or more of the operations of the present disclosure for execution by a machine or that is capable of storing or encoding data structures and/or modules utilized by or associated with such instructions. Machine-readable media may include a single medium or multiple media (e.g., a centralized or distributed database, and/or associated caches and servers) that store the one or more executable instructions or data structures.

In some implementations, the computer system 2000 includes one or more ports, such as an input/output (I/O) port 2008, a communication port 2010, and a sub-systems port 2012, for communicating with other computing, network, or vehicle devices. It will be appreciated that the ports 2008-2012 may be combined or separate and that more or fewer ports may be included in the computer system 2000.

The I/O port 2008 may be connected to an I/O device, or other device, by which information is input to or output from the computing system 2000. Such I/O devices may include, without limitation, one or more input devices, output devices, and/or environment transducer devices.

In one implementation, the input devices convert a human-generated signal, such as, human voice, physical movement, physical touch or pressure, and/or the like, into electrical signals as input data into the computing system 2000 via the I/O port 2008. Similarly, the output devices may convert electrical signals received from the computing system 2000 via the I/O port 2008 into signals that may be sensed as output by a human, such as sound, light, and/or touch. The input device may be an alphanumeric input device, including alphanumeric and other keys for communicating information and/or command selections to the processor 2002 via the I/O port 2008. The input device may be another type of user input device including, but not limited to: direction and selection control devices, such as a mouse, a trackball, cursor direction keys, a joystick, and/or a wheel; one or more sensors, such as a camera, a microphone, a positional sensor, an orientation sensor, a gravitational sensor, an inertial sensor, and/or an accelerometer; and/or a touch-sensitive display screen ("touchscreen"). The output devices may include, without limitation, a display, a touchscreen, a speaker, a tactile and/or haptic output device, and/or the like. In some implementations, the input device and the output device may be the same device, for example, in the case of a touchscreen.

The environment transducer devices convert one form of energy or signal into another for input into or output from the computing system 2000 via the I/O port 2008. For example, an electrical signal generated within the computing system 2000 may be converted to another type of signal, and/or vice-versa. In one implementation, the environment transducer devices sense characteristics or aspects of an environment local to or remote from the computing system 2000, such as, light, sound, temperature, pressure, magnetic field, electric field, chemical properties, physical movement, orientation, acceleration, gravity, and/or the like. Further, the environment transducer devices may generate signals to impose some effect on the environment either local to or remote from the computing device 2000, such as, physical movement of some object (e.g., a mechanical actuator), heating or cooling of a substance, adding a chemical substance, and/or the like.

In one implementation, a communication port 2010 is connected to a network by way of which the computer system 2000 may receive network data useful in executing the methods and systems set out herein as well as transmitting information and network configuration changes determined thereby. Stated differently, the communication port 2010 connects the computer system 2000 to one or more communication interface devices configured to transmit and/or receive information between the computing system 2000 and other devices by way of one or more wired or wireless communication networks or connections. Examples of such networks or connections include, without limitation, Universal Serial Bus (USB), Ethernet, Wi-Fi, Bluetooth®, Near Field Communication (NFC), Long-Term Evolution (LTE), and so on. One or more such communication interface devices may be utilized via the communication port 2010 to communicate with one or more other machines, either directly over a point-to-point communication path, over a wide area network (WAN) (e.g., the Internet), over a local area network (LAN), over a cellular (e.g., third generation (3G) or fourth generation (4G)) network, or over another communication means including any existing or future protocols including, without limitation fifth generation (5G), mesh networks and distributed networks. Further, the communication port 2010 may communicate with an antenna for electromagnetic signal transmission and/or reception.

In certain implementations, the communication port 2010 is configured to communicate with one or more process control networks and/or process control devices including one or more of standalone, distributed, or remote/server-based control systems. In such implementations, the communication port 2010 is coupled to the process control networks and/or devices by a network, bus, hard-wire, or any other suitable connection. Such process control systems may include, without limitation, supervisory control and data acquisition (SCADA) systems and distributed control systems (DCSs) and may include one or more of programmable logic controllers (PLCs), programmable automation controllers (PACs), input/output (I/O) devices, human-machine interfaces (HMIs) and HMI workstations, servers, process historians, and other process control-related devices. Accordingly, the communication port 2010 facilitates communication between the computing system 2000 and process control equipment using one or more process-control related protocols including, without limitation, fieldbus, Ethernet fieldbus, Ethernet TCP/IP, Controller Area Network, ControlNet, DeviceNet, Highway Addressable Remote Transducer (HART) protocol, and OLE for Process Control (OPC), Wellsite Information Transfer Standard Markup Language (WITSML), and Universal File and Stream Loading (UFL).

Computer system 2000 may include a sub-systems port 2012 for communicating with one or more external systems to control an operation of the external system and/or exchange information between the computer system 2000 and one or more sub-systems of the external system. In certain implementations, the sub-systems port 2012 is configured to communicate with sub-systems of a pump truck or similar vehicle configured to provide pressurized fracturing fluid to a well including, without limitation, sub-systems directed to controlling and monitoring pumps and associated pumping equipment.

The system set forth in FIG. 20 is but one possible example of a computer system that may employ or be configured in accordance with aspects of the present disclosure. It will be appreciated that other non-transitory tangible computer-readable storage media storing computer-executable instructions for implementing the presently disclosed technology on a computing system may be utilized.

In the present disclosure, the methods disclosed may be implemented, at least in part, as sets of instructions or software readable by a device. Further, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A machine-readable medium includes any mechanism for storing information in a form (e.g., software, processing application) readable by a machine (e.g., a computer). The machine-readable medium may include, but is not limited to, magnetic storage medium, optical storage medium; magneto-optical storage medium, read only memory (ROM); random access memory (RAM); erasable programmable memory (e.g., EPROM and EEPROM); flash memory; or other types of medium suitable for storing electronic instructions.

While the present disclosure has been described with reference to various implementations, it will be understood that these implementations are illustrative and that the scope of the present disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow further below.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended thereto.

What is claimed is:

1. A method of hydraulically fracturing subterranean formations comprising:

while hydraulic fracturing a target well according to a completion operation parameter, the target well extending through a subterranean formation and a fracture growing from the target well responsive to the hydraulic fracturing, modifying the completion operation parameter responsive to detection of a change of pressure within a liquid filled cased section of a monitor well extending through the subterranean formation, the change of pressure within the liquid filled cased section of the monitor well resulting from deformation of a casing of the liquid filled cased section of the monitor well caused by the fracture growing from the target well, wherein the casing seals the cased section of the monitor well relative to the subterranean formation.

2. The method of claim 1, wherein the liquid filled cased section is a first volume defined within the monitor well that is sealed relative to each of the subterranean formation and a second volume defined within the monitor well.

3. The method of claim 1, wherein the change of pressure within the liquid filled cased section is identified using a pressure transducer adapted to measure pressure within the liquid filled cased section.

4. The method of claim 1, wherein the liquid filled cased section includes an entirety of a downhole volume of the monitor well.

5. The method of claim 1, wherein the liquid filled cased section is filled with the liquid to optimize pressure response from the interactions between the liquid filled cased section and the fracture growing from the target well.

6. The method of claim 1, wherein the liquid filled cased section is in communication with a wellhead of the monitor well and the change of pressure within the liquid filled cased section is detected using a pressure transducer at the wellhead.

7. The method of claim 1, wherein:

the liquid filled cased section includes a first sealed volume portion and a second sealed volume portion isolated from the first sealed volume portion, and the change of pressure within the liquid filled cased section is detected in one of the first sealed volume portion using a first pressure transducer adapted to measure pressure changes in the first sealed volume portion or the second sealed volume portion using a second pressure transducer adapted to measure pressure changes in the second sealed volume portion.

8. The method of claim 1, wherein modifying the completion operation parameter is further in response to a pressure change in the subterranean formation, the pressure change in the subterranean formation detected using a pressure transducer adapted to measure pressure within the subterranean formation.

9. The method of claim 1, wherein the completion operation parameter is a hydraulic fracturing fluid injection rate.

10. The method of claim 1, wherein:

the monitor well includes at least one of a strain gauge or an optical fiber adapted to measure a strain on a casing of the monitor well, and modifying the completion parameter is further responsive to detecting a change of strain on the casing.

11. The method of claim 1, wherein at least one of the target well and the monitor well is formed such that the monitor well extends through a plane defined by a predominant fracture growth path extending from the target well.

12. The method of claim 1, wherein modifying the completion operation parameter comprises reducing an injection rate of hydraulic fracturing fluid into the target well.

13. The method of claim 12 wherein modifying the completion operation parameter further comprises, subsequent to reducing the injection rate of hydraulic fracturing fluid into the target well, increasing the injection rate of hydraulic fracturing fluid into the target well.

14. The method of claim 12, wherein the target well is a first target well, the method further comprising, subsequent to reducing the injection rate of hydraulic fracturing fluid into the first target well, initiating injection of hydraulic fracturing fluid into a second target well different from the first target well.

15. The method of claim 14 further comprising:

subsequent to initiating injection of hydraulic fracturing fluid into the second target well and responsive to detecting a second change of pressure within the liquid filled cased section, reducing an injection rate of hydraulic fracturing fluid into the second target well.

16. The method of claim 15 further comprising, subsequent to reducing the injection rate of hydraulic fracturing fluid into the second target well, initiating pumping of hydraulic fracturing fluid into a third target well, wherein the third target well is one of the first target well or a well other than the first target well and the second target well.

17. A method of fracturing subterranean formations comprising:

while hydraulic fracturing a first target well causing a fracture to extend from the first target well through a subterranean formation, decreasing an injection rate of hydraulic fracturing fluid into the first target well and increasing an injection rate of hydraulic fracturing fluid into a second target well extending through the subterranean formation responsive to detection of a pressure response of a liquid filled cased section defined within a monitor well extending through the subterranean formation, the pressure response of the liquid filled cased section resulting from interactions between the sealed volume and the fracture extending from the first target well deforming a casing of the liquid filled cased section, wherein the liquid filled cased section is sealed relative to the subterranean formation.

18. The method of claim 17 further comprising, subsequent to increasing the injection rate of fracturing fluid into the second target well and responsive to a second pressure response of the liquid filled cased section resulting from a fracture extending from the second target well deforming the casing of the liquid filled cased section, each of reducing the injection rate of hydraulic fracturing fluid into the second target well and increasing an injection rate of fracturing fluid into a third target well, wherein the third target well is one of the first target well, the second target well, or a target well other than the first target well and the second target well.

19. The method of claim 18, wherein:

reducing the injection rate of fracturing fluid into the first target well comprises reducing the injection rate of fracturing fluid into a first stage of the first target well, increasing the injection rate of fracturing fluid into the second target well comprises increasing the injection rate of fracturing fluid into a first stage of the second target well, and increasing the injection rate of fracturing fluid into the third target well comprises one of:

increasing an injection rate of fracturing fluid into a second stage of the first target well, increasing an injection rate of fracturing fluid into a second stage of the second target well, or increasing an injection rate of fracturing fluid into a first stage of the target well other than the first target well and the second target well.

20. The method of claim 17, wherein the liquid filled cased section includes one of an entirety of a downhole volume of the monitor well or a portion of a downhole volume of the monitor well.

21. A system for providing a fracturing fluid to a subterranean formation comprising:

one or more hardware processors configured by machine-readable instructions to:

while hydraulic fracturing a target well according to a completion operation parameter, the target well extending through a subterranean formation and a fracture extending from target well from the hydraulic fracturing, modify the completion operation parameter responsive to detection of a change of pressure within a liquid filled cased section of a monitor well extending through the subterranean formation, the liquid filled cased section that includes a casing that seals the liquid filled cased section relative to the subterranean formation and the change of pressure within the liquid filled cased section of the monitor well resulting from deformation of a casing of the liquid filed cased section caused by the fracture extending from the target well.

22. The system of claim 21, wherein the one or more hardware processors are configured to modify the completion operation parameter by initiating a rate cycle for the target well.

23. The system of claim 21, wherein modifying the completion operation is further responsive to detecting a change of strain on a casing of the monitor well measured by at least one of a strain gauge or an optical fiber coupled to the casing.

24. The system of claim 21, wherein the change of pressure is measured by a pressure transducer and the pressure transducer is one of disposed within the liquid filled cased section or disposed at a wellhead of the monitor well.

25. The system of claim 21, wherein the liquid filled cased section is a first sealed volume of the monitor well and the monitor well includes a second sealed volume isolated from the first sealed volume.

26. The system of claim 21, wherein the target well is a first target well and the one or more hardware processors further configured to modify the completion operation parameter by reducing an injection rate of hydraulic fracturing fluid into the first target well and increasing an injection rate of hydraulic fracturing fluid into a second target well extending through the subterranean formation.

27. The system of claim 21, wherein an entirety of the monitor well is cased and sealed relative to the subterranean formation.

28. A method of hydraulically fracturing subterranean formations comprising:

pumping hydraulic fracturing fluid into a first well extending through a subterranean formation to propagate a fracture from the first well; and subsequent to pumping the hydraulic fracturing fluid into the first well and in response to a change in pressure within a liquid filled cased section of a second well extending through the subterranean formation, the liquid filled cased section being sealed relative to the subterranean formation reducing an injection rate of hydraulic fracturing fluid into the first well and increasing an injection rate of hydraulic fracturing fluid into a third well, wherein the change in pressure within the liquid filled cased section is due to deformation of a casing of the liquid filled cased section due to interactions between the second well and the fracture propagated from the first well.

29. The method of claim 28, wherein the third well is different from each of the first well and the second well.

* * * * *